US005270156A

United States Patent [19]

Hirabayashi et al.

[11] Patent Number: 5,270,156

[45] Date of Patent: Dec. 14, 1993

[54] SILVER HALIDE COLOR PHOTOGRAPHIC LIGHT SENSITIVE MATERIAL

[75] Inventors: Shigeto Hirabayashi, Hachioji; Shuichi Sugita, Kunitachi; Katsumasa Yamazaki, Hachioji, all of Japan

[73] Assignee: Konica Corporation, Tokyo, Japan

[21] Appl. No.: 936,800

[22] Filed: Aug. 28, 1992

[30] Foreign Application Priority Data

Oct. 11, 1991 [JP] Japan ..... 3-292524
Oct. 11, 1991 [JP] Japan ..... 3-292525
Oct. 11, 1991 [JP] Japan ..... 3-292526

[51] Int. Cl.[5] ..... G03C 1/46

[52] U.S. Cl. ..... 430/505; 430/544; 430/957; 430/558; 430/557; 430/555; 430/508

[58] Field of Search ..... 430/508, 505, 957, 544, 430/558

[56] References Cited

U.S. PATENT DOCUMENTS (List continued on next page.)

FOREIGN PATENT DOCUMENTS 0262567 4/1988 European Pat. Off. .

(List continued on next page.)

*Primary Examiner*—Charles L. Bowers, Jr.
*Assistant Examiner*—Geraldine Letscher
*Attorney, Agent, or Firm*—Finnegan, Henderson, Farabow, Garrett & Dunner

[57] ABSTRACT

Disclosed is a silver halide color photographic light-sensitive material comprising a support having thereon a blue-sensitive silver halide emulsion layer, a green-sensitive silver halide emulsion layer and a red-sensitive silver halide emulsion layer, wherein at least one of green-sensitive silver halide emulsion layers contains at least one of magenta couplers represented by Formula M-I and at least one of compounds capable of releasing a development inhibitor or a precursor of a development inhibitor, upon reaction with oxidized products of a development agent, represented by Formula D-I;

Formula M-I wherein Z represents a group consisting of a non-metal atoms necessary to form a nitrogen containing heterocyclic ring, provided, the ring formed by the Z may have a substituent; X represents a hydrogen atom or a group releasable upon reaction with an oxidized product of a color developing agents; and R represents a hydrogen atom or a substituent, Formula D-I wherein $R_1$ represents an alkyl group, $R_2$ represents an alkyl group or an aryl group, $R_3$ represents an oxycarbonyl group, a sulfonamido group, a carbamoyl group, an acylamino group, an ureido group, an oxycarbonylamino group, a sulfonyloxy group, a carbonyloxy group or a sulfamoyl group, Rrepresents a substituent; n is an integer of 0 to 3; X represents a group capable of releasing a development inhibitor or a precursor upon formation of ortho quinonemethide when released by a coupling to an oxidized product of a color developing agent.

A silver halide color photographic light-sensitive material is improved in sensitivity, image quality, exposure latitude, process variation and color reproducibility.

9 Claims, No Drawings

U.S. PATENT DOCUMENTS

| | | | |
|---|---|---|---|
| 1,044,778 | 11/1912 | Grüttefien et al. | 564/361 |
| 2,369,489 | 2/1945 | Porter et al. | 430/386 |
| 2,376,380 | 5/1945 | Porter et al. | 548/162 |
| 2,428,054 | 9/1947 | Vittum et al. | 430/359 |
| 2,449,966 | 9/1948 | Hanson | 430/359 |
| 2,472,581 | 6/1949 | Gregory | 548/365 |
| 2,600,788 | 6/1952 | Loria et al. | 430/386 |
| 2,763,552 | 9/1956 | Campen et al. | 430/545 |
| 2,835,579 | 5/1958 | Thirtle et al. | 430/546 |
| 2,933,391 | 4/1960 | Feniak et al. | 430/554 |
| 3,476,564 | 11/1969 | Mariani et al. | 430/555 |
| 3,519,429 | 7/1970 | Lestina | 430/551 |
| 3,615,506 | 10/1971 | Abbott et al. | 430/381 |
| 3,725,067 | 4/1973 | Bailey et al. | 430/476 |
| 3,758,309 | 9/1973 | Bailey et al. | 430/587 |
| 3,810,761 | 5/1974 | Bailey et al. | 430/522 |
| 4,146,396 | 3/1979 | Yokota et al. | 430/385 |
| 4,248,962 | 2/1981 | Lau | 430/382 |
| 4,409,323 | 10/1983 | Sato et al. | 430/544 |
| 4,421,845 | 12/1983 | Uemura et al. | 430/544 |
| 4,546,073 | 10/1985 | Bergthaller et al. | 430/543 |
| 4,652,516 | 3/1987 | Ichijima et al. | 430/544 |
| 4,698,297 | 10/1987 | Ichijima et al. | 430/383 |
| 4,880,726 | 11/1989 | Shiba et al. . | |
| 5,006,437 | 4/1991 | Yoshizawa et al. . | |
| 5,009,988 | 4/1991 | Yagi et al. | 430/505 |
| 5,051,346 | 9/1991 | Fujiwhara et al. | 430/544 |
| 5,053,324 | 10/1991 | Sasaki | 430/505 |

FOREIGN PATENT DOCUMENTS

| | | |
|---|---|---|
| 0422513 | 4/1991 | European Pat. Off. . |
| 2336711 | 12/1976 | France . |
| 1552701 | 9/1979 | United Kingdom . |

SILVER HALIDE COLOR PHOTOGRAPHIC LIGHT SENSITIVE MATERIAL

FIELD OF THE INVENTION

This invention relates to a silver halide color photographic light sensitive material and particularly to a silver halide color photographic light sensitive material high in sensitivity and image quality, wide in exposure latitude, excellent in process variation and color reproducibility and satisfactory in aging preservation stability.

BACKGROUND OF THE INVENTION

Color negative type photographic light sensitive materials for photographic use have been demanded to improve the characteristics from various viewpoints. Particularly, the high image qualities such as color reproducibility, graininess and sharpness thereof have been demanded in keeping with the popularization of the recent small-format system.

In the recent color photography, the so-called negative-positive system has been widely popularized, wherein a picture is taken on a color negative film, enlarged on a photographic light sensitive material for color print use and the color print is obtained. One of the reasons is that color films have an extremely low possibility of picture-taking failures and even any common users without having any special knowledge can readily take color photographs, because the films have an extremely wide exposure latitude. This is one of the great features of the negative-positive system, different from reversal films. In the color-negative films, it is essential to have a wide latitude as well as the above-mentioned improvements of graininess and sharpness.

About the color reproducibility, for example, U.S. Pat. No. 3,725,067 and Japanese Patent Publication Open to Public Inspection (hereinafter referred to as JP OPI Publication) Nos. 58-42045/1983, 59-171956/1984, 60-43659/1985 and 60-190779/1985 disclose the techniques for improving color reproducibility with the use of the magenta couplers without having any secondary absorption.

The magenta couplers disclosed in the above-given patents have incomparably improved particularly in bright red-color reproduction. However, the development process variations and, particularly, these patented techniques have a serious color-density variation produced by the pH variations of a developer.

The present inventors have discovered that the so-called process variation improving agents such as those described in JP Application No. 1-263938/1989 are effective against the above-mentioned problem.

In color photographic light sensitive materials, each of yellow, magenta and cyan dyes formed of couplers has not always any ideal absorption characteristics. For example, it is usual that a magenta dye image absorbs necessary green light and, besides, some blue light. Therefore, the resulting color reproduction produces a strain. For removing the above-mentioned strain, a yellow- or magenta-colored coupler is used before making a reaction with the oxidized product of an aromatic primary amine color developing agent, wherein the former is the so-called colored magenta coupler and the latter is the so-called colored cyan coupler.

About the auto-masking methods using the above-mentioned colored couplers therein, they are detailed in, for example, J.Phot.Soc.Am., 13, 94 (1947), J.Opt.Soc.Am., 40, 166 (1950) or J.Am.Chem.Soc., 72, 1533 (1950).

As for the colored magenta couplers having the principal absorption in a blue light region; 1-phenyl-3-acylamino-4-phenylazo-5-pyrazolone is described in U.S. Pat. Nos. 2,428,054 and 2,449,966; those having a 4-methoxyallylazo group, in U.S. Pat. No. 2,763,552; 1-phenyl-3-anilino-4-phenylazo-5-pyrazolone, in U.S. Pat. No. 2,983,608; those having a naphthylazo group, in U.S. Pat. Nos. 3,519,429 and 3,615,506; those having a water-soluble group, in U.S. Pat. No. 1,044,778; those having a hydroxyphenylazo group, in U.S. Pat. No. 3,476,564 and JP OPI Publication Nos. 49-123625/1974, 49-131448/1974 and 54-52532/1979; those having an acylaminophenylazo group, in JP OPI Publication No. 52-42121/1977; those having a substituted alkoxyphenylazo group, in JP OPI Publication No. 52-102723/1977; and those having a thiophenylazo group, in JP OPI Publication No. 53-63016/1978; respectively.

However, for example, a large amount of these colored magenta couplers are to be added because they have a small molar absorption coefficient; the principal absorption thereof is difficult to adjust to a desired region; they have not so much masking effects thereof, because of the low development activity thereof; a fog is liable to produce, though the development activity is high; the stabilities thereof against light, heat and moisture are low; or the magenta dyes produced upon reaction with a color developing agent have a short wavelength. Therefore, they are not desirable as much as satisfied and the present situations are that the characteristics of the colored magenta couplers can barely be maintained by using them in combination. Particularly, the characteristics of the colored magenta couplers have been emphatically required in recent years, since a high-speed fine-grained silver halide emulsion and a high-color developable magenta coupler were used.

On the other hand, novel magenta couplers have been studied with the purposes of reducing a sub-absorption and improving a color reproducibility. For example, the pyrazoloazole type magenta couplers were developed such as those disclosed in U.S. Pat. Nos. 3,725,065, 3,810,761, 3,758,309 and 3,725,067. These magenta couplers have a small sub-absorption. Therefore, the amount of the colored magenta couplers used therein can be saved. However, in the case where a color negative obtained from a color negative film is used for printing on a color negative paper, it was found that the hue came out on the finished color paper becomes erratic (hereinafter referred to as the inter-printer variations), according to the usage of various printing equipments (hereinafter referred to as printers).

The above-mentioned phenomenon may be observed in other conventional couplers. However, the degrees of the phenomenon is too low to be problematic. On the other hand, when making use of a pyrazoloazole type magenta couplers, it was found that the erratic hue of a finished color paper is not on a negligible level depending on the different types of printers used.

The above-mentioned phenomenon is supposedly produced by the following reasons. When making a print from a color negative film onto a color paper by making use of a printer, the printer functions as follows: (1) the blue, green and red densities of a color negative film are measured, respectively; (2) then, the measured values are converted into the exposure amount for the color paper; and (3) the color paper is exposed to light in the above-mentioned exposure amount. On the market, various types of printers are available and used. According to the types of the printers, there may be some instances where the spectral sensitivity of a detector used may be varied when it measures the rays of light described in item (1), and where an erratic hue may be produced because a half-band width, for example, is too narrow according to the spectral absorption characteristics of a color developing dye contained in a color negative film or because the spectral absorption characteristics are varied by the densities.

Some of the above-described pyrazoloazole type magenta couplers are seriously varied by the densities of the spectral absorption characteristics thereof. This is one of the reasons for making an inter-printer variation greater when a pyrazoloazole type magenta coupler is used in a color negative film. Further, these pyrazoloazole type magenta couplers have been demanded to be improved, because they have the serious development process variations including, particularly, the serious color density variation produced by the pH variations of a developer used.

In silver halide color photographic light sensitive materials, the subtractive primaries are used at present, wherein a color image is formed by a combination of three dyes derived from a yellow coupler, a magenta coupler and a cyan coupler.

As for the magenta couplers applicable to conventional silver halide color photographic light sensitive materials, those of the pyrazolone, pyrazolinobenzimidazole or indanone type have been known. Among them, various kinds of 5-pyrazolone type magenta couplers have been used. The 5-pyrazolone type couplers have had various problems of color reproducibility, because the dyes formed in a development process have a sub-absorption in and around 430 nm. For solving the problems, the pyrazolotriazole type couplers have been developed as disclosed in, for example, U.S. Pat. Nos. 3,758,309 and 3,725,067. These couplers have many advantages such as few sub-absorption, the advantage of color reproduction, an excellent color developability and an excellent preservability in the presence of formalin.

However, the pyrazolotriazole type magenta couplers have the defect that the resulting color density is seriously varied by processing variations including particularly the pH variations of a developer used. The present inventors have discovered that the compounds represented by the foregoing Formula [D-I] are effective against the above-mentioned problems. It was proved that the preservability of a raw stock sample including particularly a sensitivity lowering was made serious by moisture, though the processing variations could be improved considerably in this method.

Silver halide color photographic light sensitive materials are usually applied with a yellow coupler, a magenta coupler and a cyan coupler in combination. As for the magenta couplers among these couplers, 5-pyrazolone type magenta couplers are widely used. The 5-pyrazolone type magenta couplers have had various color reproduction problems, because the dyes formed in a development process have a sub-absorption in and around 430 nm. For solving the problems, novel magenta couplers have been studied and the pyrazolotriazole type couplers were developed as disclosed in, for example, U.S. Pat. Nos. 3,725,065, 3,810,761, 3,758,309 and 3,728,067.

These couplers have many advantages such as few subabsorption, an advantage of color reproducibility and an excellent color developability.

However, it was found that there produce the serious development process variations including, particularly, the serious color density variation produced by the pH variations of a developer used.

For improving the above-described defects, the present inventors have discovered the methods detailed in JP Application No. 1-299771/1989 and JP OPI Publication No. 3-126031/1991. However, the methods have not only any satisfactory improvement effects, but the problems of lowering a sensitivity and deteriorating an aging preservation stability. Therefore, it has been demanded to develop a technique for improving the development process variations without spoiling any photographic characteristics.

It became obvious that the silver halide color photographic light sensitive materials containing these pyrazolotriazole type couplers have the problem that the photographic characteristics thereof are liable to vary in the course of preserving them for a long time after they were prepared. Recently, in the photographic industry, the strong demands are being increased for improving the photographic characteristics of the silver halide color photographic light sensitive materials and, particularly, the silver halide color photographic light sensitive materials having few sensitivity difference in aging them and between the lots so as to have the so-called quality-uniformity. Further, with the advance of saving a silver consumption and making layer thinner for the recent silver halide color photographic light sensitive materials, the photographic characteristics thereof are seriously varied in the course of an aging preservation. Therefore, there have been demanded for developing a silver halide color photographic light sensitive material having few photographic characteristic variations in the course of aging preservation, that is those having an excellent raw-stock stability.

SUMMARY OF THE INVENTION

It is an object of the invention is to provide a silver halide color photographic light sensitive material having a high image quality, a wide exposure latitude, an excellent processing variation resistance and a satisfactory color reproducibility.

Another object of the invention is to provide a silver halide color photographic light sensitive material having a wide exposure latitude, an excellent processing variation resistance and few variations between the printers used.

A further object of the invention is to provide a silver halide color photographic light sensitive material having an excellent color reproducibility, few processing variations and an excellent raw-stock stability.

A still further object of the invention is to provide a silver halide color photographic light sensitive material having a high sensitivity, an excellent processing stability and a satisfactory aging preservation stability.

The first object of the invention can be achieved with a silver halide color photographic light sensitive material comprising a support having photographic component layers including a blue-sensitive silver halide emulsion layer, a green-sensitive silver halide emulsion layer and a red-sensitive silver halide emulsion layer thereon; wherein at least one of the green-sensitive silver halide emulsion layers contains at least one kind of the magenta couplers represented by the following Formula

[M-I] and at least one kind of the compounds capable of releasing a development inhibitor or the precursors of the development inhibitor, upon reaction with the oxidized products of the developing agents represented by the following Formula [D-I].

The second object of the invention can be achieved with a silver halide color photographic light sensitive material comprising a support having photographic component layers including a blue-sensitive silver halide emulsion layer, a green-sensitive silver halide emulsion layer and a red-sensitive silver halide emulsion layer thereon; wherein at least one of the green-sensitive silver halide emulsion layers contains at least one kind of the magenta couplers represented by the following Formula [M-I], at least one kind of the colored magenta couplers represented by the following Formula [CM-I] and at least one kind of the compounds capable of releasing a development inhibitor or the precursors of the development inhibitor, upon reaction with the oxidized products of the developing agents represented by the following Formula [D-I].

The third object of the invention can be achieved with a silver halide color photographic light sensitive material comprising a support having photographic component layers including a blue-sensitive silver halide emulsion layer, a green-sensitive silver halide emulsion layer and a red-sensitive silver halide emulsion layer thereon; wherein at least one of the green-sensitive silver halide emulsion layers contains at least one kind of the compounds represented by the following Formula [M-I], at least one kind of the compounds represented by the following Formula [D-I], at least one kind of the compounds represented by the following Formula [A-I] and at least one kind of the compounds represented by Formula [A-II].

The fourth object of the invention can be achieved with a silver halide color photographic light sensitive material comprising a support having photographic component layers including a blue-sensitive silver halide emulsion layer, a green-sensitive silver halide emulsion layer and a red-sensitive silver halide emulsion layer thereon; wherein the silver halide emulsion layer contains at least one kind of the magenta couplers represented by the following Formula [M-I], at least one kind of the magenta couplers represented by the following Formula [M-II] and at least one kind of the compounds capable of releasing a development inhibitor or the precursors of the development inhibitor, upon reaction with the oxidized products of the developing agents represented by the following Formula [D-I].

Formula [M-I]

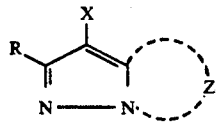

wherein Z represents a group consisting of non-metal atoms necessary to form a nitrogen-containing heterocyclic ring, provided, the ring formed by the Z may have a substituent; X represents a hydrogen atom or a group releasable upon reaction with the oxidized product of a color developing agent; and R represents a hydrogen atom or a substituent.

Formula [D-I]

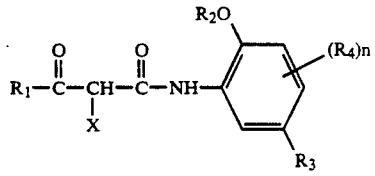

wherein $R_1$ represents an alkyl group, $R_2$ represents an alkyl or aryl group; $R_3$ represents an oxycarbonyl, sulfonamido, carbamoyl, acylamino, ureido, oxycarbonylamino, sulfonyloxy, carbonyloxy or sulfamoyl group; $R_4$ represents a substituent; n is an integer of 0, 1, 2 or 3; and X represents a group capable of releasing a development inhibitor or the precursors thereof upon formation of ortho-quinone methide when released by a coupling to the oxidized product of a color developing agent.

Formula [CM-I]

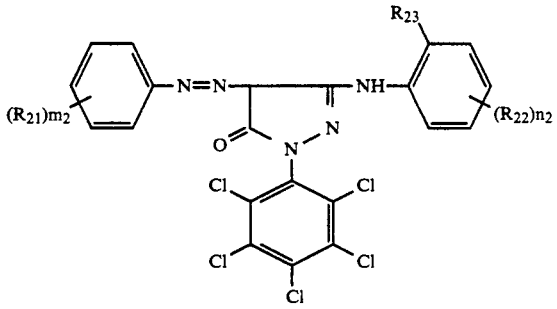

wherein $R_{21}$ represents a substituent; $R_{22}$ represents an acylamino, sulfonamido, imido, carbamoyl, sulfamoyl, alkoxy, alkoxycarbonyl or alkoxycarbonylamino group; $R_{23}$ represents a halogen atom or an alkoxy group; m2 is an integer of 0 to 5; and n2 is an integer of 0 to 4.

$R_{11}—NHSO_2—R_{12}$ Formula [A-I]

wherein $R_{11}$ and $R_{12}$ represent each a hydrogen atom, an alkyl group, a cycloalkyl group, an alkenyl group, a cycloalkenyl group, an alkinyl group, an aryl group, a heterocyclic group, an alkoxy group, an aryloxy group, a hetercyclic-oxy group or

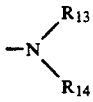

wherein $R_{13}$ and $R_{14}$ represent each a hydrogen atom, an alkyl group or an aryl group, provided, $R_{13}$ and $R_{14}$ may be the same with or the different from each other.

Formula [A-II]

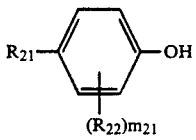

wherein $R_{21}$ represents an alkyl, alkoxycarbonyl, arylsulfonyl, alkylsulfonyl, arylsulfonylamino or alkylsulfonylamino group; $R_{22}$ represents a group substitutable to a benzene ring; and $m_{21}$ is an integer of 0 to 4.

Formula [M-II]

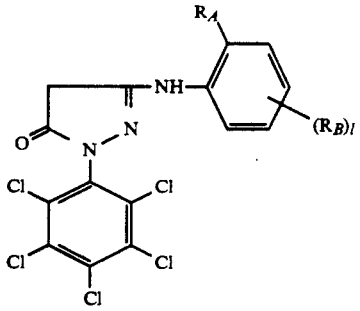

wherein $R_A$ represents a halogen atom or an alkoxy group; $R_B$ represents an acylamino group, a sulfonamido group, an imido group, a carbamoyl group, a sulfamoyl group, an alkoxycarbonyl group, an alkoxycarbonylamino group or an alkoxy group; and 1 is an integer of 0 to 4.

DETAILED DESCRIPTION OF THE INVENTION

The invention will now be detailed below.

First, the magenta couplers of the invention represented by Formula [M-I] will be described.

Formula [M-I]

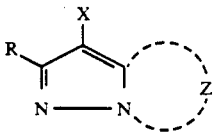

wherein Z represents a group consisting of non-metal atoms necessary to form a nitrogen-containing heterocyclic ring, provided that the ring formed by Z may have a substituent; X represents a hydrogen atom or a group releasable upon reaction with the oxidized product of a color developing agent; and R represents a hydrogen atom or a substituent.

There is no special limitation to the substituents represented by R, but they typically include each of the following groups, namely, an alkyl group, an aryl group, an anilino group, an acylamino group, a sulfonamido group, an alkylthio group, an arylthio group, an alkenyl group and a cycloalkyl group; besides the above groups, they also include a halogen atom and each of the following groups, namely, a cycloalkenyl group, an alkinyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclic-oxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, an alkoxycarbonyl group, an aryloxycarbonyl group and a heterocyclic-thio group; and they further include a spiro compound residual group and a cross-linked hydrocarbon compound residual group.

The alkyl groups represented by R may include, desirably, those having 1 to 32 carbon atoms and those having a straight chain or branched chain may also be used.

The aryl groups represented by R include, desirably, a phenyl group.

The acylamino groups represented by R include, for example, an alkylcarbonylamino group and an arylcarbonylamino group.

The sulfonamido groups represented by R include, for example, an alkylsulfonylamino group and an arylsulfonylamino group.

In the alkylthio groups and arylthio groups each represented by R, the alkyl components and aryl components include, for example, the alkyl groups and aryl groups represented by R.

The alkenyl groups represented by R include, desirably, those having 2 to 32 carbon atoms. The cycloalkyl groups represented thereby include, desirably, those having 3 to 12 carbon atoms and, particularly those having 5 to 7 carbon atoms. The alkenyl groups may also be straight-chained or branch-chained.

The cycloalkenyl groups represented by R include, desirably, those having 3 to 12 carbon atoms and, particularly, those having 5 to 7 carbon atoms.

The sulfonyl groups represented by R include, desirably, an alkylsulfonyl group and an arylsulfonyl group;

As the sulfinyl groups, an alkylsulfinyl group and an arylsulfinyl group; As the phosphonyl groups, an alkylphosphonyl group, an alkoxyphosphonyl group, an aryloxyphosphonyl group and an arylphosphonyl group;

As the acyl groups, an alkylcarbonyl group and an arylcarbonyl group;

As the carbamoyl groups, an alkylcarbamoyl group and an arylcarbamoyl group;

As the sulfamoyl groups, an alkylsulfamoyl group and an arylsulfamoyl group;

As the acyloxy groups, an alkylcarbonyloxy group and an arylcarbonyloxy group;

As the carbamoyloxy groups, an alkylcarbamoyloxy group and an arylcarbamoyloxy group;

As the ureido groups, an alkylureido group and an arylureido group;

As the sulfamoylamino groups, an alkylsulfamoylamino group and an arylsulfamoylamino group;

As the desirable heterocyclic groups, those having 5 to 7 carbon atoms including, typically, a 2-furyl group, a 2-thienyl group, a 2-pyrimidinyl group and a 2-benzothiazolyl group;

As the desirable heterocyclic-oxy groups, those having 5- to 7-membered heterocyclic ring including, for example, a 3,4,5,6-tetrahydropyranyl-2-oxy group and a 1-phenyltetrazole-5-oxy group;

As the desirable heterocyclic-thio groups, a 5- to 7-members heterocyclic-thio group including, for example, a 2-pyridylthio group, a 2-benzothiazolylthio group and a 2,4-diphenoxy-1,3,5-triazole-6-thio group;

As the siloxy groups, a trimethylsiloxy group, a triethylsiloxy group and a dimethylbutylsiloxy group;

As the imido groups, a succinimido group, a 3-heptadecyl succinimido group and a glutarimido group;

As the spiro compound residual groups, spiro[3.3-]heptane-1-yl; and

As the cross-linked hydrocarbon compound residual groups, bicyclo[2.2.1]heptane-1-yl, tricyclo[3.3.1.1$^{3,7}$]-decane-1-yl and 7,7-dimethyl-bicyclo[2.2.1]heptane-1-yl.

The groups releasable upon reaction with the oxidized product of a color developing agent, which are represented by X, include, for example, a halogen atom (such as a chlorine atom, a bromine atom and a fluorine atom) and each of the following groups, namely, an alkoxy group, an aryloxy group, a heterocyclic-oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic-thio group, an alkyloxythiocarbonylthio group, an acylamino group, a sulfonamido group, a nitrogen-containing heterocyclic ring bonded with an N atom, an alkyloxycarbonylamino group, an aryloxycarbonylamino group, a carboxyl group, and

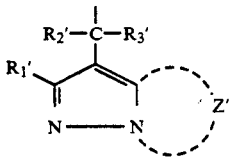

wherein $R_1$, is synonymous with the foregoing R; Z' is synonymous with the foregoing Z; and $R_2$, and $R_3$, represent each a hydrogen atom, an aryl group, an alkyl group or a heterocyclic group. Among them, a halogen atom is desirable and a chlorine atom is particularly desirable.

The nitrogen-containing heterocyclic rings formed by Z or Z' include, for example, a pyrazole ring, an imidazole ring, a triazole ring and a tetrazole ring. The substituents the foregoing rings are allowed to have include those described of the foregoing R.

Those represented by Formula [M-I] are further typically represented by the following Formulas [M-II] through [M-VII], for example.

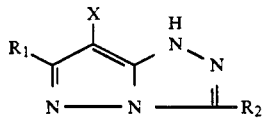

Formula [M-II]

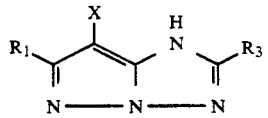

Formula [M-III]

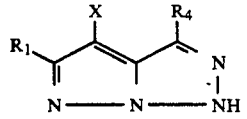

Formula [M-IV]

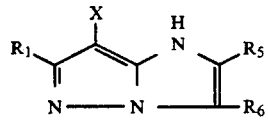

Formula [M-V]

-continued

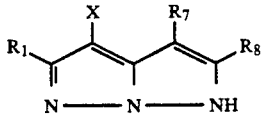

Formula [M-VI]

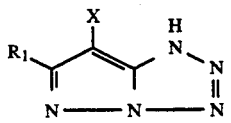

Formula [M-VII]

In the above-given Formulas [M-II] through [M-VII], $R_1$ through $R_8$ and X are synonymous with the foregoing R and X, respectively. Among those represented by Formula [M-I], those represented by the following Formula [M-XIII] are desirable.

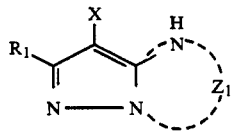

Formula [M-XIII]

wherein $R_1$, X and $Z_1$ are synonymous with R, X and Z denoted in Formula [M-I].

Among the magenta couplers represented by the foregoing Formulas [M-II] through [M-VII], the particularly desirable ones include the magenta couplers represented by Formula [M-II].

As for the substituents R and $R_1$ on the foregoing heterocyclic rings, the most desirable ones are represented by the following Formula [M-IX].

$R_9—CH_2—$ Formula [M-IX]

wherein $R_9$ is synonymous with the foregoing R. Those desirable for $R_9$ include, for example, a hydrogen atom and an alkyl group.

In the rings formed by Z in Formula [M-I] and the rings formed by $Z_1$ in Formula [M-VIII], the substituents which these rings are allowed to have and $R_2$ through $R_8$ denoted in Formula M-II] through [M-VI] are each desirably represented by the following Formula [M-X].

$—R^1—SO_2—R^2$ Formula [M-X]

wherein $R^1$ represents an alkylene group; and $R^2$ represents an alkyl, cycloalkyl or aryl group.

The alkylene groups represented by $R^1$ have desirably not less than 2 carbon atoms in the straight chain thereof and more desirably 3 to 6 carbon atoms. The alkylene groups may be regardless of either straight-chained or branch-chained.

The cycloalkyl groups represented by $R^2$ include, desirably, those having 5- or 6-members.

The typical and concrete examples of the compounds relating to the invention will be given below.

M-1

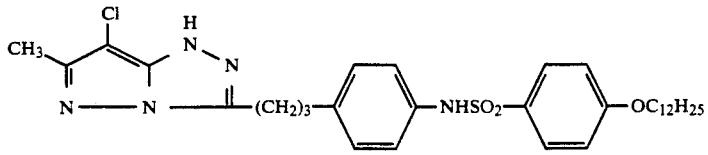

-continued
M-2
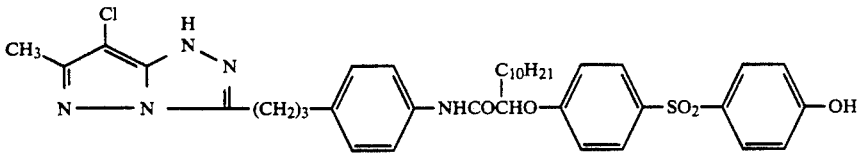
M-3
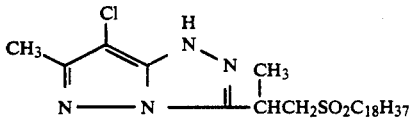
M-4
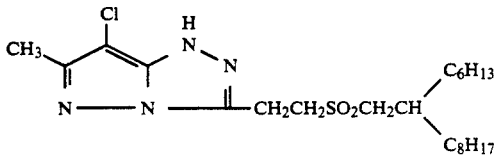
M-5
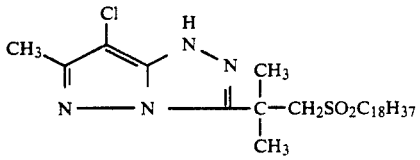
M-6
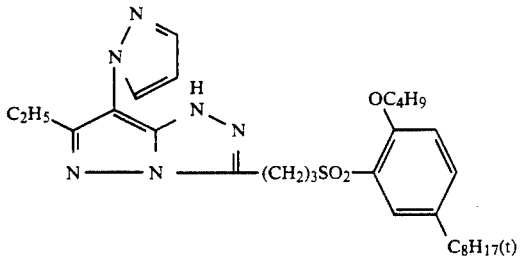
M-7
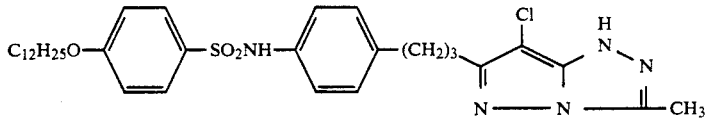
M-8
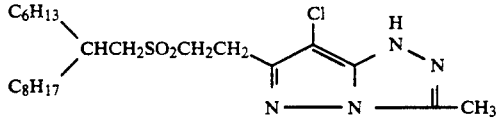
M-9
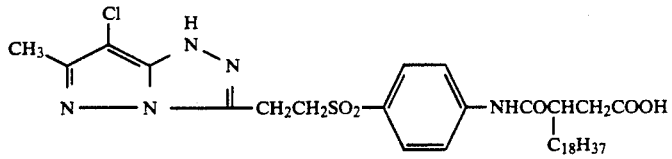
M-10
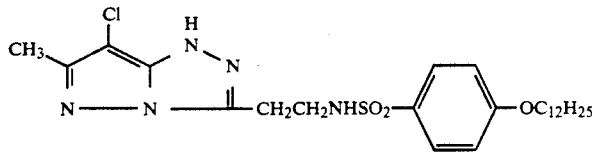

-continued
M-11
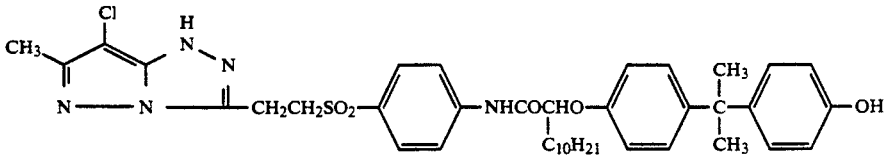
M-12
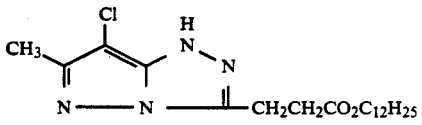
M-13
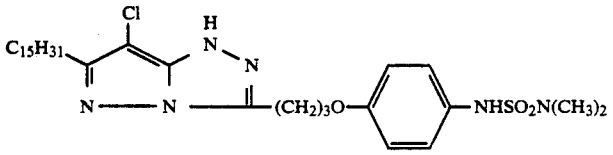
M-14
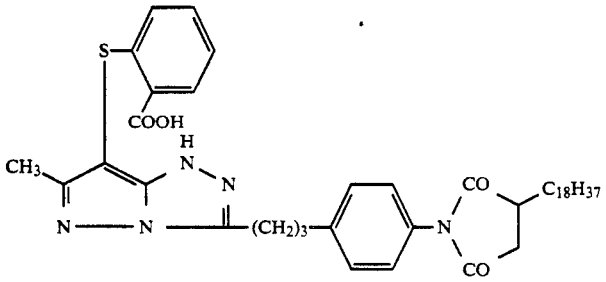
M-15
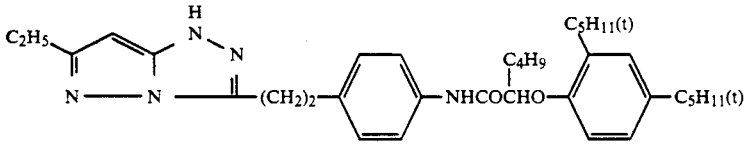
M-16
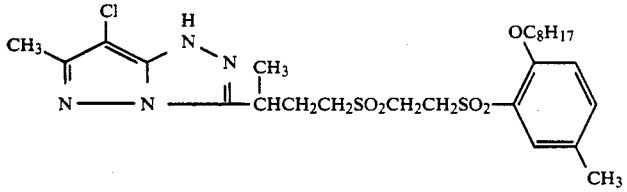
M-17
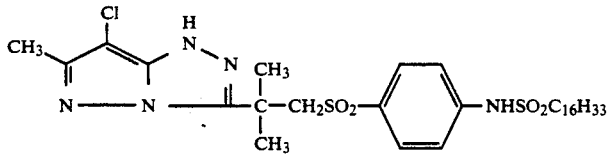
M-18
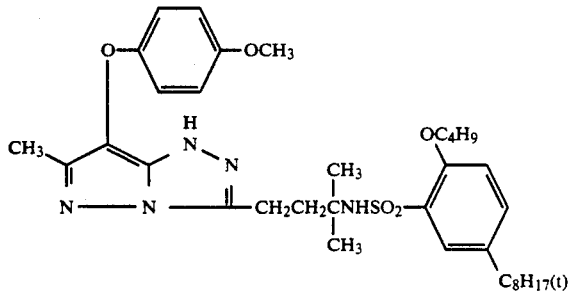

-continued
M-19
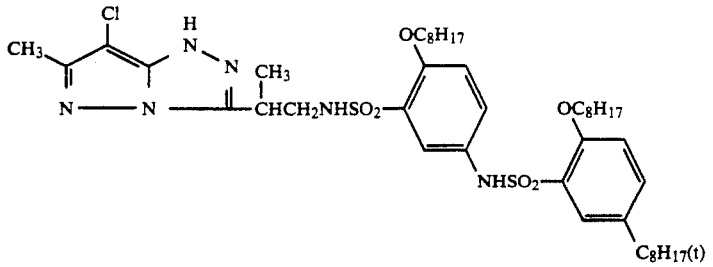
M-20
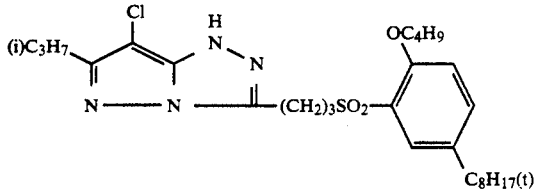
M-21
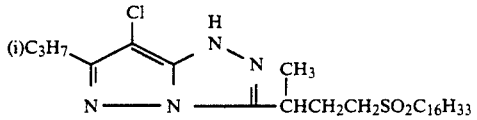
M-22
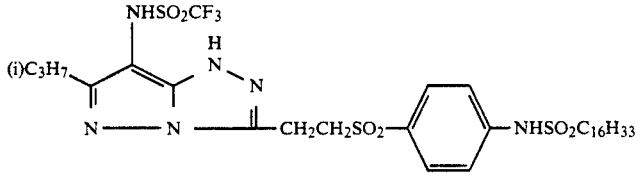
M-23
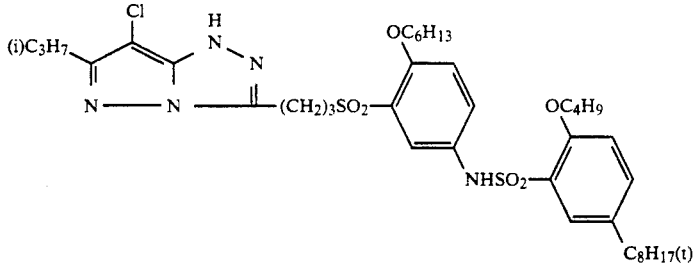
M-24
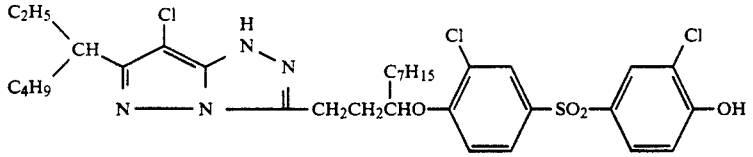
M-25
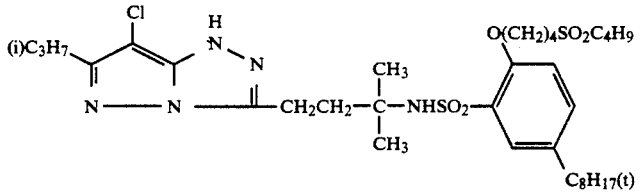
M-26
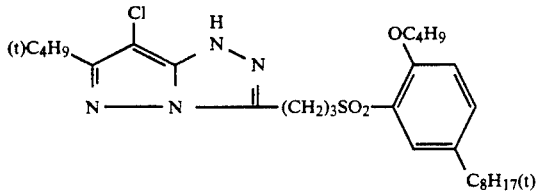

-continued
M-27
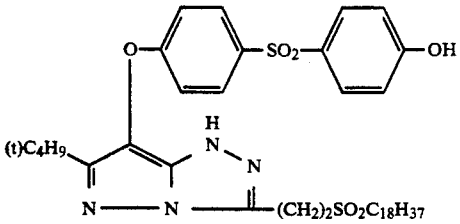
M-28
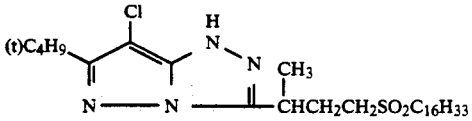
M-29
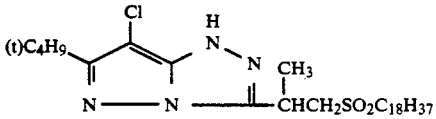
M-30
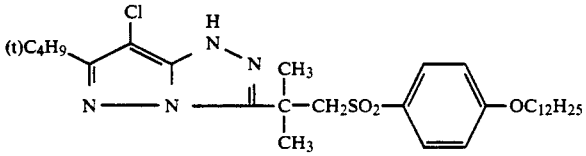
M-31
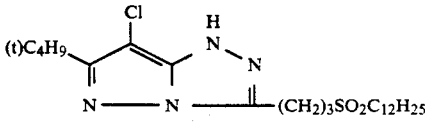
M-32
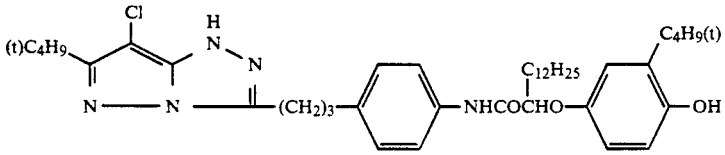
M-33
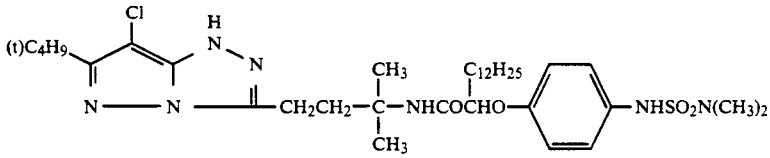
M-34
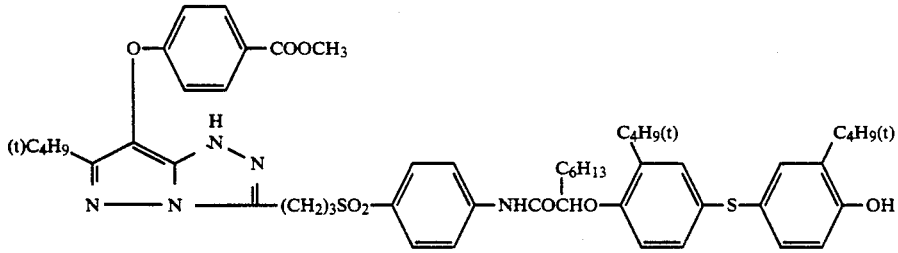
M-35
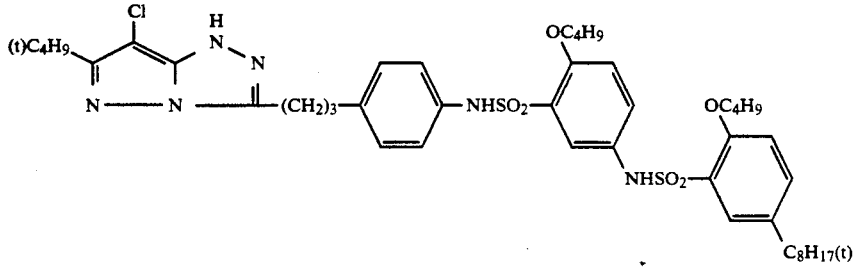

-continued
M-36
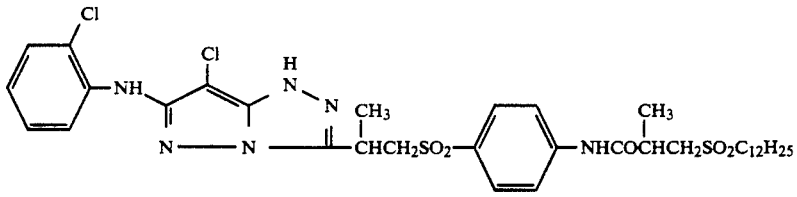
M-37
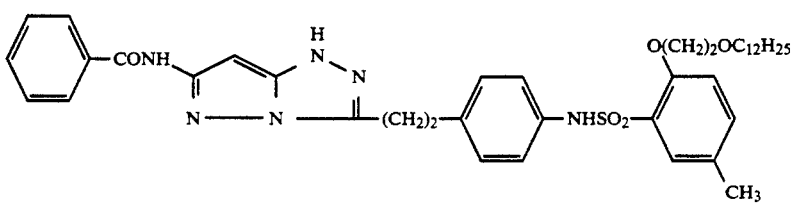
M-38
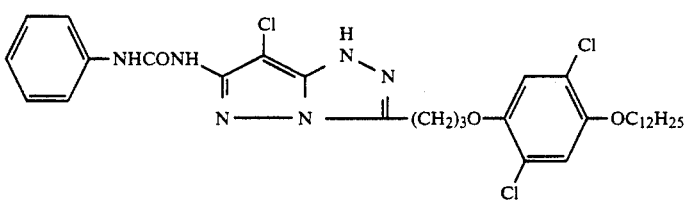
M-39
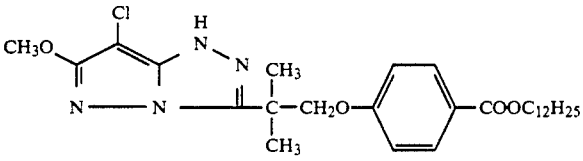
M-40
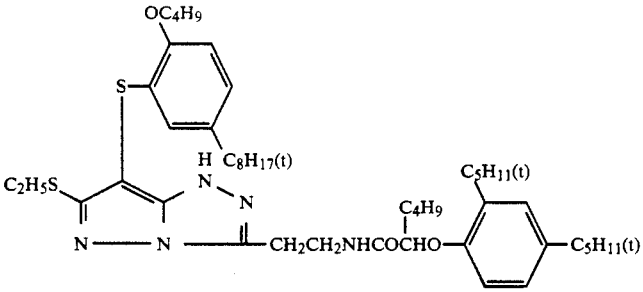
M-41
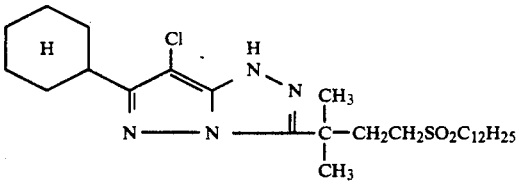
M-42
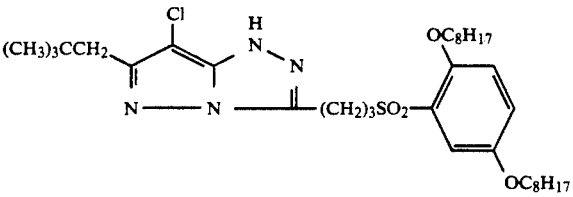

-continued
M-43
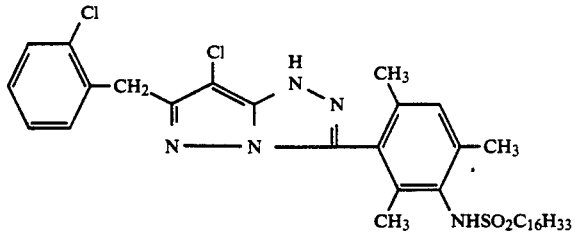
M-44
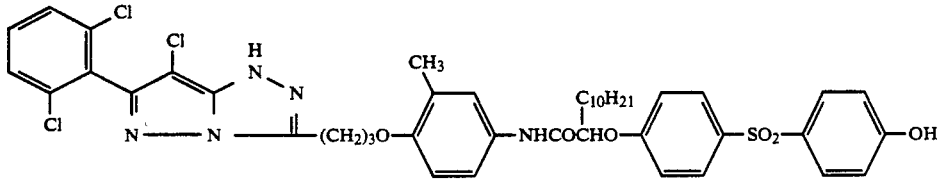
M-45
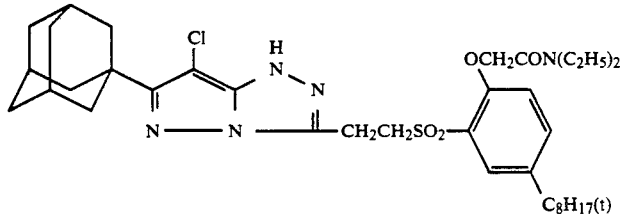
M-46
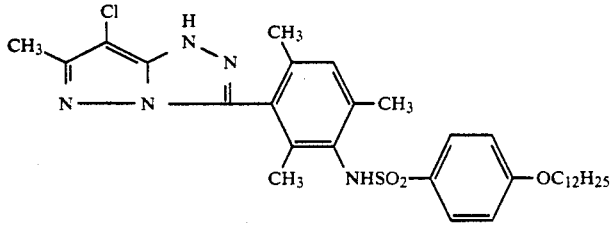
M-47
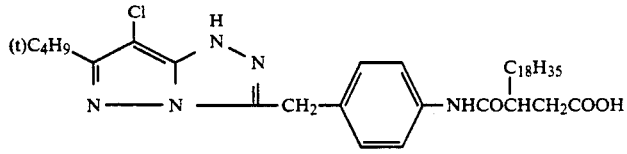
M-48
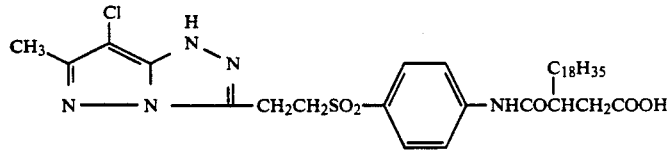
M-49
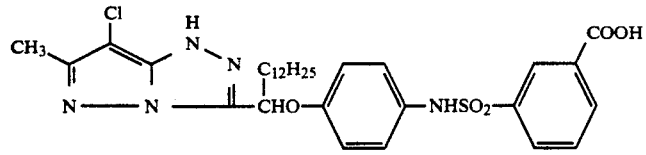
M-50
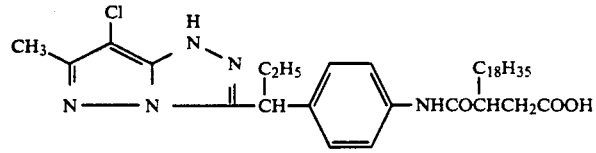

-continued
M-51
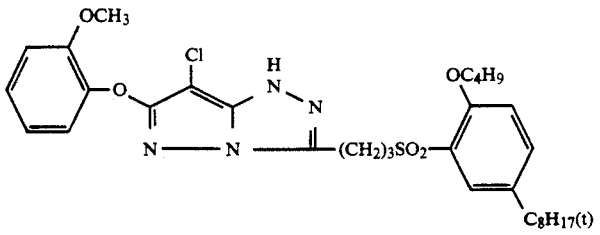
M-52
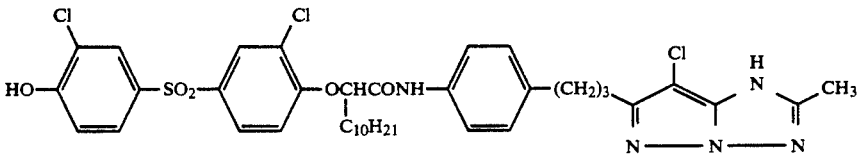
M-53
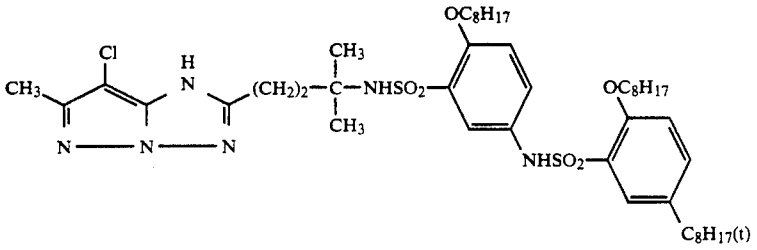
M-54
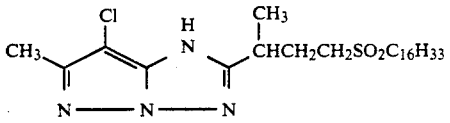
M-55
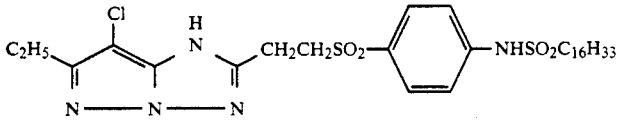
M-56
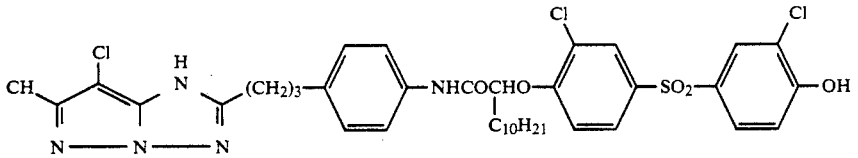
M-57
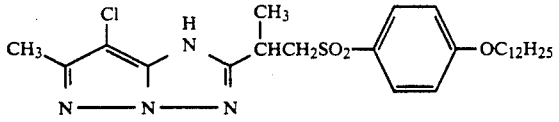
M-58
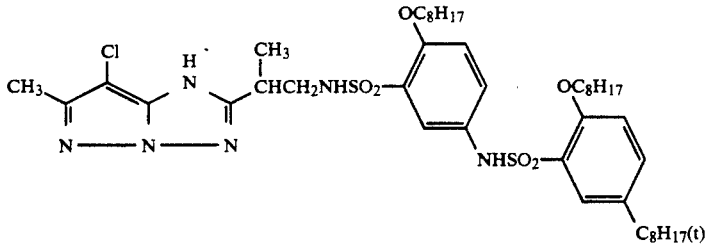
M-59
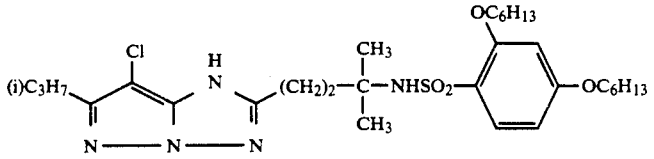

-continued
M-60
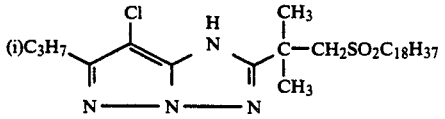
M-61
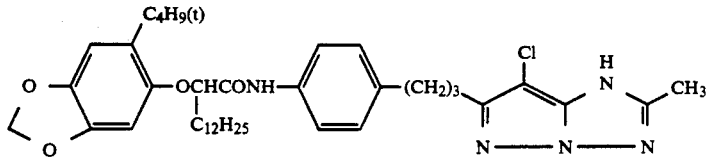
M-62
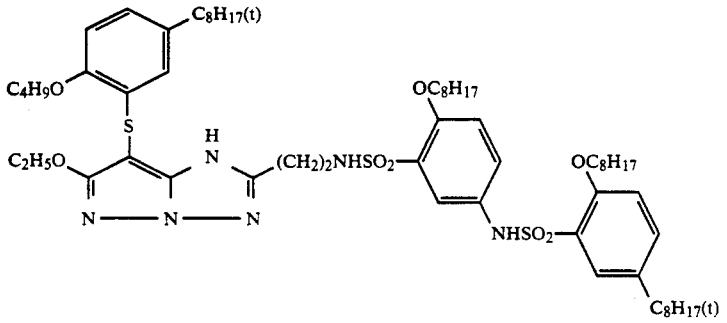
M-63
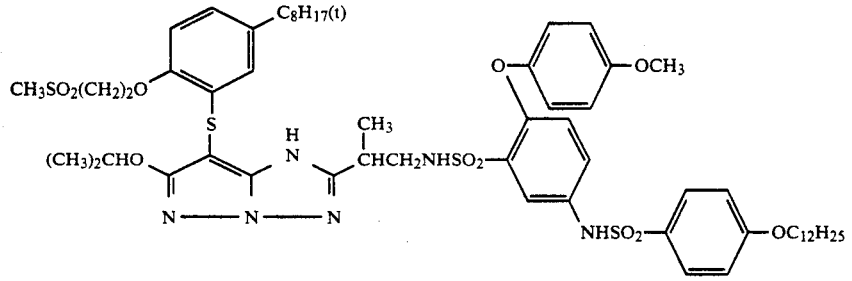
M-64
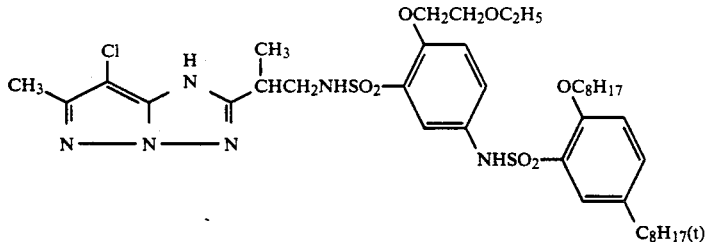
M-65
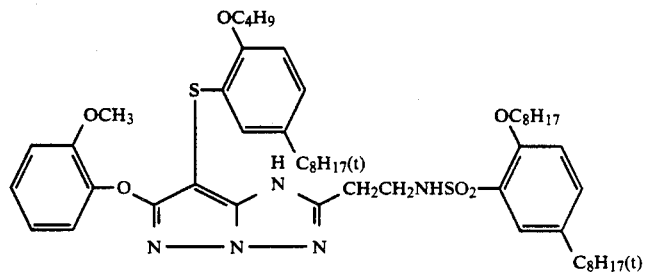

-continued
M-66
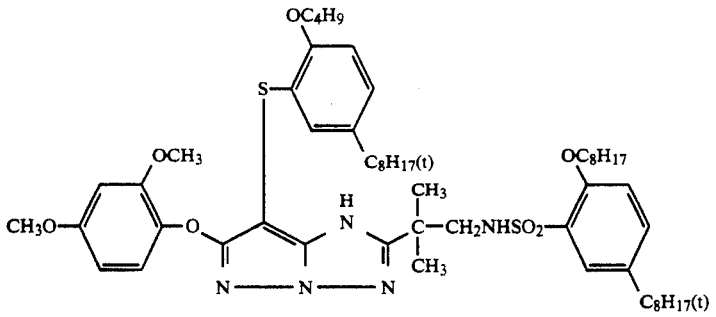
M-67
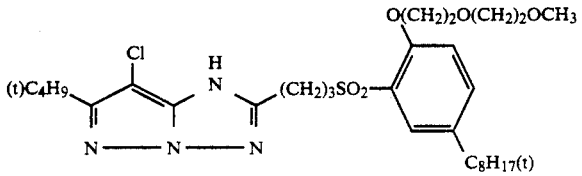
M-68
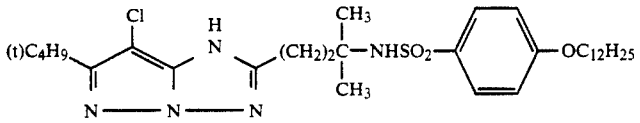
M-69
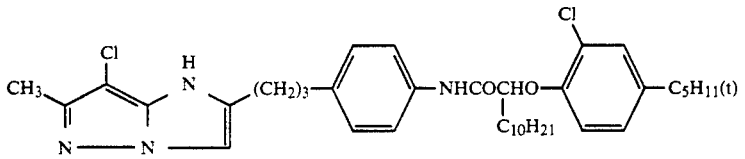
M-70
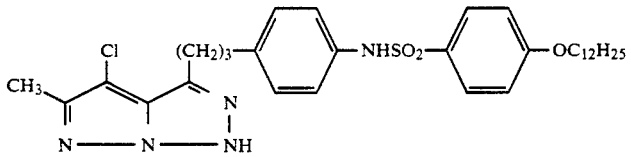
M-71
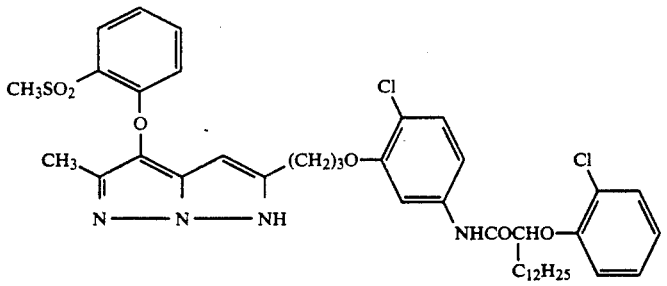
M-72
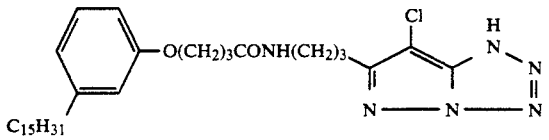

-continued

M-73

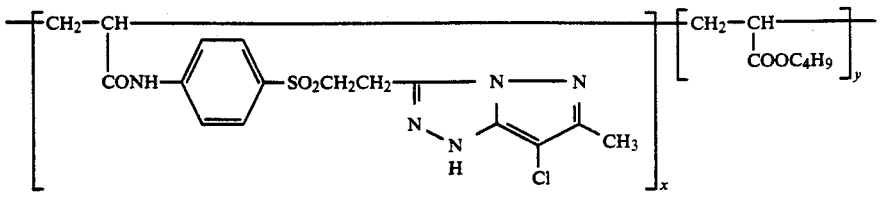

x:y = 50:50

M-74

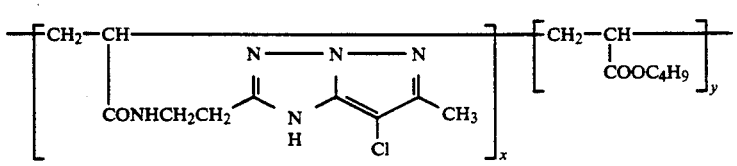

x:y = 50:50

Besides the above-given typical and concrete examples of the compounds relating to the invention, the other concrete examples of the compounds relating to the invention include, for example, the compounds numbered by Nos. 1~4, 6, 8~17, 19~43, 45~59, 61~104, 106~121, 123~162 and 164~223 each belonging to the compounds given in JP OPI Publication No. 62-166339/1987, pp. (18)~(32).

The above-described couplers can be synthesized with reference to Journal of the Chemical Society, Perkin I, (1977), 2047~2052; U.S. Pat. No. 3,725,067; JP OPI Publication Nos. 59-99437/1984, 58-42045/1983, 59-162548/1984, 59-171956/1984, 60-33552/1985, 60-43659/1985, 60-172982/1985, 60-190779/1985, 62-209457/1987 and 63-307453/1988.

The couplers of the invention can be used in an amount within the range of, usually, $1\times10^{-3}$ mols to 1 mol per mol of silver halide used and, desirably, $1\times10^{-2}$ mols to $8\times10^{-1}$ mols.

The couplers of the invention can be used with the other magenta couplers in combination.

Next, the detailed descriptions will be made on the compounds capable of releasing a development inhibitor or the precursors of the development inhibitors upon reaction with the oxidized product of the color developing agent of the invention (hereinafter referred to as the DIR couplers) which is represented by Formula [D-I].

In Formula [D-I], The alkyl groups represented by $R_1$ may be straight-chained, branch-chained or cyclic. The straight-chained alkyl groups include, for example, a methyl group, an ethyl group and a dodecyl group; the branch-chained alkyl groups include, for example, an isopropyl group, a t-butyl group and a t-ocyl group; and the cyclic alkyl groups include, for example, a cyclopropyl group, a cyclohexyl group and an adamantyl group. These alkyl groups represented by $R_1$ further include those having a substituent. The substituents include, for example, a halogen atom, an aryl group, an alkoxy group, an aryloxy group, an alkylsulfonyl group, an acylamino group and a hydroxyl group. $R_1$ include, desirably, a branch-chained or cyclic alkyl group, more desirably, a branch-chained alkyl group and, preferably, a t-butyl group.

In Formula [D-I], the alkyl groups represented by $R_2$ include, for example, the same groups as those represented by the foregoing $R_1$. These alkyl groups represented by $R_2$ also include those having the same substituents as those represented by $R_1$. The alkyl groups represented by $R_2$ include, desirably, the straight-chained or branch-chained alkyl groups.

Also in Formula [D-I], the aryl groups represented by $R_2$ include, for example, a phenyl group and a naphthyl group. These aryl groups represented by $R_2$ are allowed to have a further substituent. Such substituents include, for example, a halogen atom, an alkyl group, an aryl group, an alkoxy group, an aryloxy group, a nitro group, a cyano group and an acylamino group. The aryl groups represented by $R_2$ include, desirably, a substituted or non-substituted phenyl group. As for $R_2$, the straight-chained alkyl groups are desirable and the methyl groups are most desirable.

In the foregoing Formula [D-I], $R_3$ represents an oxycarbonyl group, a sulfonamido group, a carbamoyl group, an acylamino group, a ureido group, an oxycarbonylamino group, a sulfonyloxy group, a carbonyloxy group and a sulfamoyl group, each allowed to have a substituent, respectively. Among them, the desirable ones include, for example, the groups represented by the following Formulas A through H and J through L.

Formula A

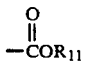

Formula B

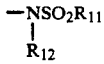

Formula C

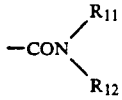

Formula D

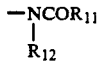

Formula E

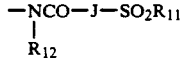

Formula F

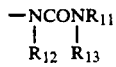

-continued

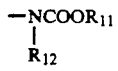

Formula G

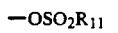

Formula H

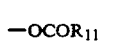

Formula J

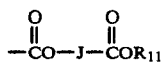

Formula K

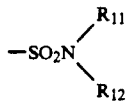

Formula L

In the above-given Formulas A~H and J~L, $R_{11}$ represents an alkyl group, a cycloalkyl group or an aryl group; and $R_{12}$ and $R_{13}$ represent independently a hydrogen atom, an alkyl group, a cycloalkyl group or an aryl group.

The alkyl groups and cycloalkyl groups each represented by $R_{11}$, $R_{12}$ and $R_{13}$ include, for example, a straight-chained or branch-chained alkyl groups each having 1 to 30 carbon atoms and a cycloalkyl group (such as a methyl group, an n-butyl group, a cyclohexyl group, a 2-ethylhexyl group, an n-dodecyl group and an n-hexadecyl group). The aryl groups represented by $R_{11}$, $R_{12}$ and $R_{13}$ include, for example, an aryl group having 6 to 22 carbon atoms (such as a phenyl group and a 1-naphthyl group).

The alkyl groups, cycloalkyl groups and aryl groups each represented by $R_{11}$, $R_{12}$ and $R_{13}$ include those further having a substituent. Such substituents include, for example, a halogen atom (such as a chlorine atom and a bromine atom), a hydroxyl group, an aryl group (such as a phenyl group and a 4-t-butylphenyl group), an aryloxy group (such as a phenoxy group, a p-methylphenoxy group and a 2,4-di-t-amylphenoxy group), an alkoxy group (such as a methoxy group, an ethoxy group, an i-propoxy group and an n-dodecyloxy group), a cycloalkyloxy group (such as a cyclohexyloxy group), an alkylthio group (such as a methylthio group), an alkylsulfonylamino group (such as a methanesulfonylamino group and an n-butanesulfonylamino group), and an alkylcarbonylamino group (such as an acetylamino group and a 3-(2,4-di-t-amylphenoxy)-butanoylamino group).

The aryl groups represented by $R_{11}$, $R_{12}$ and $R_{13}$ include those having an alkyl group as the substituent thereof, besides the above-given substituents.

In the foregoing Formulas E and K, J represents a divalent organic linking group selected from the group consisting of alkylene groups and arylene groups. The alkylene groups include, for example, a straight-chained or branch-chained alkylene group having 1 to 10 carbon atoms (such as a methylene group, an ethylene group, a methylethylene group, a propylene group, a dimethylmethylene group, a butylene group and a hexylene group). The arylene groups include, for example, an arylene group having 6 to 14 carbon atoms (such as a 1,2-phenylene group, a 1,4-phenylene group and a 1,4-naphthylene group).

In the foregoing Formula [D-I], the substituents represented by $R_4$ may be any one, provided it can be substituted to a benzene ring. They include, for example, a halogen atom, an alkyl group, an alkoxy group, an aryloxy group, an acyloxy group, an imido group, an acylamino group, a sulfonamido group, an oxycarbonyl group, a carbamoyl group, a sulfamoyl group, a carbonyloxy group, an oxycarbonylamino group, a ureido group and a sulfonyloxy group.

In Formula [D-I], n represents 0, 1, 2 or 3. When n represents 2 or 3, the $R_4$s thereof may be the same with or the different from each other. It is desired when n is 0 or 1.

In Formula [D-I], the groups represented by X are those capable of releasing a development inhibitor or the precursors of the development inhibitor, which form an orthoquinone methide or a paraquinone methide when releasing upon coupling with the oxidized product of a color developing agent. These groups include, desirably, the groups represented by Formulas [D-II] and [D-III].

Formula [D-II]

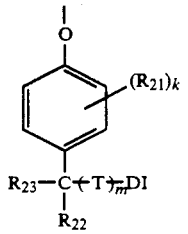

Formula [D-III]

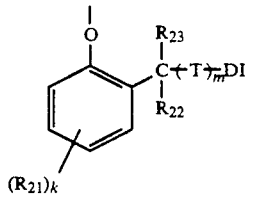

In Formulas [D-II] and [D-III], $R_{21}$ represents a group substitutable to a benzene ring and they include, for example, a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group or an acyl group.

As for $R_{21}$, a nitro group, an acylamino group, a sulfonamido group, a sulfamoyl group, a cyano group, an alkoxycarbonyl group and so forth are desirable.

k represents an integer of 0 to 4, desirably 0, 1 or 2 and it is particularly desirable when k is 1.

In Formulas [D-II] and [D-III], $R_{22}$ and $R_{23}$ represent independently a hydrogen atom, an alkyl group or an aryl group. The alkyl groups represented by $R_{22}$ and $R_{23}$ include, for example, a methyl group, an ethyl group, an i-propyl group, a trifluoromethyl group, a cyclohexyl group and a dodecyl group. The aryl groups represented by $R_{22}$ and $R_{23}$ include, for example, a phenyl group, a p-tolyl group, a p-octylphenyl group and a naphthyl group.

In Formulas [D-II] and [D-III], the linking groups represented by T include, for example; a group utilizing a hemiacetal cleavage reaction, such as those described in U.S. Pat. Nos. 4,146,396, 4,652,516 or 4,698,297; a timing group utilizing an intermolecular nucleophilic reaction so as to produce a cleavage reaction, such as those described in U.S. Pat. No. 4,248,962; a timing group such as those described in U.S. Pat. Nos. 4,409,323 or 4,421,845; a group utilizing an iminoacetal hydrolysis so as to produce a cleavage reaction, such as those described in U.S. Pat. No. 4,546,073; and a group utilizing an ester hydrolysis so as to produce a cleavage reaction, such as those described in West German Patent DT-OS No. 2,626,317.

In Formulas [D-II] and [D-III], m represents 0 or 1.

In Formulas [D-II] and [D-III], DI represents a group which is cleaved so as to serve as a development inhibitor. The development inhibitors include, for example; a 5-mercaptotetrazole type compound (such as 1-phenyl-5-mercaptotetrazole, 1-(4-hydroxyphenyl)-5-mercaptotetrazole, 1-(2-methoxycarbonylphenyl)-5-mercaptotetrazole, 1-ethyl-5-mercaptotetrazole and 1-propyloxy carbonylmethyl-5-mercaptotetrazole); a benzotriazole type compound (such as 5- or 6-nitrobenzotriazole, 5- or 6-phenoxycarbonyl benzotriazole, 1,3,4-thiadiazole type compound (such as 5-methyl-2-mercapto-1,3,4-thiadiazole, 5-(2-methoxycarbonyl ethylthio)-2-mercapto-1,3,4-thiadiazole); a 1,3,4-oxadiazole type compound (such as 5-methyl-2-mercapto-1,3,4-oxadiazole); a benzothiazole type compound (such as 2-mercaptobenzothiazole); a benzoimidazole type compound (such as 2-mercaptobenzoimidazole); a benzoxazole type compound (such as 2-mercaptobenzoxazole); and a 1,2,4-triazole type compound (such as 3-(2-furyl)-5-hexylthio-1,2,4-triazole). Among them, the desirable groups for DI include, for example, those capable of forming a 1,3,4-oxadiazole type compound or a 5-mercaptotetrazole type compound.

The desirable development inhibitors include the compounds having a substituent containing a bond (such as an ester bond, a urethane bond, a sulfonic acid ester bond and a carbonic acid ester bond) which is capable of producing a cleavage reaction in the course of carrying out a developing process.

The typical examples of the compounds of the invention will be given below. However, the invention shall not be limited thereto.

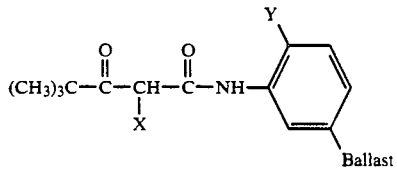

| No. | X | Y | Ballast |
|---|---|---|---|
| D-1 | 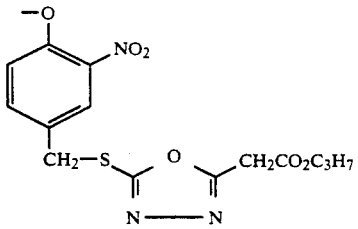 | $-OCH_3$ | $-NHSO_2C_{16}H_{33}$ |
| D-2 | 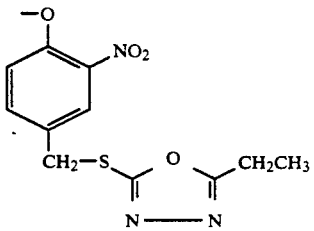 | $-OCH_3$ | $-NHSO_2C_{16}H_{33}$ |
| D-3 | 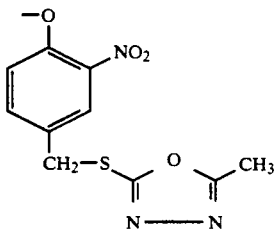 | $-OC_2H_5$ | $-NHSO_2C_{16}H_{33}$ |

-continued
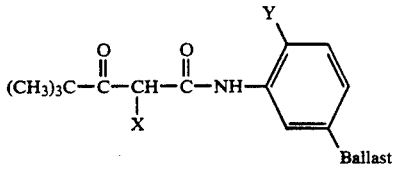
| No. | X | Y | Ballast |
|---|---|---|---|
| D-4 | 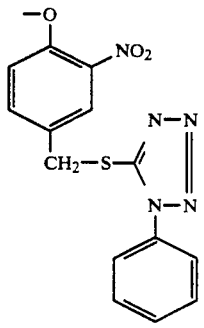 | $-OCH_3$ | $-NHSO_2C_{16}H_{33}$ |
| D-5 | 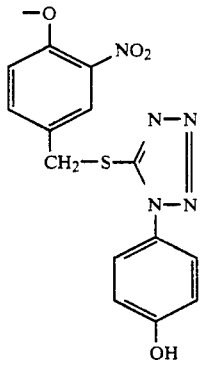 | $-OC_3H_7(i)$ | $-NHSO_2C_{16}H_{33}$ |
| D-6 | 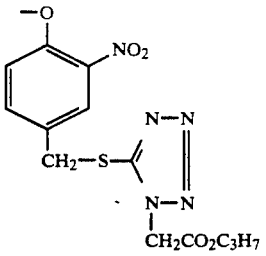 | $-OCH_3$ | $-NHSO_2C_{16}H_{33}$ |
| D-7 | 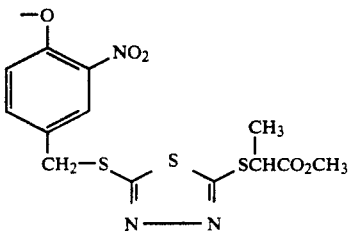 | $-OCH_3$ | $-NHSO_2C_{12}H_{25}$ |

-continued
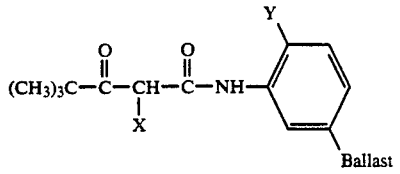
| No. | X | Y | Ballast |
|---|---|---|---|
| D-8 | 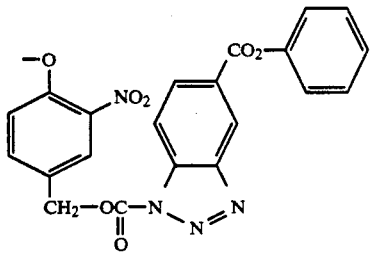 | $-OCH_3$ | $-NHSO_2C_{12}H_{25}$ |
| D-9 | 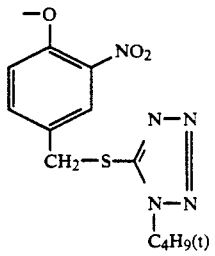 | $-OCH_3$ | $-NHSO_2C_{16}H_{33}$ |
| D-10 | 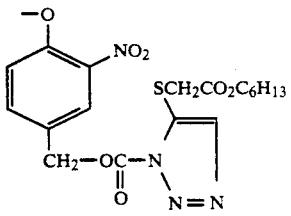 | $-OC_3H_7(i)$ | $-NHSO_2C_{16}H_{33}$ |
| D-11 | 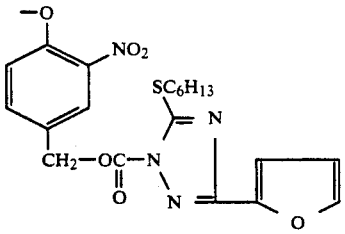 | 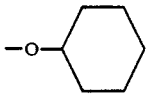 | $-NHSO_2C_8H_{17}$ |
| D-12 | 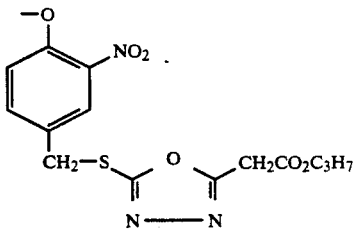 | $-OCH_3$ | $-NHSO_2C_8H_{17}$ |
| D-13 | 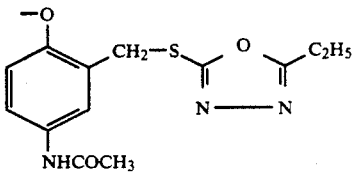 | $-OC_2H_5$ | $-NHSO_2C_{16}H_{33}$ |

-continued
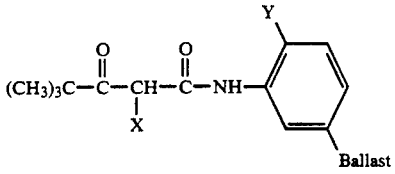
| No. | X | Y | Ballast |
|---|---|---|---|
| D-14 | 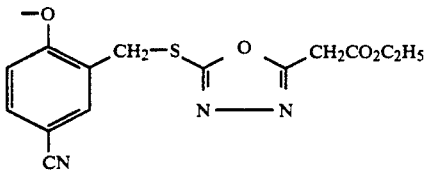 | $-OC_4H_9(t)$ | 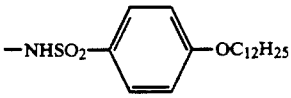 |
| D-15 | 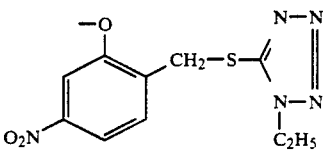 | $-OC_2H_5$ | 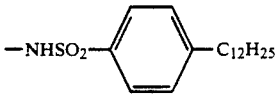 |
| D-16 | 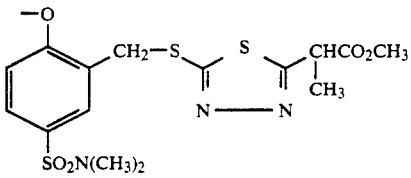 | $-OCH_3$ | $-NHSO_2C_{16}H_{33}$ |
| D-17 | 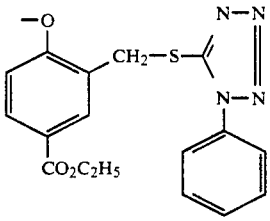 | 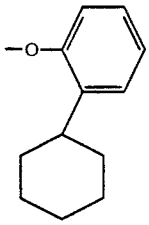 | $-NHSO_2C_8H_{17}$ |
| D-18 | 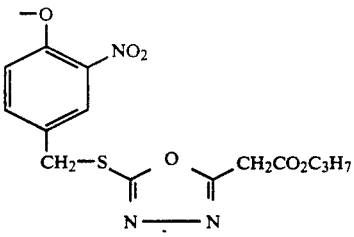 | $-OCH_3$ | $-CO_2C_{12}H_{25}$ |
| D-19 | 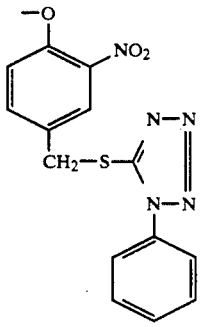 | $-OCH_3$ | $-CO_2C_{12}H_{25}$ |

-continued
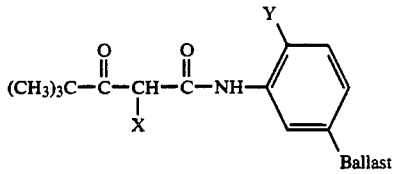
| No. | X | Y | Ballast |
|---|---|---|---|
| D-20 | 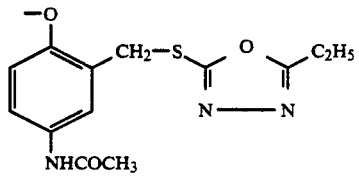 | $-OCH_3$ | $-CO_2C_{12}H_{25}$ |
| D-21 | 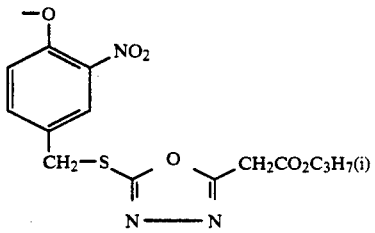 | $-OCH_3$ | $-CO_2CH(CH_3)CO_2C_{12}H_{25}$ |
| D-22 | 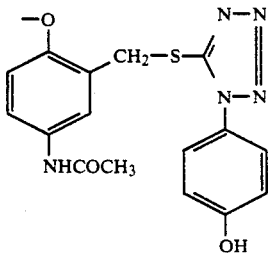 | $-OCH_3$ | $-CO_2CH_2CO_2C_{12}H_{25}$ |
| D-23 | 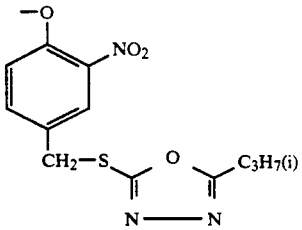 | $-OCH_3$ | $-NHCOCH(CH_3)CH_2-SO_2C_{12}H_{25}$ |
| D-24 | 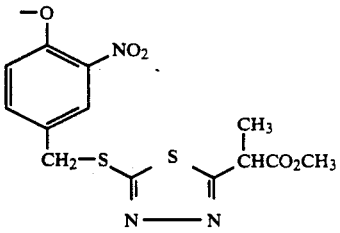 | $-OC_6H_{13}$ | 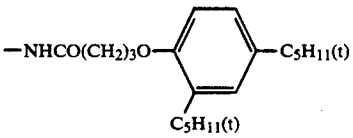 |
| D-25 | 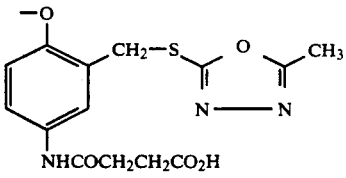 | $-OCH_3$ | 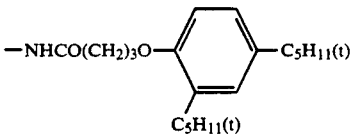 |

-continued

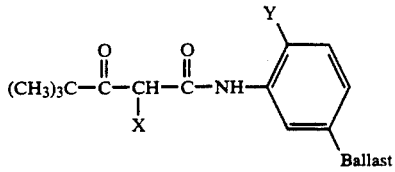

| No. | X | Y | Ballast |
|---|---|---|---|
| D-26 | 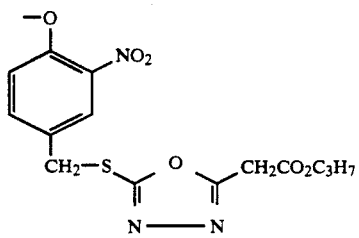 | $-OCH_3$ | $-SO_2NHC_{14}H_{27}$ |
| D-27 | 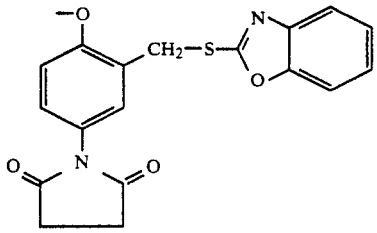 | $-OC_6H_{13}$ | $-SO_2N(CH_3)_2$ |
| D-28 | 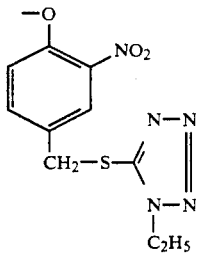 | $-OCH_3$ | 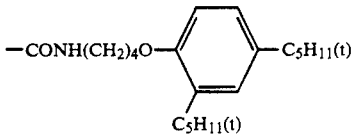 |
| D-29 | 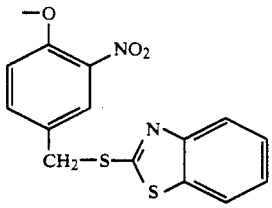 | $-OCH_3$ | $-NHSO_2C_{16}H_{33}$ |
| D-30 | 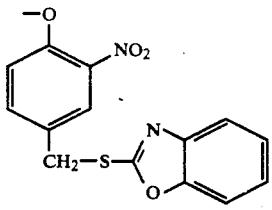 | $-OCH_3$ | $-NHSO_2C_{16}H_{33}$ |

These DIR couplers of the invention may be used in any amount without special limitation, but they may be used in an amount within the range of, desirably, 0.0001 to 0.1 mols and, particularly, 0.001 to 0.05 mols per mol of silver halide used.

Next, the colored magenta couplers of the invention represented by Formula [CM-I] (hereinafter referred to as the colored magenta coupler of the invention) will be detailed.

Formula [CM-I]

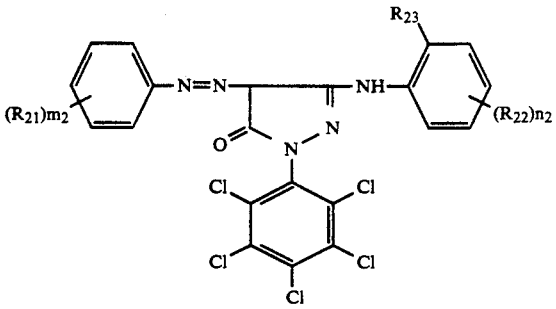

wherein $R_{21}$ represents a substituent; $R_{22}$ represents an acylamino, sulfonamido, imido, carbamoyl, sulfamoyl, alkoxy, alkoxycarbonyl or alkoxycarbonylamino group; $R_{23}$ represents a halogen atom or an alkoxy group; $m_2$ is an integer of 0 to 5; and $n_2$ is an integer of 0 to 4.

The substituents represented by $R_{21}$ include, for example, an alkyl group, an alkoxy group, an aryl group, an acylamino group, a sulfonamido group, a hydroxy group, a halogen atom, an alkoxycarbonyl group, an acyl group, a carbamoyl group, a sulfamoyl group and a carboxyl group, provided, these groups may further have a substituent. Among the groups represented by $R_{21}$, the desirable groups include an alkyl, alkoxy, hydroxy or acylamino group, and the most desirable group is an alkoxy group.

The acylamino groups represented by $R_{22}$ include, for example, a 2,4-di-t-pentylphenoxyacetamido group and a 4-(2,4-di-t-pentylphenoxy)butanamido group; the sulfonamido groups represented thereby include, for example, a 4-dodecyloxyphenyl sulfonamido group; the imido groups represented thereby include, for example, an ocadecenyl succinimido group; the carbamoyl groups represented thereby include, for example, a 4-(2,4-di-t-pentylphenoxy)butyl amino carbonyl group; the sulfamoyl groups represented thereby include, for example, a tetradecane sulfamoyl group; the alkoxy groups represented thereby include, for example, a methoxy group, an ethoxy group and an octyloxy group; the alkoxycarbonyl groups represented thereby include, for example, a tetradecaneoxy carbonyl group; and the alkoxycarbonylamino groups represented thereby include, for example, a dodecyloxy carbonylamino group. The desirable groups represented by $R_{22}$ include, for example, an acylamino group substituted at the p-position to $R_{23}$.

The halogen atoms represented by $R_{23}$ include, for example, a chlorine atom, a bromine atom and a fluorine atom; and the alkoxy groups represented thereby include, for example, a methoxy group and a dodecyloxy group. $R_{23}$ desirably represents a chlorine atom. $m_2$ is desirably 1 or 2; and $n_2$ is desirably 1.

The typical examples of the colored magenta couplers of the invention will be given below.

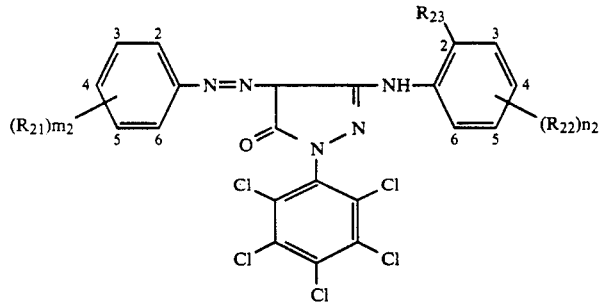

| Compound | $(R_{21})$ $m_2$ | $(R_{22})$ $n_2$ | $R_{23}$ |
|---|---|---|---|
| CM-1 | 3-$OCH_3$, 4-$OCH_3$ | 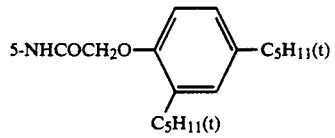 | —Cl |
| CM-2 | 3-$OCH_3$, 4-$OCH_3$ | 5-$NHCOC_{13}H_{27}$ | —Cl |
| CM-3 | 3-$OCH_3$, 4-$OCH_3$ | 4-$NHSO_2C_{16}H_{33}$ | —Cl |
| CM-4 | 3-$OCH_3$, 4-$OCH_3$ | 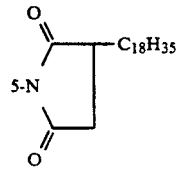 | —Cl |
| CM-5 | 3-$OCH_3$, 4-$OCH_3$ | 5-$NHSO_2C_{16}H_{33}$ | —Cl |
| CM-6 | 3-$OCH_3$, 4-$OCH_3$ | 5-$CONHC_{14}H_{29}$ | —Cl |
| CM-7 | 3-$OC_2H_5$, 4-$OC_2H_5$ | 5-$NHCOC_{13}H_{27}$ | —Cl |

-continued
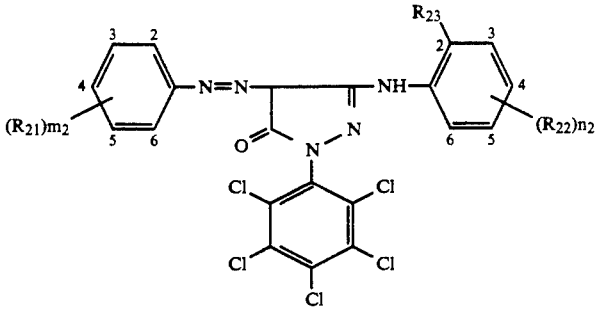
| Compound | $(R_{21})\ m_2$ | $(R_{22})\ n_2$ | $R_{23}$ |
|---|---|---|---|
| CM-8 | $3\text{-}OC_2H_5$, $4\text{-}OC_2H_5$ | 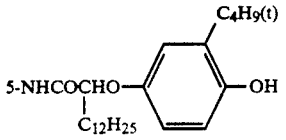 | —Cl |
| CM-9 | $3\text{-}OC_2H_5$, $4\text{-}OC_2H_5$ | 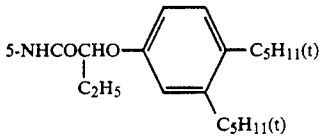 | —Cl |
| CM-10 | $3\text{-}OC_2H_5$, $4\text{-}OC_2H_5$ | 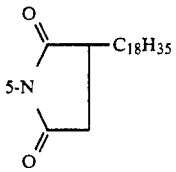 | —Cl |
| CM-11 | $3\text{-}OC_2H_5$, $4\text{-}OC_2H_5$ | 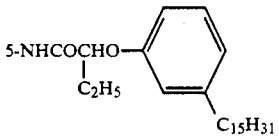 | —Cl |
| CM-12 | $4\text{-}OCH_3$ | 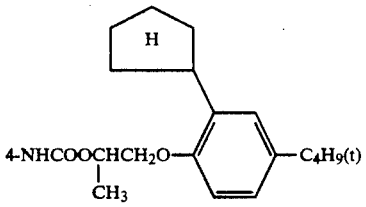 | —Cl |
| CM-13 | $4\text{-}OCH_3$ | 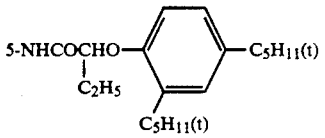 | —Cl |
| CM-14 | $4\text{-}OCH_3$ | $-(n_2 = 0)$ | $-OC_{12}H_{25}$ |
| CM-15 | $3\text{-}CH_3$, 4-OH | 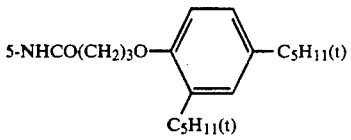 | —Cl |

-continued
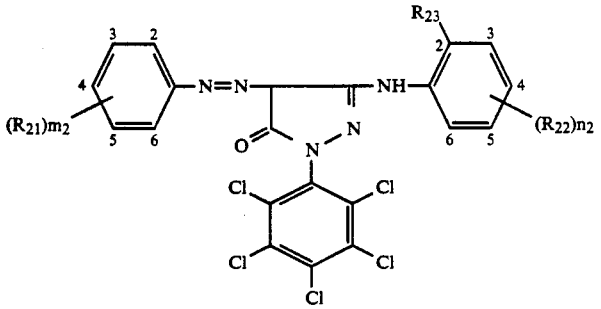
| Compound | $(R_{21})$ $m_2$ | $(R_{22})$ $n_2$ | $R_{23}$ |
|---|---|---|---|
| CM-16 | 3-$CH_3$, 4-OH | 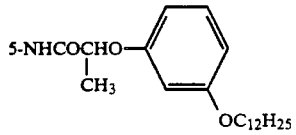 | —Cl |
| CM-17 | 4-OH | 5-$NHCOOC_{16}H_{33}$ | —Cl |
| CM-18 | 4-OH | 4-$OC_8H_{17}$, 5-$OC_8H_{17}$ | —Cl |
| CM-19 | 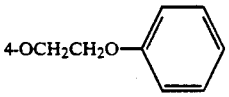 | 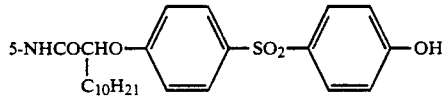 | —$OCH_3$ |
| CM-20 | 4-$NHCOC_4H_9$(t) | 5-$NHCOC_{13}H_{27}$ | —Cl |
| CM-21 | 4-$NHCOC_4H_9$(t) | 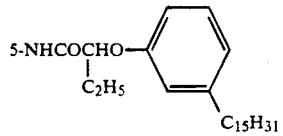 | —Cl |
| CM-22 | 3-$C_3H_7$(i), 4-$C_3H_7$(i) | 5-$COOC_{12}H_{25}$ | —Cl |
| CM-23 | 3-$C_3H_7$(i), 4-$C_3H_7$(i) | 4-$SO_2N(C_8H_{17})_2$ | —F |
| CM-24 | 3-$OCH_3$, 4-$OCH_3$ | 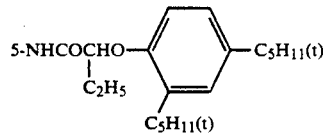 | —Cl |
| CM-25 | 3-$OC_2H_5$, 4-$OC_2H_5$ | 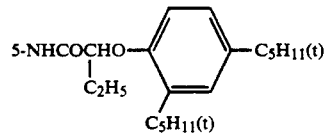 | —Cl |
| CM-26 | 4-$OC_2H_5$ | 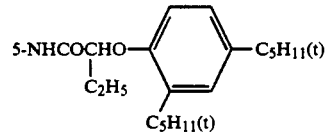 | —Cl |
| CM-27 | 4-$OC_3H_7$ | 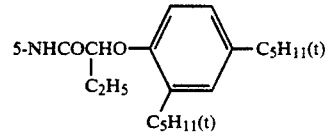 | —Cl |

-continued
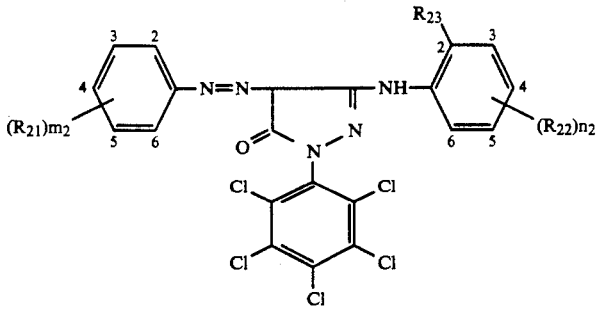
| Compound | $(R_{21})\ m_2$ | $(R_{22})\ n_2$ | $R_{23}$ |
|---|---|---|---|
| CM-28 | 4-$OC_4H_9$ | 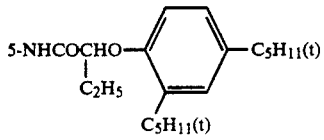 | —Cl |
| CM-29 | 4-$OCH_3$ | 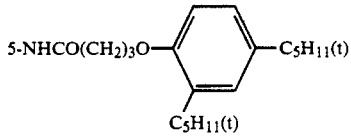 | —Cl |
| CM-30 | 3-$OCH_3$, 4-$OCH_3$ | 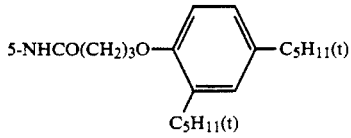 | —Cl |
| CM-31 | 3-$OC_2H_5$, 4-$OC_2H_5$ | 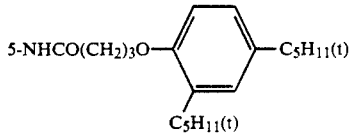 | —Cl |
| CM-32 | 4-$OC_2H_5$ | 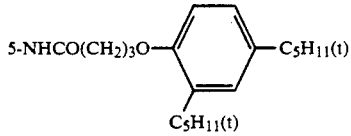 | —Cl |
| CM-33 | 4-$OC_3H_7$ | 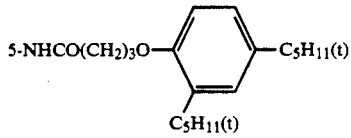 | —Cl |
| CM-34 | 4-$OC_4H_9$ | 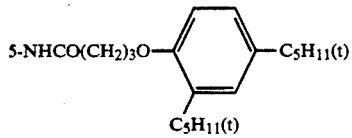 | —Cl |
| CM-35 | 4-$NHCOC_4H_9(t)$ | 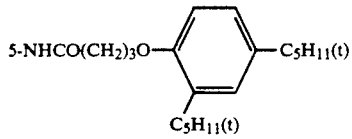 | —Cl |

-continued

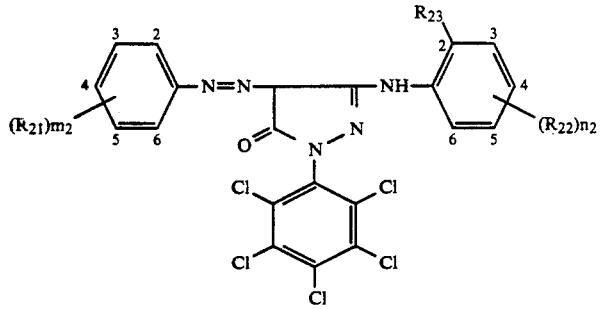

| Compound | $(R_{21})\ m_2$ | $(R_{22})\ n_2$ | $R_{23}$ |
|---|---|---|---|
| CM-36 | 4-OH | 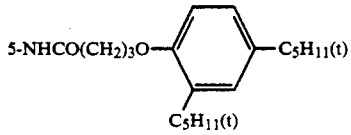 | —Cl |

The colored magenta couplers of the invention can be synthesized in the diazo-coupling reactions including, for example, the reaction detailed in JP Examined Publication No. 56-6540/1981, which is usually carried out. To be more concrete, an objective colored magenta coupler can be obtained in the following manner an aniline derivative is diazotized in water, hydrate alcohol or hydrate acetone at a temperature of 0° to −10° C. by making use of a 1 to 5×mols of conc. hydrochloric acid and I to 1,2×mols of sodium nitrite. The resulting solution is added at a temperature of −5° to −10° C. into a separately prepared pyridine solution of the magenta coupler having the mols equivalent to the mols of the above-mentioned aniline derivative and the diazotization is then carried out.

Next, the typical synthesis example of the colored magenta coupler of the invention will be given.

SYNTHESIS EXAMPLE 1 (SYNTHESIS OF CM-7)

3,4-diethoxy aniline of 1.4 g was dissolved in 3ml of conc hydrochloric acid and 18 ml of water by heating them once and the resulting solution was then cooled down to −3° C. An aqueous 10% sodium nitrite solution of 5.3 ml was added thereto so as to be diazotized and the resulting solution was stirred for 20 minutes at −3° C. After that, 0.1 g of urea was added thereto so that an excess nitrous acid could be decomposed. Separate from the above, 5.2 g of 1-(2,3,4,5,6-pentachlorophenyl)-3-(2-chloro-5-tetradecaneamidoanilino)-5-pyrazolone was dissolved in 100 ml of pyridine. The resulting solution was cooled down to a temperature of −5° to −10° C. and was then stirred. After that, the solution of the above-mentioned prepared diazonium salt was gradually added thereto.

Three hours later, the reacted solution was poured into 400 ml of ice water containing 100 ml of conc. hydrochloric acid. The resulting crystals were filtrated, washed, dried and recrystallized out of a mixed solution of ethyl acetate and acetonitrile, so that 5.5 g of CM-7 could be obtained.

SYNTEHSIS EXAMPLE 2 (SYNTHESIS OF CM-13)

4-methoxy aniline of 1.0 g was dissolved in 3ml of conc hydrochloric acid and 20 ml of water by heating them once and the resulting solution was then cooled down to −3° C. An aqueous 10% sodium nitrite solution of 5.3 ml was added thereto so as to be diazotized and the resulting solution was stirred for 20 minutes at −3° C.. After that, 0.1 g of urea was added thereto so that an excess nitrous acid could be decomposed.

Separate from the above, 5.6 g of 1-(2,3,4,5,6-pentachlorophenyl)-3-{2-chloro-5-[α-(2,4-di-t-amylphenoxy) butanamido]anilino}-5-pyrazolone was dissolved in 100 ml of pyridine. The resulting solution was cooled down to −5° to −10° C. and was then stirred. The above-mentioned prepared diazonium salt solution was then gradually added thereto. Three hours later, the resulting reacted solution was poured into 400 ml of ice water containing 100 ml of conc. hydrochloric acid. The resulting crystals were filtrated, washed, dried and recrystallized out of a mixed solution of acetonitrile and ethyl acetate, so that 5.1 g of CM-13 could be obtained.

The structures of the resulting compounds were identified by NMR spectra and Mass spectra.

The colored magenta couplers of the invention may also be used in combination.

The amounts of the colored magenta couplers of the invention to be added shall not be limitative, but they may be added suitably in an amount within the range of 1/20 to ½ mols of other magenta couplers used, and the amounts thereof may also suitably be adjusted so as to meet to the kinds (or characteristics) of silver halides, magenta couplers and the colored magenta couplers of the invention.

Next, the compounds represented by Formula [A-I] will be detailed.

$$R_{11}—NHSO_2—R_{12} \qquad \text{Formula [A-I]}$$

wherein $R_{11}$ and $R_{12}$ represent each a hydrogen atom, an alkyl group, a cycloalkyl group, an alkenyl group, a cycloalkenyl group, an alkinyl group, an aryl group, a heterocyclic group, an alkoxy group, an aryloxy group, a heterocyclicoxy group, or

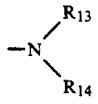

wherein $R_{13}$ and $R_{14}$ represent each a hydrogen atom, an alkyl group or an aryl group, provided, $R_{13}$ and $R_{14}$ may be the same with or the different from each other.

The alkyl groups represented by $R_{11}$ and $R_{12}$ include those having 1 to 32 carbon atoms; the alkenyl and alkinyl groups, those having 2 to 32 carbon atoms; and the cycloalkyl and cycloalkenyl groups, those having 3 to 12 carbon atoms, respectively. The alkyl, alkenyl and alkinyl groups may be straight-chained or branched. These groups include those having substituents.

The aryl groups represented by $R_{11}$ and $R_{12}$ include desirably, a phenyl group including those having substituents.

The heterocyclic groups represented by $R_{11}$ and $R_{12}$ include desirably, those having 5 to 7 members. They may be condensed and may include those having substituents.

The alkoxy groups represented by $R_{11}$ and $R_{12}$ include those having substituents, such as a 2-ethoxyethoxy group, a pentadecyloxy group, a 2-dodecyloxyethoxy group and a phenethyloxyethoxy group.

The aryloxy groups include, desirably, a phenyloxy group, wherein the aryl nucleus thereof may be substituted. They include, for example, a phenoxy group, a p-t-butylphenoxy group and an m-pentadecylphenoxy group.

The heterocyclicoxy groups include, desirably, those having a 5- to 7-member ring. The ring may further have a substituent. These groups include, for example, a 3,4,5,6-tetrahydropyranyl-2-oxy group and a 1-phenyltetrazole-5-oxy group.

The particularly desirable compounds of the invention, among the compounds represented by Formula [A-I], include the compounds represented by the following Formula [A-III].

$$R_{15}-NHSO_2-R_{16} \qquad \text{Formula [A-III]}$$

wherein $R_{15}$ and $R_{16}$ represent each an alkyl or aryl group, provided that these groups include those Substituted. At least one of $R_{15}$ and $R_{16}$ represents desirably an aryl group. Most desirably, both of $R_{15}$ and $R_{16}$ represent aryl groups and in particular, a phenyl group is preferable. Wherein, when $R_{15}$ represents a phenyl group, it is particularly desired that the Hammett's $\sigma p$ value of the substituent in the para-position of a sulfonamido group is not less than $-0.4$.

The alkyl and aryl groups each represented by $R_{15}$ and $R_{16}$ are synonymous with the alkyl and aryl groups each represented by $R_{11}$ and $R_{12}$.

The compounds of the invention represented by Formula [A-I] may form a polymer Of not less than a dimer in $R_{11}$ and $R_{12}$ and $R_{11}$ and $R_{12}$ may also be coupled to each other so as to form a 5- or 6-member ring.

In the non-color developable compounds of the invention represented by Formula [A-I], the total numbers of the carbon atoms thereof are desirable to be not less than 8 and particularly desirable to be not less than 12.

The typical and concrete examples of the compounds of the invention represented by Formula [A-I] will be given below.

| Compound No. | $R_{11}-NHSO_2-R_{12}$ $R_{11}$ | $R_{12}$ |
|---|---|---|
| AI-1 | 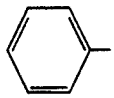 | 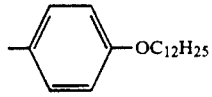 |
| AI-2 | 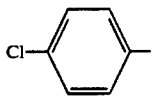 | 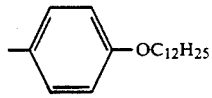 |
| AI-3 | 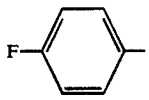 | 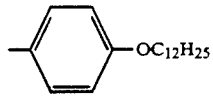 |
| AI-4 | 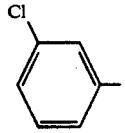 | 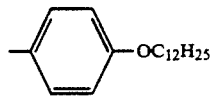 |
| AI-5 | 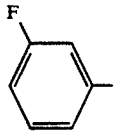 | 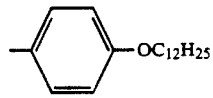 |
| AI-6 | 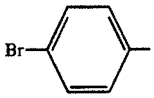 | 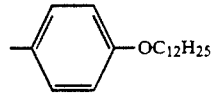 |

-continued
| Compound No. | $R_{11}$—$NHSO_2$—$R_{12}$ $R_{11}$ | $R_{12}$ |
|---|---|---|
| AI-7 | 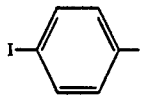 | 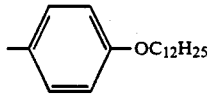 |
| AI-8 | 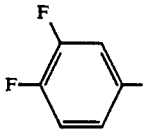 | 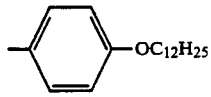 |
| AI-9 | 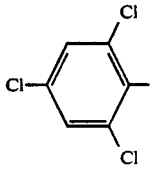 | 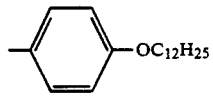 |
| AI-10 | 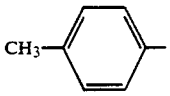 | 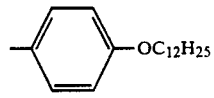 |
| AI-11 | 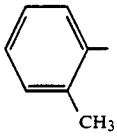 | 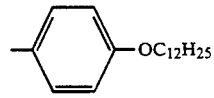 |
| AI-12 | 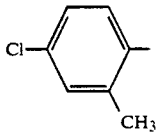 | 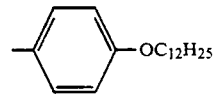 |
| AI-13 | 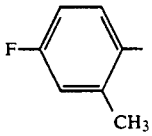 | 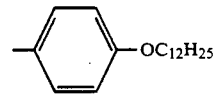 |
| AI-14 | 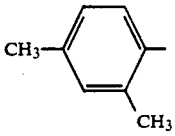 | 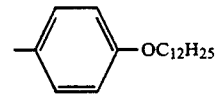 |
| AI-15 | 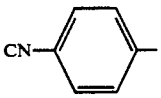 | 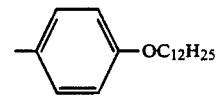 |
| AI-16 | 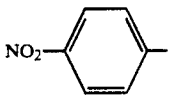 | 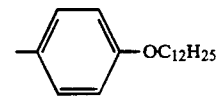 |
| AI-17 | 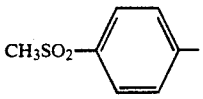 | 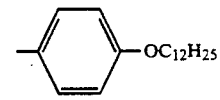 |

-continued
| Compound No. | $R_{11}$—$NHSO_2$—$R_{12}$ $R_{11}$ | $R_{12}$ |
|---|---|---|
| AI-18 | 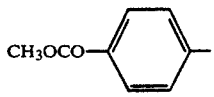 | 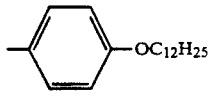 |
| AI-19 | 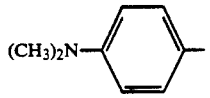 | 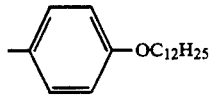 |
| AI-20 | 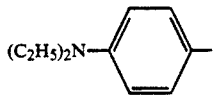 | 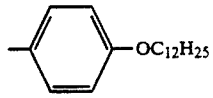 |
| AI-21 | 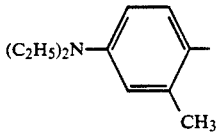 | 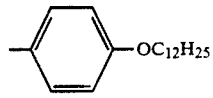 |
| AI-22 | 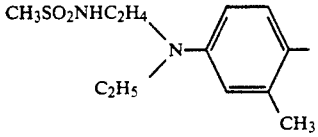 | 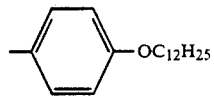 |
| AI-23 | 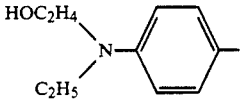 | 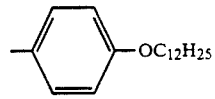 |
| AI-24 | 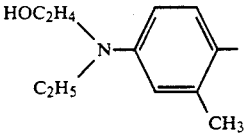 | 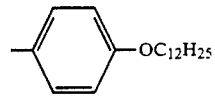 |
| AI-25 | 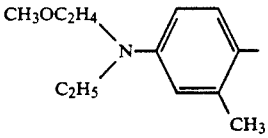 | 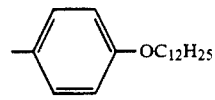 |
| AI-26 | 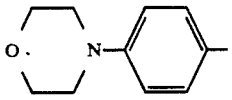 | 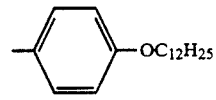 |
| AI-27 | 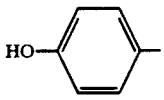 | 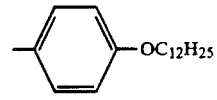 |
| AI-28 | 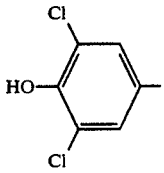 | 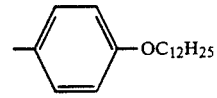 |

-continued
| Compound No. | $R_{11}$—$NHSO_2$—$R_{12}$ $R_{11}$ | $R_{12}$ |
|---|---|---|
| AI-29 | 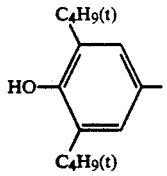 | 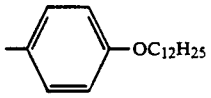 |
| AI-30 | 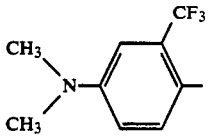 | 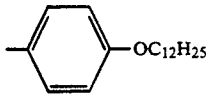 |
| AI-31 | 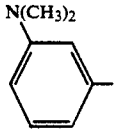 | 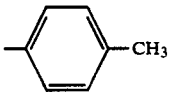 |
| AI-32 | 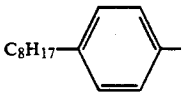 | 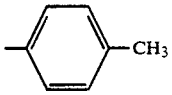 |
| AI-33 | 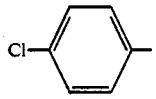 | 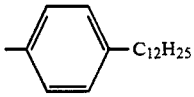 |
| AI-34 | 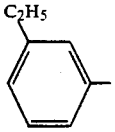 | 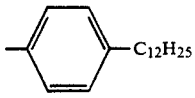 |
| AI-35 | 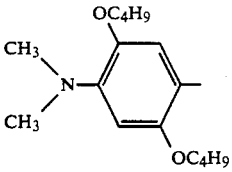 | 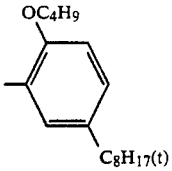 |
| AI-36 | 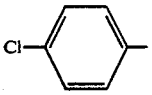 | 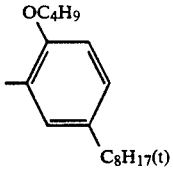 |
| AI-37 | 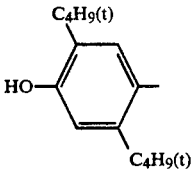 | 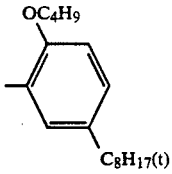 |
| AI-38 | 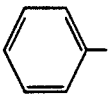 | 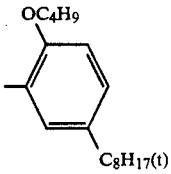 |

-continued
| Compound No. | $R_{11}$—$NHSO_2$—$R_{12}$ $R_{11}$ | $R_{12}$ |
|---|---|---|
| AI-39 | 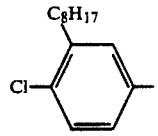 | 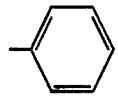 |
| AI-40 | 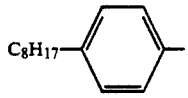 | 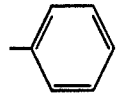 |
| AI-41 | 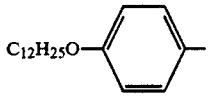 | 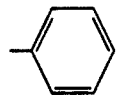 |
| AI-42 | 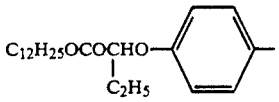 | 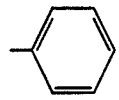 |
| AI-43 | 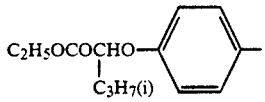 | 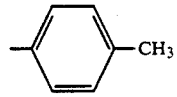 |
| AI-44 | 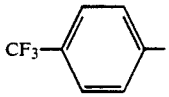 | 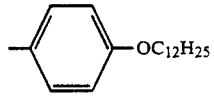 |
| AI-45 | 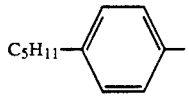 | 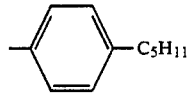 |
| AI-46 | 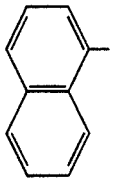 | 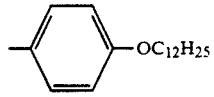 |
| AI-47 | 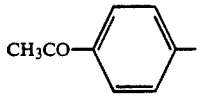 | 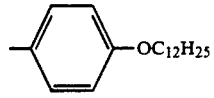 |
| AI-48 | 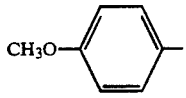 | 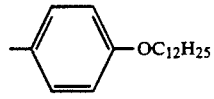 |
| AI-49 | 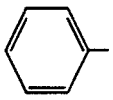 | $-C_{16}H_{33}$ |
| AI-50 | 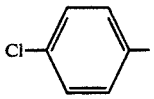 | $-C_{16}H_{33}$ |

-continued
| Compound No. | $R_{11}$—$NHSO_2$—$R_{12}$ $R_{11}$ | $R_{12}$ |
|---|---|---|
| AI-51 | 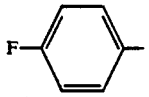 | $-C_{16}H_{33}$ |
| AI-52 | 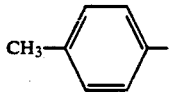 | $-C_{16}H_{33}$ |
| AI-53 | 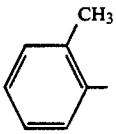 | $-C_{16}H_{33}$ |
| AI-54 | 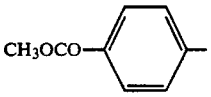 | $-C_{16}H_{33}$ |
| AI-55 | 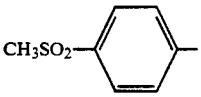 | $-C_{8}H_{17}$ |
| AI-56 | 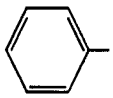 | 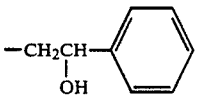 |
| AI-57 | 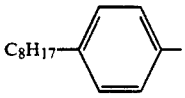 | $-C_{3}H_{7}(i)$ |
| AI-58 | $C_{8}H_{17}-$ | 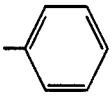 |
| AI-59 | $C_{4}H_{9}CHCH_{2}-$ (with $C_{2}H_{5}$) | 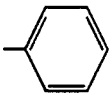 |
| AI-60 | $CH_{3}-$ | 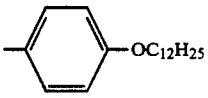 |
| AI-61 | $Cl(CH_{2})_{2}-$ | 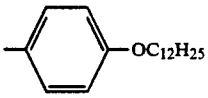 |
| AI-62 | $CF_{3}CH_{2}-$ | 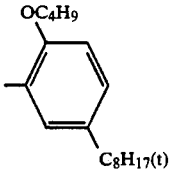 |

-continued
| Compound No. | $R_{11}$—$NHSO_2$—$R_{12}$ $R_{11}$ | $R_{12}$ |
|---|---|---|
| AI-63 | 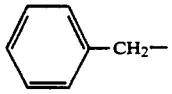 | 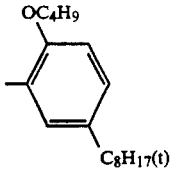 |
| AI-64 | $C_8H_{17}$— | 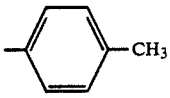 |
| AI-65 | $C_{12}H_{25}$— | 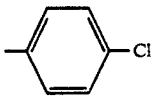 |
| AI-66 | 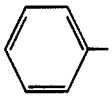 | 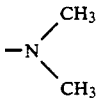 |
| AI-67 | 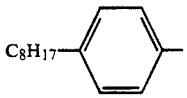 | 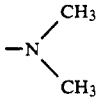 |
| AI-68 | 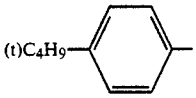 | 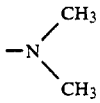 |
| AI-69 | 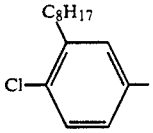 | 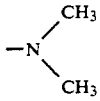 |
| AI-70 | 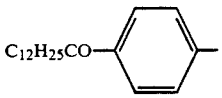 | 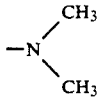 |
| AI-71 | 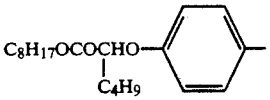 | 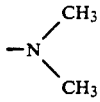 |
| AI-72 | 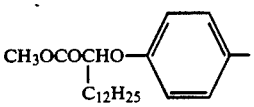 | 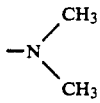 |
| AI-73 | 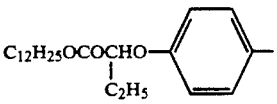 | 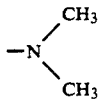 |
| AI-74 | 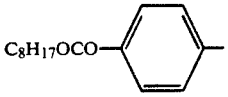 | 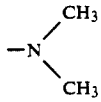 |

-continued

| Compound No. | $R_{11}$—$NHSO_2$—$R_{12}$ $R_{11}$ | $R_{12}$ |
|---|---|---|
| AI-75 | $C_{12}H_{25}O$— | —N($C_2H_5$)$_2$ |
| AI-76 | $C_8H_{17}$— | —N($C_2H_5$)$_2$ |
| AI-77 | $C_8H_{17}$(t) CN— | —N($C_2H_5$)$_2$ |
| AI-78 | $C_{12}H_{25}OCO$— | —N($C_2H_5$)$_2$ |
| AI-79 | $CH_3OCOCHO$— $C_{12}H_{25}$ | —N($C_2H_5$)$_2$ |
| AI-80 | $CH_3OCOCHO$— $C_3H_7$(i) | —N($C_2H_5$)$_2$ |
| AI-81 | $C_{12}H_{25}OCOCH_2$— | —N($C_2H_5$)$_2$ |
| AI-82 | $C_{12}H_{25}OCOCHOCO$— $C_2H_5$ | —N($C_2H_5$)$_2$ |
| AI-83 | $C_{12}H_{25}OCO(CH_2)_3O$— | —N($CH_3$)$_2$ |
| AI-84 | $C_{10}H_{21}NHCO$— | —N($CH_3$)$_2$ |
| AI-85 | $C_8H_{17}$— | —N($C_2H_5$)$_2$ |
| AI-86 | $C_8H_{17}$— | —NH— |
| AI-87 | $C_8H_{17}$— | —$C(CH_3)_3$ |
| AI-88 | $CCl_3CH_2$— | —$C_{16}H_{33}$ |

-continued
| Compound No. | $R_{11}$—$NHSO_2$—$R_{12}$ $R_{11}$ | $R_{12}$ |
|---|---|---|
| AI-89 | 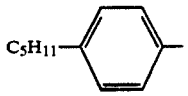 | 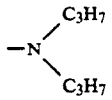 |
| AI-90 | H— | 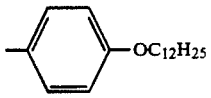 |
| AI-91 | 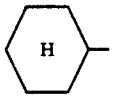 | 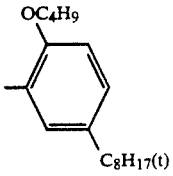 |
| AI-92 | $CF_3CH{=}CH$— | 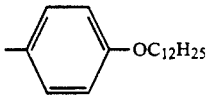 |
| AI-93 | 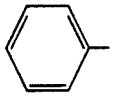 | 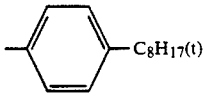 |
| AI-94 | $HOCH_2CH_2C{=}C$— | 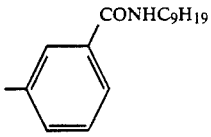 |
| AI-95 | 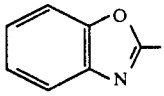 | —$C_{18}H_{37}$ |
| AI-96 | 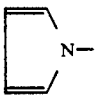 | 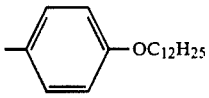 |
| AI-97 | $C_4H_9CO$— | 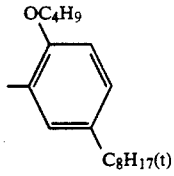 |
| AI-98 | $C_{10}H_{21}NHCO$— | 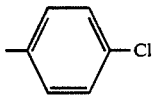 |
| AI-99 | 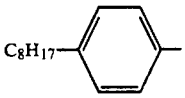 | —$OC_2H_5$ |

-continued
| Compound No. | $R_{11}$—$NHSO_2$—$R_{12}$ $R_{11}$ | $R_{12}$ |
|---|---|---|
| AI-100 | 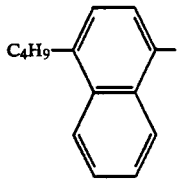 | 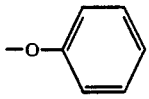 |
| AI-101 | 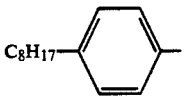 | 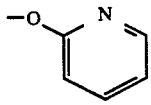 |
| AI-102 | 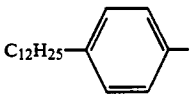 | $-NH_2$ |
| AI-103 | 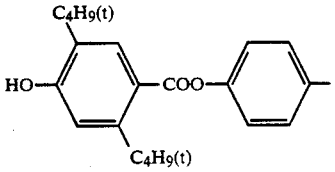 | 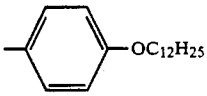 |
| AI-104 | 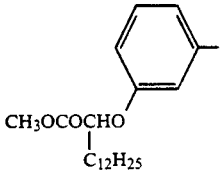 | 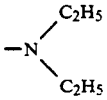 |
| AI-105 | 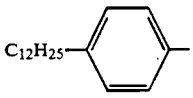 | 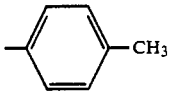 |
| AI-106 | 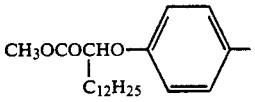 | 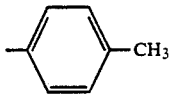 |
| AI-107 | 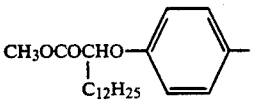 | 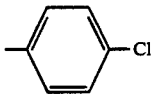 |
| AI-108 | 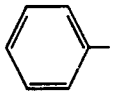 | 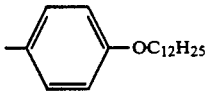 |
| AI-109 | 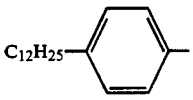 | 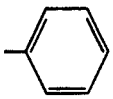 |
| AI-110 | 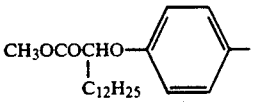 | 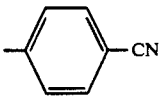 |

-continued

| Compound No. | $R_{11}$—$NHSO_2$—$R_{12}$ $R_{11}$ | $R_{12}$ |
|---|---|---|
| AI-111 | 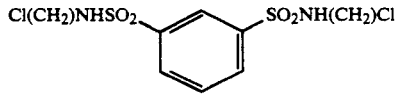 | |
| AI-112 | 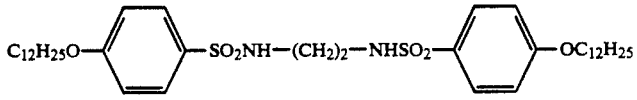 | |
| AI-113 | 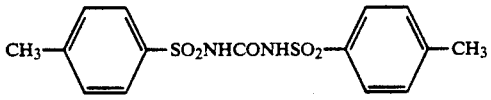 | |
| AI-114 | 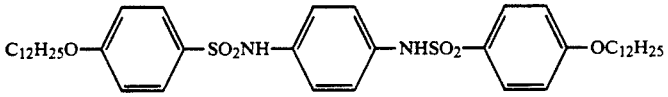 | |
| AI-115 | 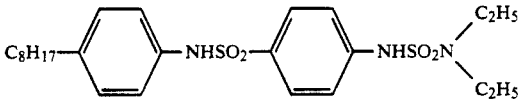 | |
| AI-116 | 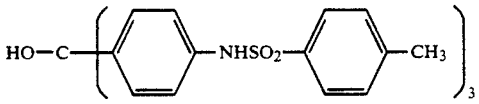 | |
| AI-117 | 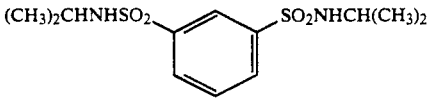 | |
| AI-118 | 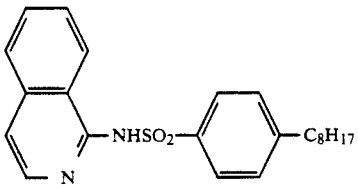 | |
| AI-119 | 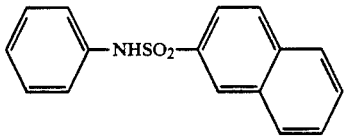 | |
| AI-120 | 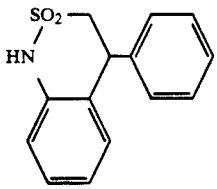 | |

The compounds of the invention represented by Formula [A-I] can be synthesized in the conventionally known processes such as the process described in JP Application No. 61-20589/1986.

The compounds of the invention represented by Formula [A-I] can be used in a proportion within the range of, desirably, 5 to 500 mol% and, more desirably, 10 to 300 mol% of the couplers used.

Some of the compounds of the invention represented by Formula [A-I] are described in JP OPI Publication Nos. 57-76543/1982, 57-179842/1982, 58-1139/1983 and 62-178258/1987.

Next, the compounds represented by Formula [A-II] will be detailed.

Formula [A-II]

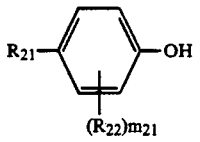

wherein $R_{21}$ represents an alkyl group, an alkoxycarbonyl group, an arylsulfonyl group, an alkylsulfonyl group, an arylsulfonylamino group or an alkylsulfonylamino group; $R_{22}$ represents a group substitutable with a benzene ring; and $m_{21}$ is an integer of 0 to 4.

The alkyl groups represented by $R_{21}$ include, desirably, those straight-chained or branched having 1 to 32 carbon atoms and those having substituents. The examples thereof include a straight-chained or branched butyl group, a hexyl group, a decyl group, a dodecyl group and an octadecyl group. Among the alkyl groups represented by $R_{21}$, the particularly desirable ones are those having 4 to 20 carbon atoms and more desirable ones are those having 5 to 9 carbon atoms.

As for the alkoxycarbonyl groups represented by $R_2$include desirably those having 2 to 20 carbon atoms. The alkyl components in these alkoxycarbonyl groups may be straight chained or branched and these alkoxycarbonyl groups may include those having substituents. The examples of the above-mentioned alkoxycarbonyl groups include a methoxycarbonyl group, an ethoxycarbonyl group, a hexyloxycarbonyl group, an octyloxycarbonyl group, an undecyloxycarbonyl group and an octadecyloxycarbonyl group. Among the alkoxycarbonyl groups represented by $R_{21}$, the desirable ones include those having 2 to 14 carbon atoms in total and the more desirable ones are those having 5 to 13 carbon atoms.

The arylsulfonyl groups represented by $R_{21}$ include, for example, a benzenesulfonyl group, a naphthalenesulfonyl group and also include those having substituents. The typical examples of the arylsulfonyl groups may include a p-toluenesulfonyl group, a p-dodecylbenzenesulfonyl group, a p-dodecyloxybenzenesulfonyl group, a p-chlorobenzenesulfonyl group, a p-octylbenzenesulfonyl group, a 1-naphthalenesulfonyl group and a 4-dodecyloxynaphthalenesulfonyl group.

The alkylsulfonyl groups represented by $R_{21}$ include, desirably, those having a straight-chained or branched alkyl group having 1 to 32 carbon atoms and also include the alkyl groups having substituents. The examples of the alkylsulfonyl groups may include a methylsulfonyl group, an ethylsulfonyl group, a straight-chained or branched butylsulfonyl group, a dodecylsulfonyl group and a hexadecylsulfonyl group.

The arylsulfonylamino groups represented by $R_{21}$ include, for example, a benzenesulfonylamino group and a naphthalene sulfonylamino group and also include those having substituents. The typical examples of the arylsulfonylamino groups include a p-toluenesulfonylamino group, a p-dodecylbenzenesulfonylamino group, a p-dodecyloxybenzenesulfonylamino group, a p-chlorobenzene sulfonylamino group, a p-octylbenzenesulfonylamino group, a 1-naphthalenesulfonylamino group and a 4-dodecyloxynaphthalene sulfonylamino group.

The alkylsulfonylamino groups represented by $R_{21}$ include, desirably, those having a straight-chained or branched alkyl group having 1 to 32 carbon atoms and also include those having the alkyl groups having substituents. The examples of the alkylsulfonylamino groups may include a methylsulfonylamino group, an ethyl sulfonylamino group, a straight-chained or branched butyl sulfonylamino group, a dodecylsulfonylamino group and a hexadecyl sulfonylamino group.

The groups substitutable with a benzene ring, which are represented by $R_{22}$, shall not be specially limited, but they include, for example, a halogen, an alkyl group, a cycloalkyl group, an alkenyl group, a cycloalkenyl group, an alkinyl group, an aryl group, a heterocyclic group, an alkoxy group, an aryloxy group,

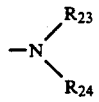

wherein $R_{23}$ and $R_{24}$ represent each an alkyl group or an aryl group, a cyano group, an acyl group, an alkoxycarbonyl group, a carbamoyl group, a sulfamoyl group, a nitro group, a carboxyl group, a sulfo group, an alkylthio groups, an acylamino group, a sulfonamido group, an arylthio group and hydroxy group. Among the halogens, chlorine is particularly desirable.

The typical and concrete examples of the non-color developable compounds of the invention represented by Formula [A-II] will be given below.

(AII-1)

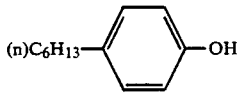

(AII-2)

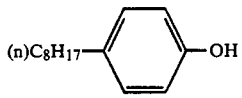

(AII-3)

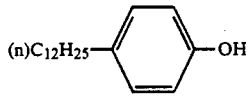

(AII-4)

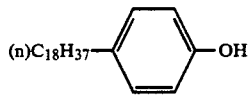

(AII-5)

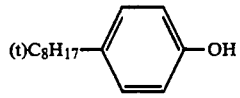

(AII-6)

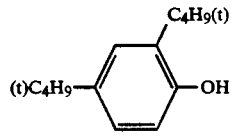

(AII-7)

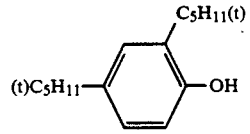

-continued
(AII-8)
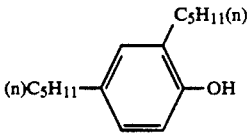
(AII-9)
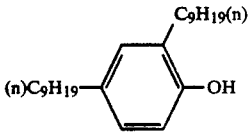
(AII-10)
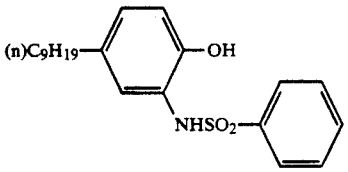
(AII-11)
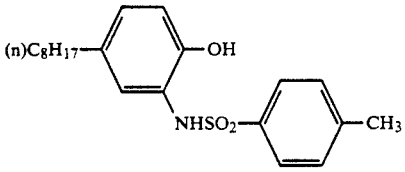
(AII-12)
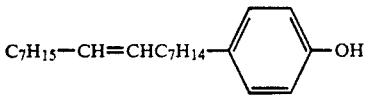
(AII-13)
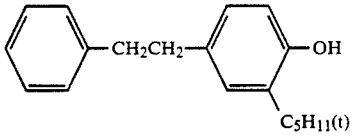
(AII-14)
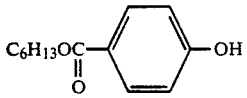
(AII-15)
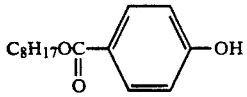
(AII-16)
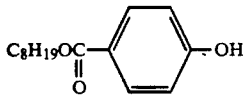
(AII-17)
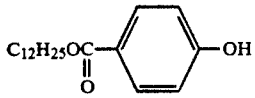
(AII-18)
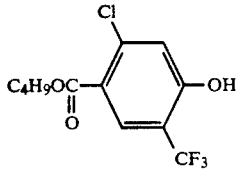
-continued
(AII-19)
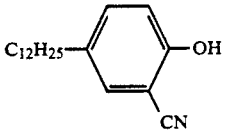
(AII-20)
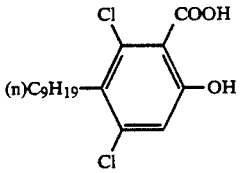
(AII-21)
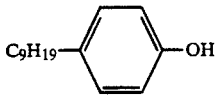
(AII-22)
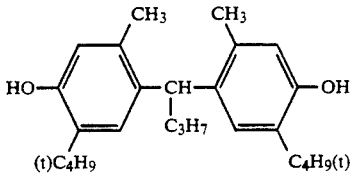
(AII-23)
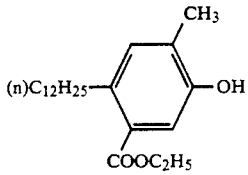
(AII-24)
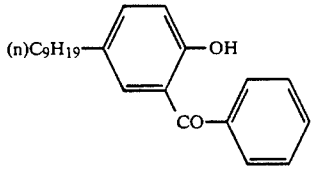
(AII-25)
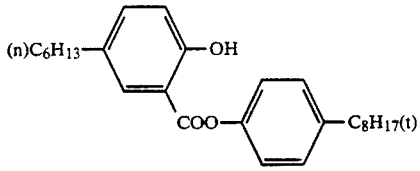
(AII-26)
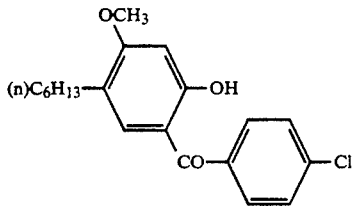
(AII-27)
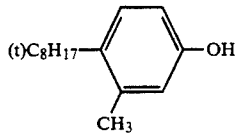

-continued
(AII-28)
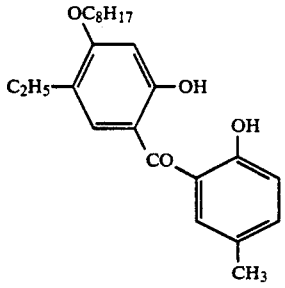
(AII-29)
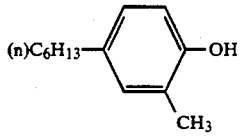
(AII-30)
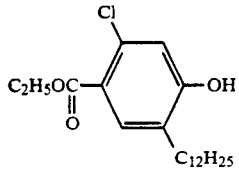
(AII-31)
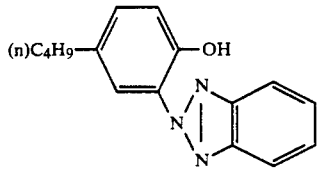
(AII-32)
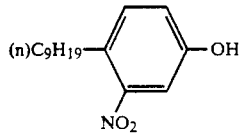
(AII-33)
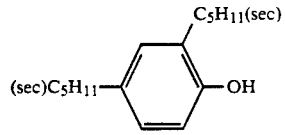
(AII-34)
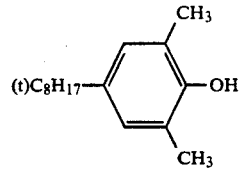
(AII-35)
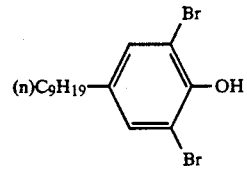
(AII-36)
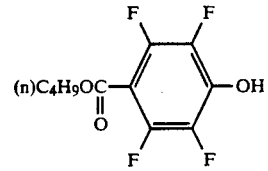
-continued
(AII-37)
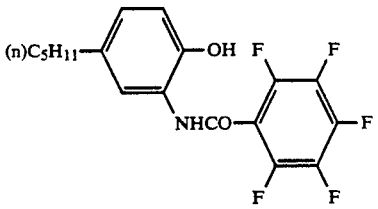
(AII-38)
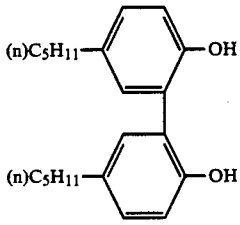
(AII-39)
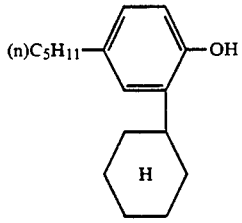
(AII-40)
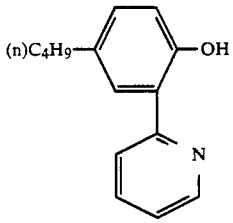
(AII-41)
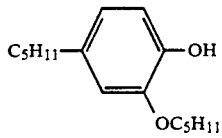
(AII-42)
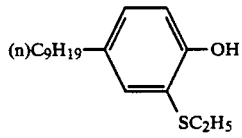
(AII-43)
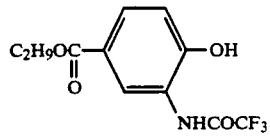
(AII-44)
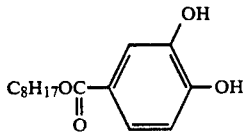

-continued (AII-45)

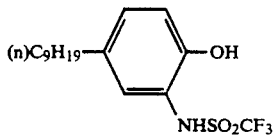

(AII-46)

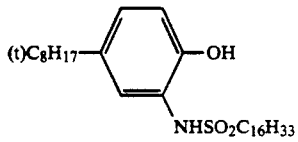

(AII-47)

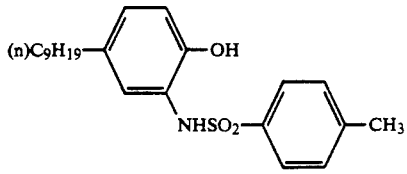

(AII-48)

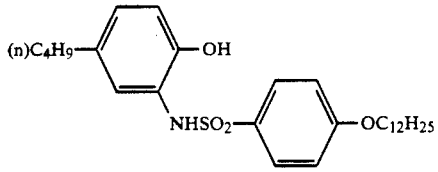

(AII-49)

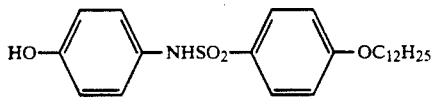

(AII-50)

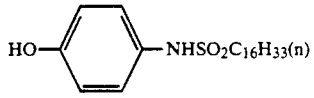

(AII-51)

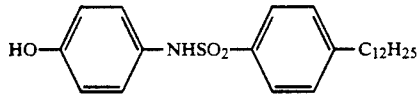

(AII-52)

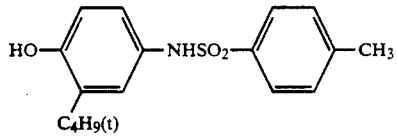

(AII-53)

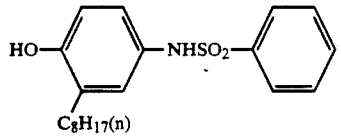

(AII-54)

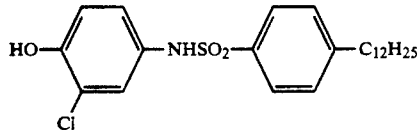

(AII-55)

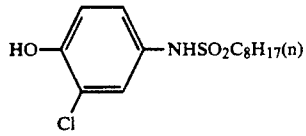

-continued (AII-56)

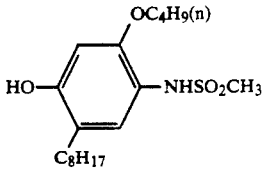

(AII-57)

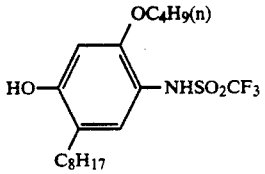

(AII-58)

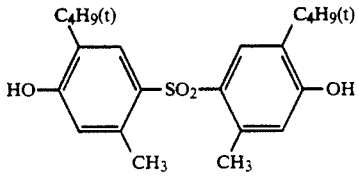

(AII-59)

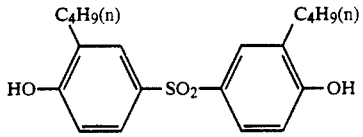

(AII-60)

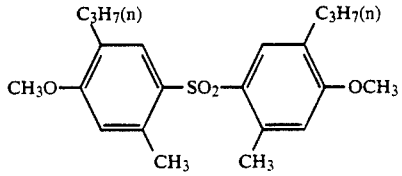

The above-given compound can readily be synthesized in the conventionally known processes including, for example, the process described in U.S. Pat. No. 2,835,579. In addition, there are many compounds available on the market including, for example, the above-given compounds (AII-3), (AII-5), (AII-7), (AII-16) and (AII-21).

Next, the magenta couplers relating to the invention, represented by the foregoing Formula [M-II] (hereinafter referred to as magenta coupler [M-II]) will now be detailed.

Formula [M-II]

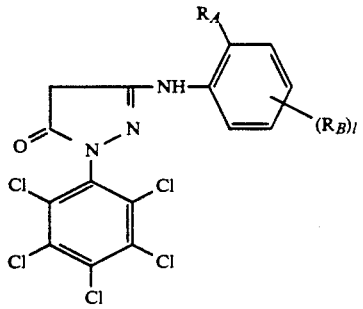

wherein $R_A$ represents a halogen atom or an alkoxy group; $R_B$ represents an acylamino group, a sulfonamido group, an imido group, a carbamoyl group, a sulfamoyl group, an alkoxycarbonyl group, an alkoxycarbonylamino group or an alkoxy group; and 1 is an integer of 0 to 4.

In Formula [M-II], the halogen atoms represented by $R_A$ include, for example, a chlorine atom, a bromine atom and a fluorine atom; the alkoxy groups include, for example, a methoxy group and a dodecyloxy group; and the desirable $R_A$ include a chlorine atom.

The acylamino groups represented by $R_B$ include, for example, a 2,4-di-t-pentylphenoxy acetamido group and a 4-(2,4-di-t-pentylphenoxy)butanamido group; the sulfonamido groups include, for example, a 4-dodecyloxyphenylsulfonamido group; the imido groups include, for example, an octadecenylsuccinimido group; the carbamoyl groups include, for example, a 4-(2,4-di-t-pentylphenoxy) butylaminocarbonyl group; the sulfamoyl groups include, for example, a tetradecanesulfamoyl group; the alkoxycarbonyl groups include, for example, a tetradecaneoxycarbonyl group; the alkoxy carbonylamino groups include, for example, a dodecyloxycarbonyl amino group; and the alkoxy groups include, for example, a methoxy group, an ethoxy group and an octyloxy group; respectively. The groups desirable for $R_B$ include an acylamino group substituted to the p-position in respect of $R_A$. 1 is desirably 1.

The typical and concrete examples of magenta couplers [M-II] will be given below. However the invention shall not be limited thereto.

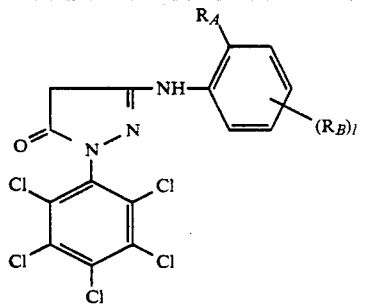

| Compound | $R_A$ | $(R_B)_l$ |
|---|---|---|
| II-1 | Cl | 5-NHCOCH$_2$O-(C$_5$H$_{11}$(t))-C$_5$H$_{11}$(t) |
| II-2 | Cl | 5-NHCOCH(C$_2$H$_5$)O-(C$_5$H$_{11}$(t))-C$_5$H$_{11}$(t) |
| II-3 | Cl | 5-NHCOCH((i)C$_3$H$_7$)O-(C$_5$H$_{11}$(t))-C$_5$H$_{11}$(t) |
| II-4 | Cl | 5-NHCOCH(C$_4$H$_9$)O-(C$_5$H$_{11}$(t))-C$_5$H$_{11}$(t) |
| II-5 | Cl | 5-NHCO(CH$_2$)$_3$O-(C$_5$H$_{11}$(t))-C$_5$H$_{11}$(t) |
| II-6 | Cl | 5-NHSO$_2$C$_{16}$H$_{33}$ |

-continued

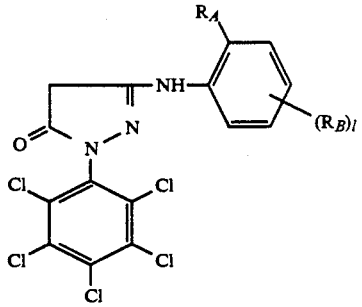

| Compound | $R_A$ | $(R_B)_l$ |
|---|---|---|
| II-7 | Cl | 5-NHSO$_2$-(C$_6$H$_4$)-OC$_{12}$H$_{25}$ |
| II-8 | OCH$_3$ | 5-NHSO$_2$C$_{12}$H$_{25}$ |
| II-9 | Cl | 5-N(C(=O)CH$_2$CH(C$_{18}$H$_{35}$)C(=O))- |
| II-10 | Cl | 5-NHCOC$_{13}$H$_{27}$ |
| II-11 | OCH$_3$ | 5-NHCOCH(C$_{12}$H$_{25}$)O-(C$_6$H$_3$(C$_4$H$_9$(t))-OH) |
| II-12 | Cl | 5-NHCOCH(C$_2$H$_5$)O-(C$_6$H$_4$)-C$_{15}$H$_{31}$ |
| II-13 | Cl | 5-CONHC$_{12}$H$_{25}$ |
| II-14 | Cl | 5-SO$_2$N(C$_8$H$_{17}$)$_2$ |
| II-15 | Cl | 4-OC$_8$H$_{17}$, 5-OC$_8$H$_{17}$ |
| II-16 | Cl | 5-COOC$_{12}$H$_{25}$ |
| II-17 | Cl | 5-NHCOCH(CH$_3$)CH$_2$SO$_2$C$_{12}$H$_{25}$ |
| II-18 | Cl | 5-NHCOCH(C$_{10}$H$_{21}$)O-(C$_6$H$_4$)-SO$_2$-(C$_6$H$_4$)-OH |
| II-19 | Cl | 5-NHCOOC$_{12}$H$_{25}$ |
| II-20 | Cl | 5-OC$_{12}$H$_{25}$ |

The above-given magenta couplers [M-II] can be synthesized in the ordinary processes for synthesizing a 1-phenyl-5-pyrazolone compound, such as the processes described in, for example, U.S. Pat. Nos. 2,369,489, 2,376,380, 2,472,581, 2,600,788, 2,933,391 and 3,615,506; British Patent Nos. 956,261 and 1,134,329; and JP Examined Publication No. 45-20636/1970.

A concrete synthesis example of magenta couplers [M-II] will be given below.

SYNTHESIS EXAMPLE (SYNTHESIS OF EXEMPLIFIED COMPOUND II-5)

1-pentachlorophenyl-3-(2-chloro-5-aminoanilino)-pyrazolone of 11.2 g was added into 75 ml of ethyl acetate and 20 ml of water dissolved with 2.7 g of sodium acetate was further added thereto. The resulting solution was stirred for one hour. Next, 9.2 g of 4-(2,4-di-t-pentylphenoxy)butanoyl chloride dissolved with 25 ml of ethyl acetate was added thereto by taking a time for 10 minutes. After stirring for 3 hours, removing the resulting aqueous layer and washing with 50 ml of water, the ethyl acetate was removed by vacuum distillation. The resulting residue was recrystallized with toluene, so that 12.8 g of the objective matter could be obtained.

White crystals with a melting point of 125° to 127° C.

The resulting compound was identified in Mass, NMR and IR spectra and was thereby confirmed to be Exemplified Compound M-5.

Magenta couplers [M-II] may be used in an amount within the range of $1\times10^{-3}$ mols to 1 mol and, desirably, $1\times10^{-2}$ mols to $8\times10^{-1}$ mols per mol of silver halide used.

In the invention, when magenta couplers [M-I] and [M-II] are used in combination in a single silver halide emulsion layer, the mol ratio between the two couplers are, desirably, 10:1 to 1:5 and, more desirably, 5:1 to 1:3. The couplers of the invention can be used with other kinds of magenta couplers in combination.

Magenta coupler [M-I] and magenta coupler [M-II] may be used separately in two or more silver halide emulsion layers each having the same color sensitivity. For example, these magenta couplers may be used separately in a high-speed silver halide emulsion layer and a low-speed silver halide emulsion layer.

In the invention, it is desirable that magenta coupler [M-I] and magenta coupler [M-II] are to be contained in at least one of green sensitive silver halide emulsion layers.

In the silver halide photographic light sensitive materials of the invention, the silver halides applicable to the silver halide emulsions thereof include any silver halides applicable to any ordinary silver halide emulsions, such as silver bromide, silver iodobromide, silver iodochloride, silver chlorobromide and silver chloride.

The silver halide grains applicable to the silver halide emulsions may be those having the uniform distribution of the silver halide grain composition inside the grains or those having a layer-formed structure having the different silver halide compositions between the inside of the grains and the surface layer thereof.

The silver halide grains may be those capable of forming a latent image mainly on the surfaces thereof or those capable of forming a latent image mainly inside the grains.

Any silver halide emulsions may be used without limitation, even if they have any grain-size distributions. In other words, it is allowed to use an emulsion having a wide grain-size distribution (that is so-called a polydisperse type emulsion) and to use emulsions having a narrow grain-size distribution (which are so-called monodisperse type emulsions), independently or in combination in the form of the mixtures thereof. It is also allowed to use the mixtures of the polydisperse type emulsions and the monodisperse type emulsions.

The silver halide emulsions may be used upon mixing two or more kinds of separately prepared silver halide emulsions together.

The silver halide grains applicable to the invention can be chemically sensitized in, for example, a sulfur sensitization method, a selenium sensitization method, a reduction sensitization method and a noble-metal sensitization method.

The silver halide grains applicable to the invention can be spectrally sensitized to any desired spectral region by making use of the dyes as the sensitizing dye known in photographic industry.

To the silver halide emulsions, an antifoggant and a stabilizer may be added.

In the emulsions or the like of the silver halide photographic light sensitive materials of the invention, gelatin can advantageously be used for the binders (or the protective colloids) applicable to the emulsions or the like. Besides the gelatin, it is also allowed to use a hydrophilic colloids such as a gelatin derivative, a graft polymer comprising gelatin and other macromolecules, protein, a sugar derivative, a cellulose derivative and a synthetic hydrophilic macromolecular substance such as a monomer or a copolymer.

In the silver halide photographic light sensitive materials of the invention, the photographic emulsion layers and the other hydrophilic colloidal layers thereof are each hardened by cross-coupling the binder (or protective colloid) molecules and by making independent or combination use of a layer hardener capable of enhancing the layer strength.

It is allowed to contain a plasticizer or a dispersed matter of a water-insoluble or hardly soluble synthetic polymer (that is so-called a latex) in the silver halide emulsions.

The silver halide photographic light sensitive materials of the invention can be applied with a coupler. Further, the light sensitive materials of the invention can also be applied with a compound capable of releasing a photographically useful fragment such as a competing coupler having a color-compensating effect, a development accelerator provided upon coupling reaction with the oxidized product of a color developing agent, a bleach accelerator, a developing agent, a silver halide solvent, a color toner, a layer hardener, a foggant, an antifoggant, a chemical sensitizer, a spectral sensitizer and a desensitizer.

As for the yellow-dye forming couplers, a known acyl acetanilido type coupler may desirably be used. Among them, a benzoyl acetanilido type compound and a pivaloyl acetanilido type compound are advantageous.

As for the magenta-dye forming couplers, a 5-pyrazolone type coupler, a pyrazoloazole type coupler, a pyrazolobenzimidazole type coupler, an open-chained acyl acetonitrile type coupler and an indazole type coupler can be used.

As for the cyan-dye forming couplers, a phenol or naphthol type coupler is generally used. The above-mentioned coupler may be contained in a light sensitive material in the well-known techniques applicable to any ordinary couplers. It is also desirable to add the coupler into the silver halide emulsions of the invention by dissolving it in a high-boiling solvent and, if required, a low-boiling solvent together in combination and then by dispersing the resulting solution in the form of the finely particulate form. When this is the case, it is allowed, if required, to use a hydroquinone derivative, a UV absorbent and a color-fading inhibitor in combination.

To the silver halide photographic light sensitive materials of the invention, it is also allowed to provide auxiliary layers such as a filter layer, an antihalation layer and an anti-irradiation layer. In the above-mentioned layers and/or the emulsion layers, it is further allowed to contain a dye capable of flowing out of the light sensitive materials or being bleached in the course of carrying out a development process.

To the silver halide photographic light sensitive materials of the invention, it is further allowed to add a matting agent, a lubricant, an image stabilizer, a UV absorbent, a fluorescent whitening agent, a surfactant, a development acitivator, a development accelerator, a development retarder and a bleach accelerator.

In the silver halide photographic light sensitive materials of the invention, the photographic emulsion layers and other layers thereof can be provided onto the supports including, for example, those made of baryta paper or those laminated thereon with α-olefin polymer, a paper support readily peelable the α-olefin polymer therefrom, a flexible reflection type support such as those made of synthetic paper, those made of films comprising semisynthetic or synthetic macromolecules such as cellulose acetate, cellulose nitrate, polystyrene, polyvinyl chloride, polyethylene terephthalate, polycarbonate and polyamide, a reflection type support coated thereon with a white pigment, solid support made of glass, metal or earthenware, or a 120 to 160μm-thick thin reflection type support.

When a coupler is contained in the silver halide photographic light sensitive materials of the invention, a dye image can be obtained by exposing the light sensitive materials to light and then by carrying out a generally known color photographic process.

In the invention, it is allowed to treat with a processing solution having a bleaching function and another processing solution having a fixing function, immediately after completing a color development process. However, it is also allowed to treat with a processing solution having both of a bleaching function and a fixing function (that is so-called a bleach-fixing solution). As for the bleaching agents to be used for the bleaching treatment, a metal complex of an organic acid may be used.

After completing the fixing treatment, a washing treatment is generally carried out. As for the substitution for the washing treatment, a stabilizing treatment or both of the washing and stabilizing treatments may be carried out in combination.

EXAMPLES

The concrete examples of the invention will now be detailed. However, the embodiments of the invention shall not be limited thereto.

EXAMPLE 1

Multilayered color photographic light sensitive materials Nos. 1 through 20 were prepared by forming each of the layers having the following compositions on triacetyl cellulose film supports, respectively.

The amounts of the compositions added to the multilayered color photographic light sensitive materials are indicated by grams per sq,meter. The silver halides and colloidal silver used therein are indicated by converting them into silver used. And, the amount of the sensitizing dyes are indicated by the mol numbers per mol of silver used.

| Layer 1: An antihalation layer (HC) | |
|---|---|
| Black colloidal silver | 0.15 |
| UV absorbent (UV-1) | 0.20 |
| Colored cyan coupler (CC-1) | 0.02 |
| High boiling solvent (Oil-1) | 0.20 |
| High boiling solvent (Oil-2) | 0.20 |

-continued

| | |
|---|---|
| Gelatin | 1.6 |
| Layer 2: An interlayer (IL-1) | |
| Gelatin | 1.3 |
| Layer 3: A low-speed red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (DD-1) | 0.01 |
| High boiling solvent (Oil-1) | 0.55 |
| Gelatin | 1.0 |
| Layer 4: A high-speed red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (DD-1) | 0.02 |
| High boiling solvent (Oil-1) | 0.25 |
| Gelatin | 1.0 |
| Layer 5: An interlayer (IL-2) | |
| Gelatin | 0.8 |
| Layer 6: A low-speed green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (See Table 1) | 0.47 |
| Colored magenta coupler (CM-1) | 0.10 |
| DIR compound (See Table 1) | |
| High boiling solvent (See Table 1) | 0.70 |
| Gelatin | 1.0 |
| Layer 7: A high-speed green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (See Table 1) | 0.20 |
| Colored magenta coupler (CM-1) | 0.04 |
| DIR compound (See Table 1) | |
| High boiling solvent (See Table 1) | 0.35 |
| Gelatin | 1.0 |
| Layer 8: A yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Layer 9: A low-speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (DD-2) | 0.01 |
| High boiling solvent (Oil-2) | 0.18 |
| Gelatin | 1.3 |
| Layer 10: A high-speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| Layer 11: Protective layer 1 (PRO-1) | |
| Silver iodobromide emulsion (Em-5) | 0.3 |
| UV absorbent (UV-1) | 0.07 |
| UV absorbent (UV-2) | 0.1 |
| High boiling solvent (Oil-1) | 0.07 |

-continued

| | |
|---|---|
| High boiling solvent (Oil-3) | 0.07 |
| Gelatin | 0.8 |
| Layer 12: Protective layer 2 (PRO-2) | |
| Alkali-soluble matting agent (having average particle size of 2 μm) | 0.13 |
| Polymethyl methacrylate (having an average particle size of 3 μm) | 0.02 |
| Gelatin | 0.5 |

To each of the layers, coating aid SU-2, dispersing aid SU-1, layer hardener H-1 and dyes AI-1 and AI-2 were suitably added as well as the above-given compositions.

The emulsions used in the above-mentioned samples were as follows, and every one of these emulsions was an internally high iodine containing monodisperse type emulsion.

Em-1: An average silver iodide content=7.5 mol%; An average grain size=0.55 μm; and The grain configuration: Octahedron Em-2: An average silver iodide content=2.5 mol%; An average grain size=0.36 μm; and The grain configuration: Octahedron Em-3: An average silver iodide content=8.0 mol%; An average grain size=0.84 μm; and The grain configuration: Octahedron Em-4: An average silver iodide content=8.5 mol%; An average particle size=1.02 μm; and The grain configuration: Octahedron Em-5: An average silver iodide content=2.0 mol%; An average particle size=0.08 μm The grain configuration: Octahedron.

C-1

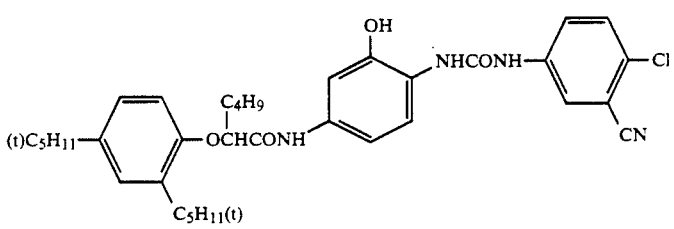

C-2

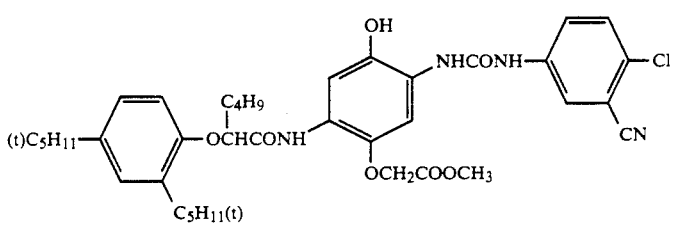

MM-1

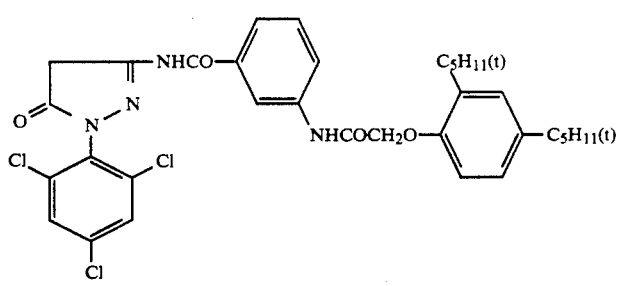

CM-1

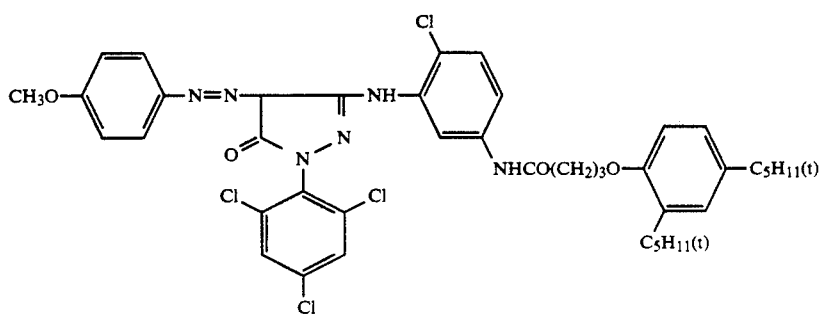

-continued
Y-1
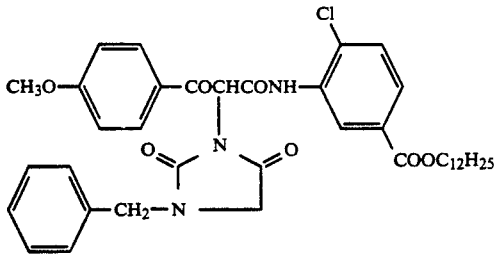
Y-2
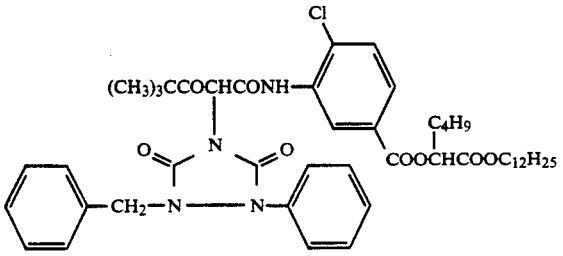
CC-1
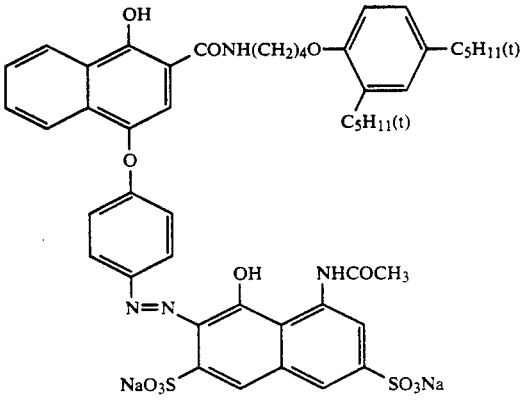
DD-1
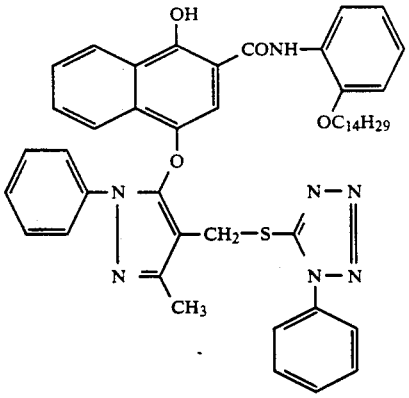
DD-2
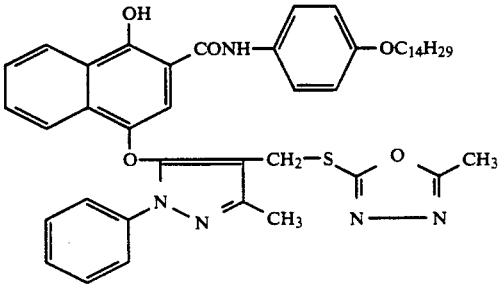

-continued
DD-3
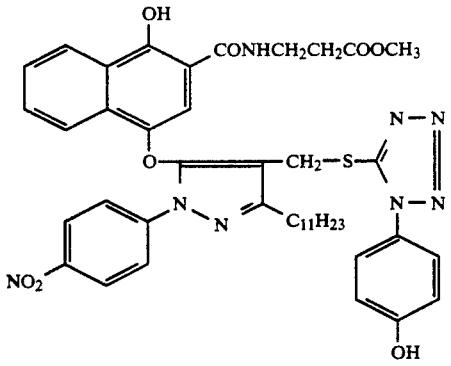
DD-4
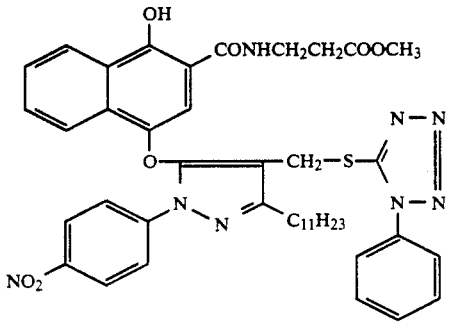
UV-1
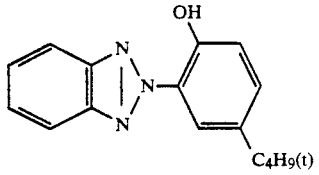
UV-2
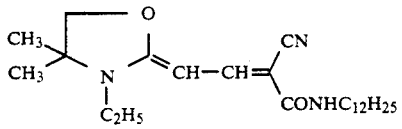
S-1
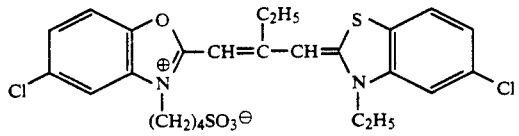
S-2
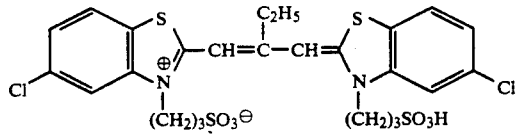
S-3
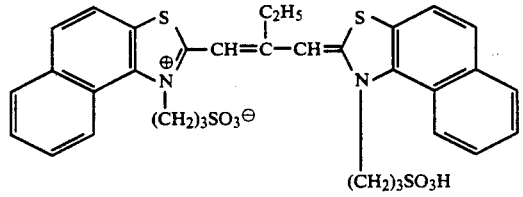
S-4
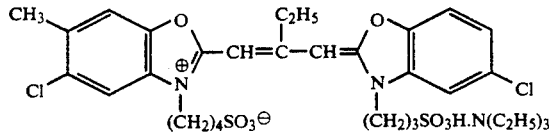

-continued
S-5
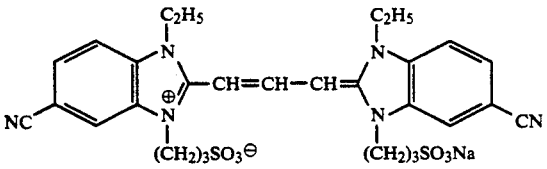
S-6
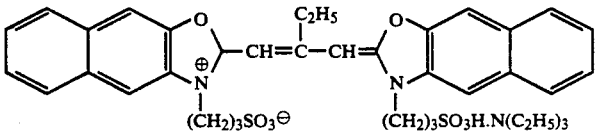
S-7
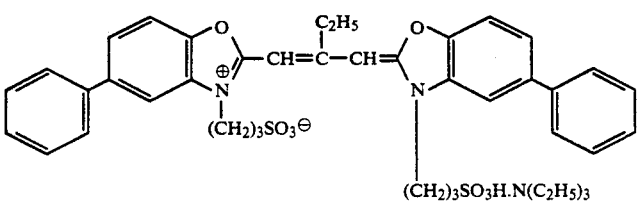
S-8
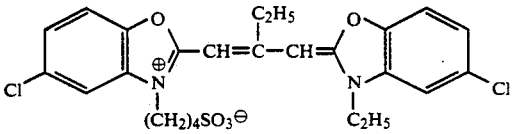
S-9
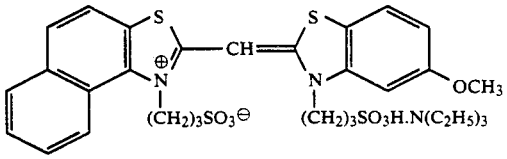
S-10
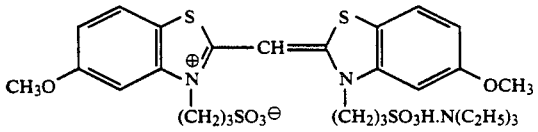
S-11
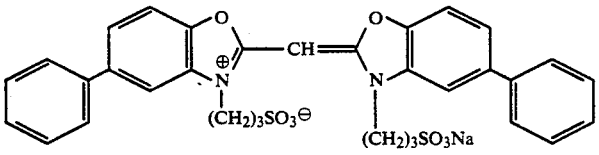
AI-1
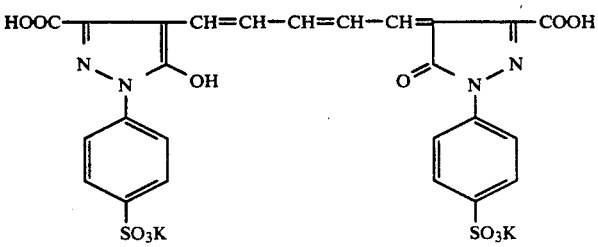

-continued

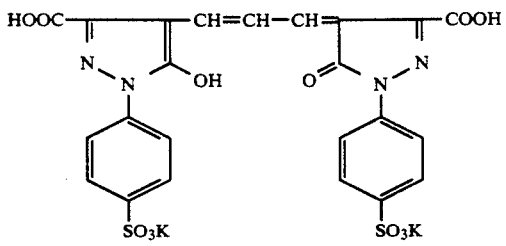

AI-2

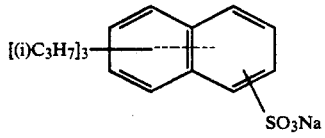

SU-1

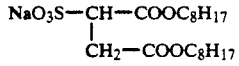

SU-2

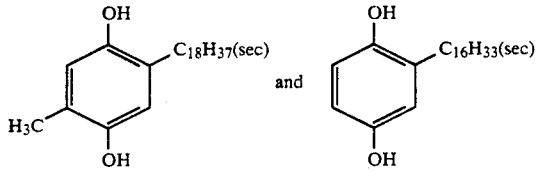

(mixture of 2:3)

SC-1

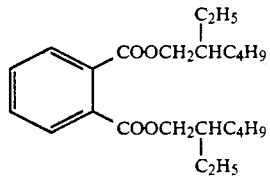

Oil-1

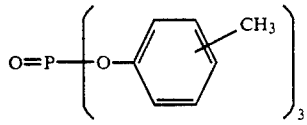

Oil-2

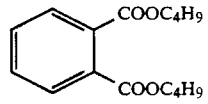

Oil-3

$CH_2=CHSO_2CH_2OCH_2SO_2CH=CH_2$

H-1

The resulting samples Nos. 1 through 20 were each exposed to white light through a sensitometric step-wedge and were then processed in the following processing steps A.

| Processing steps A | |
|---|---|
| Processing step (at 38° C.) | Processing time |
| Color developing | 3 min. 15 sec. |
| Bleaching | 6 min. 30 sec. |
| Washing | 3 min. 15 sec. |
| Fixing | 6 min. 30 sec. |
| Stabilizing | 3 min. 15 sec. |
| Drying | |

The compositions of the processing solutions used in the above-given processing steps were as follows.

| | |
|---|---|
| <Color developer> | |
| 4-amino-3-methyl-N-ethyl-N-(β-hydroxyethyl)aniline.sulfate | 4.75 g |
| Sodium sulfite, anhydrous | 4.25 g |
| Hydroxylamine.½ sulfate | 2.0 g |
| Potassium carbonate, anhydrous | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| Adjust pH to be | (pH = 10.05) |
| <Bleaching solution> | |
| Ammonium-iron (III) ethylenediamine-tetraacetate | 100.0 g |
| Diammonium ethylenediaminetetraacetate | 10.0 g |
| Ammonium bromide | 150.0 g |
| Glacial acetic acid | 10.0 ml |
| Add water to make | 1 liter |
| Adjust pH with acetic acid to be | pH = 6.0 |

-continued

| | |
|---|---|
| <Fixing solution> | |
| Ammoniuim thiosulfate | 175.0 g |
| Sodium sulfite, anhydrous | 8,5 g |
| Sodium metasulfite | 2.3 g |
| Add water to make | 1 liter |
| Adjust pH with acetic acid to be | pH = 6.0 |
| <Stabilizing solution> | |
| Water | 900 ml |
| Compound having the following Formula 37 | 2.0 g |
| Formula 37 | |

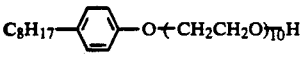

| | |
|---|---|
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia or a 50% sulfuric acid solution to be | pH = 8.5 |

The graininess of each processed samples were evaluated in terms of the RMS values thereof. The RMS values of the samples were obtained from the standard deviation of the density variations obtained when scanning 250 $\mu m^2$ of the 1.50 green-color density area through a Konica Microdensitometer Model PDA-5 Type A (manufactured by Konica Corp.) and the resulting RMS values were indicated by the relative RMS values to that of Sample No.1 regarded as a value of 100. Wherein, it is indicated that the smaller the relative values are, the more the image graininess is.

The transmission densities of the processed samples were each measured by a densitometer Model 310 manufactured by X-rite Co., through a Status-M filter, and the D-logE characteristic curves thereof were made out.

Next, the following density inclinations were obtained from the characteristic curves of the green-color measure densities (G) of the samples. Inclination ($\gamma_1$) to the density point on the side of the high-exposure area of $\Delta logE = 1.0$ from the point of density 1.0; and inclination ($\gamma_2$) to the density point on the side of the high-exposure area of $\Delta logE = 1.0$ from the point of density 2.0. Further, $\Delta\gamma$ values were obtained from the following formula in which it is indicated that the smaller a $\Delta\gamma$ value is, the wider a latitude is.

$$\Delta\gamma = \gamma_1 - \gamma_2$$

Further, the samples were each exposed to white light through a sensitometric step-wedge in the same manner as described above and were then processed in quite the same manner as in the foregoing processing steps A, except that the pH of the color developer of the processing steps A was changed into pH = 10.20 (hereinafter referred to as processing steps B). Inclinations ($\gamma_1'$) and ($\gamma_2'$) of the characteristic curves were each obtained in the same manner as described above and the differences $\Delta\gamma_1 - \Delta\gamma_2$ from processing steps A were obtained by the following formula in which it is indicated that the smaller a value of $\Delta\gamma_1 - \Delta\gamma_2$ is, the fewer a processing variation is.

$$\Delta\gamma_1 = \gamma_1' - \gamma_1$$

$$\Delta\gamma_2 = \gamma_2' - \gamma_2$$

The color reproducibilities of Samples No 1 through No. 20 were evaluated in the following method.

First, by making use of each of the samples and a camera (KONICA FT-1 MOTOR manufactured by Konica Corp.), a color-checker (manufactured by Macbeth Co.) was photographed, respectively. A color negative development (CNK-4 prepared by Konica Corp.) was successively carried out and the resulting negative images were printed in a size of 82 mm × 117 mm on Konica Color Paper Type QAA5 by making use of a Konica Color Printer CL-P2000 (manufactured by Konica Corp.), so that the practical prints could be obtained. The printing conditions applied thereto were specified for every sample so that the grey color on the color checker could be in grey on the resulting prints.

The color reproducibilities of the resulting practical prints were visually evaluated by 10 panelists.

Next, samples No. 1 through 20 were each exposed sinusoidal-wedgewise to white light for 1/100th seconds and were then developed in the foregoing processing steps A, so that the sharpness of the developed samples were obtained.

The sharpness were evaluated by the MTF (Modulation Transfer Function) of the resulting dye images and were indicated by the values relative to the MTF value obtained from 20 lines/mm (the value obtained from Sample No.1 was regarded as a value of 100.) The results thereof are collectively shown in Tables 1 and 2.

TABLE 1

| | | | DIR compound | | | | | |
|---|---|---|---|---|---|---|---|---|
| | | | Layer 6 | | Layer 7 | | | |
| | Magenta coupler | | | Amount | | Amount | Sharp- | Grain- |
| Sample No. | Layer 6 | Layer 7 | Kind | added | Kind | added | ness | iness |
| 1 (Comparison) | MM-1 | MM-1 | DD-4 | 0.02 | DD-4 | 0.02 | 100 | 100 |
| 2 (Comparison) | M-4 | M-4 | DD-4 | 0.03 | DD-4 | 0.03 | 102 | 104 |
| 3 (Comparison) | M-4 | M-4 | DD-3 | 0.03 | DD-3 | 0.02 | 101 | 103 |
| 4 (Comparison) | M-4 | M-4 | DD-2 | 0.02 | DD-2 | 0.02 | 103 | 105 |
| 5 (Invention) | M-4 | M-4 | D-1 | 0.12 | D-1 | 0.12 | 112 | 94 |
| 6 (Invention) | M-4 | M-4 | D-4 | 0.10 | D-4 | 0.10 | 110 | 94 |
| 7 (Invention) | M-4 | M-4 | D-6 | 0.15 | D-6 | 0.15 | 112 | 93 |
| 8 (Invention) | M-4 | M-4 | D-2 | 0.11 | D-2 | 0.11 | 112 | 92 |
| 9 (Invention) | M-4 | M-4 | D-18 | 0.12 | D-18 | 0.12 | 110 | 93 |
| 10 (Invention) | M-4 | M-4 | D-19 | 0.10 | D-19 | 0.10 | 113 | 90 |
| 11 (Invention) | M-4 | M-4 | D-25 | 0.15 | D-25 | 0.15 | 111 | 92 |
| 12 (Invention) | M-9 | M-9 | D-1 | 0.12 | D-1 | 0.12 | 112 | 90 |
| 13 (Invention) | M-9 | M-9 | D-4 | 0.10 | D-4 | 0.10 | 112 | 90 |
| 14 (Invention) | M-19 | M-19 | D-1 | 0.12 | D-1 | 0.12 | 111 | 91 |
| 15 (Invention) | M-19 | M-19 | D-25 | 0.15 | D-25 | 0.15 | 111 | 91 |

TABLE 1-continued

| Sample No. | Magenta coupler Layer 6 | Magenta coupler Layer 7 | DIR compound Layer 6 Kind | DIR compound Layer 6 Amount added | DIR compound Layer 7 Kind | DIR compound Layer 7 Amount added | Sharpness | Graininess |
|---|---|---|---|---|---|---|---|---|
| 16 (Invention) | M-65 | M-4 | D-1 | 0.12 | D-1 | 0.12 | 113 | 92 |
| 17 (Invention) | M-65 | M-4 | D-4 | 0.12 | D-1 | 0.12 | 110 | 91 |
| 18 (Invention) | M-65 | M-65 | D-6 | 0.15 | D-1 | 0.12 | 111 | 93 |
| 19 (Invention) | M-1 | M-4 | D-1 | 0.12 | D-1 | 0.12 | 112 | 93 |
| 20 (Invention) | M-1 | M-1 | D-1 | 0.12 | D-1 | 0.12 | 110 | 94 |

TABLE 2

| Sample No. | Latitude γ1 | Latitude γ2 | Latitude Δγ | Process variation γ1' | Process variation γ2' | Process variation Δγ1 | Process variation Δγ2 | Color reproducibility* |
|---|---|---|---|---|---|---|---|---|
| 1 (Comparison) | 0.72 | 0.66 | 0.06 | 0.73 | 0.68 | 0.01 | 0.02 | Δ |
| 2 (Comparison) | 0.73 | 0.59 | 0.14 | 0.80 | 0.67 | 0.07 | 0.08 | ○ |
| 3 (Comparison) | 0.72 | 0.59 | 0.13 | 0.79 | 0.68 | 0.07 | 0.09 | ○ |
| 4 (Comparison) | 0.75 | 0.60 | 0.15 | 0.83 | 0.69 | 0.08 | 0.09 | ○ |
| 5 (Invention) | 0.73 | 0.68 | 0.05 | 0.75 | 0.71 | 0.02 | 0.03 | ◎ |
| 6 (Invention) | 0.73 | 0.68 | 0.05 | 0.76 | 0.72 | 0.03 | 0.04 | ◎ |
| 7 (Invention) | 0.72 | 0.68 | 0.04 | 0.76 | 0.72 | 0.04 | 0.04 | ◎ |
| 8 (Invention) | 0.73 | 0.68 | 0.05 | 0.76 | 0.71 | 0.03 | 0.03 | ◎ |
| 9 (Invention) | 0.71 | 0.68 | 0.03 | 0.73 | 0.71 | 0.02 | 0.03 | ◎ |
| 10 (Invention) | 0.71 | 0.66 | 0.05 | 0.74 | 0.69 | 0.03 | 0.03 | ◎ |
| 11 (Invention) | 0.72 | 0.69 | 0.03 | 0.74 | 0.71 | 0.02 | 0.02 | ◎ |
| 12 (Invention) | 0.71 | 0.68 | 0.03 | 0.74 | 0.71 | 0.03 | 0.03 | ◎ |
| 13 (Invention) | 0.73 | 0.69 | 0.04 | 0.76 | 0.73 | 0.03 | 0.04 | ◎ |
| 14 (Invention) | 0.74 | 0.70 | 0.04 | 0.76 | 0.74 | 0.02 | 0.04 | ◎ |
| 15 (Invention) | 0.75 | 0.71 | 0.04 | 0.77 | 0.74 | 0.02 | 0.03 | ◎ |
| 16 (Invention) | 0.75 | 0.70 | 0.05 | 0.78 | 0.73 | 0.03 | 0.03 | ◎ |
| 17 (Invention) | 0.71 | 0.68 | 0.03 | 0.73 | 0.71 | 0.02 | 0.03 | ◎ |
| 18 (Invention) | 0.71 | 0.67 | 0.04 | 0.74 | 0.70 | 0.03 | 0.03 | ◎ |
| 19 (Invention) | 0.73 | 0.68 | 0.05 | 0.75 | 0.72 | 0.02 | 0.04 | ◎ |
| 20 (Invention) | 0.72 | 0.67 | 0.05 | 0.75 | 0.70 | 0.03 | 0.03 | ◎ |

*Color reproducibility:
◎: Excellent, ○: Good, Δ: Slightly inferior

As is obvious from Tables 1 and 2, Sample No. 1 used therein a 5-pyrazolone magenta coupler which is other than the invention is deteriorated in color reproducibility and can hardly be said to be satisfactory in both sharpness and graininess, though it is excellent in both latitude and process variations. On the other hand, Samples No.2 through No.4 used therein the magenta couplers of the invention and the conventionally known various DIR couplers are each proved to be seriously deteriorated in both latitude and process variations, though they improved in color reproducibilities. In contrast to the above, Samples No.5 through No.20 used therein the magenta couplers of the invention and the DIR couplers of the invention were each proved to be remarkably excellent in color reproducibilities and greatly improved in all the requirements such as latitude, sharpness, graininess and process variations.

EXAMPLE 2

A concrete example of the invention will be detailed below. However, the embodiments of the invention shall not be limited thereto.

Multilayered color photographic light sensitive material samples No.21 through No.39 were each prepared by forming each of the layers having the following compositions on a triacetyl cellulose film support in order from the support side.

The amounts of the materials added into the multilayered color photographic light sensitive materials are indicated in terms of grams per sq.meter, unless otherwise expressly stated. The silver halides and colloidal silver are indicated upon concerting them into the silver contents thereof. The sensitizing dyes are indicated by mol numbers per mol of the silver used.

| | |
|---|---|
| Layer 1: An antihalation layer (HC) | |
| Black colloidal silver | 0.15 |
| UV absorbent (UV-1) | 0.20 |
| Colored cyan coupler (CC-1) | 0.02 |
| High boiling solvent (Oil-1) | 0.20 |
| High boiling solvent (Oil-2) | 0.20 |
| Gelatin | 1.6 |
| Layer 2: An interlayer (IL-1) | |
| Gelatin | 1.3 |
| Layer 3: A low-speed red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (DD-1) | 0.01 |
| High boiling solvent (Oil-1) | 0.55 |
| Gelatin | 1.0 |
| Layer 4: A high-speed red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (DD-1) | 0.02 |
| High boiling solvent (Oil-1) | 0.25 |
| Gelatin | 1.0 |
| Layer 5: An interlayer (IL-2) | |
| Gelatin | 0.8 |
| Layer 6: A low-speed green-sensitive emulsion | |

-continued

| layer (GL) | |
|---|---|
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (See Table 3) | 0.47 |
| Colored magenta coupler (See Table 3) | 0.10 |
| DIR compound (See Table 3) | |
| High boiling solvent (Oil-2) | 0.70 |
| Gelatin | 1.0 |
| Layer 7: A high-speed green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (See Table 3) | 0.20 |
| Colored magenta coupler (CM-1) | 0.04 |
| DIR compound (See Table 3) | |
| High boiling solvent (Oil-2) | 0.35 |
| Gelatin | 1.0 |
| Layer 8: A yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Layer 9: A low-speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (D-2) | 0.01 |
| High boiling solvent (Oil-2) | 0.18 |
| Gelatin | 1.3 |
| Layer 10: A high-speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |

-continued

| | |
|---|---|
| High boiling solvent (Oil-2) | 0.05 |
| Gelatin | 1.0 |
| Layer 11: Protective layer 1 (PRO-1) | |
| Formalin scavenger (HS-1) | 0.5 |
| Silver iodobromide emulsion (Em-5) | 0.3 |
| UV absorbent (UV-1) | 0.07 |
| UV absorbent (UV-2) | 0.1 |
| High boiling solvent (Oil-1) | 0.07 |
| High boiling solvent (Oil-3) | 0.07 |
| Gelatin | 0.8 |
| Layer 12: Protective layer 2 (PRO-2) | |
| Alkali-soluble matting agent (having average particle size of 2 μm) | 0.13 |
| Polymethyl methacrylate (having an average particle size of 2 μm) | 0.02 |
| Gelatin | 0.5 |

To each of the layers, coating aid SU-2, dispersing aid SU-1, layer-hardener H-1 and dyes AI-1 and AI-2 were each suitably added, besides the above-given compositions.

The emulsions applied to the foregoing samples were as follows. All the emulsions were monodispersive internally high iodine-containing type emulsions.

Em-1: Average silver iodide content=7.5 mol%, Average grain size=0.55 μm; and Grain configuration=octahedron Em-2: Average silver iodide content=2.5 mol%; Average grain size=0.36 μm; and Grain configuration=octahedron Em-3: Average silver iodide content=8.0 mol%; Average grain size=0.84 μm; and Grain configuration=octahedron Em-4: Average silver iodide content=8.5 mol%; Average grain size=1.02 μm; and Grain configuration=octahedron Em-5: Average silver iodide content=2.0 mol%; Average grain size=0.08 μm Grain configuration=octahedron.

C-1

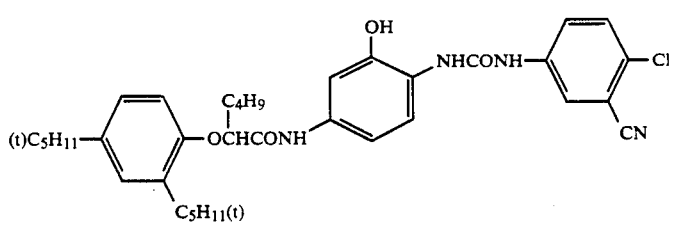

C-2

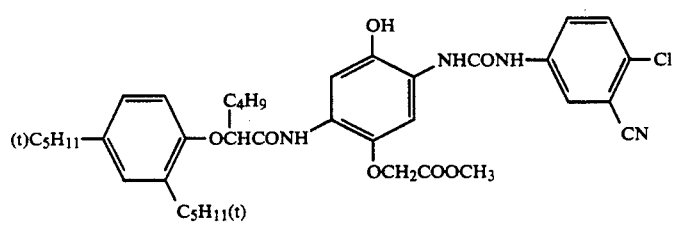

Y-1

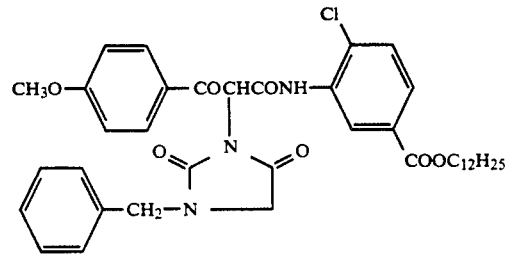

-continued
Y-2
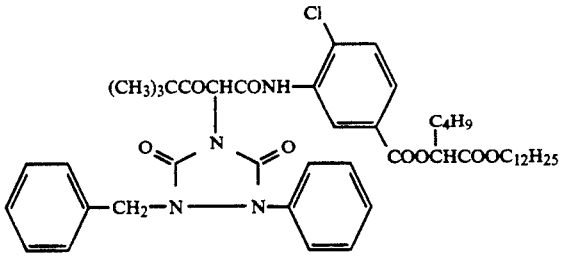
CC-1
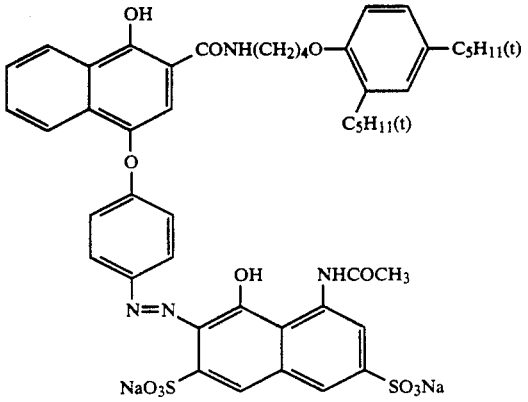
D-1
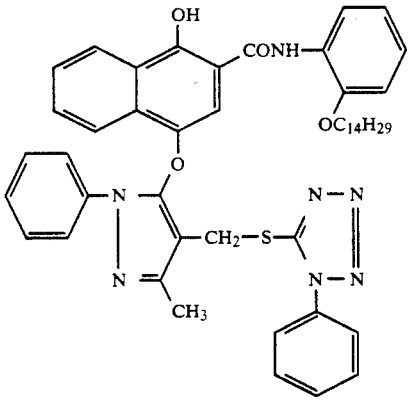
D-2
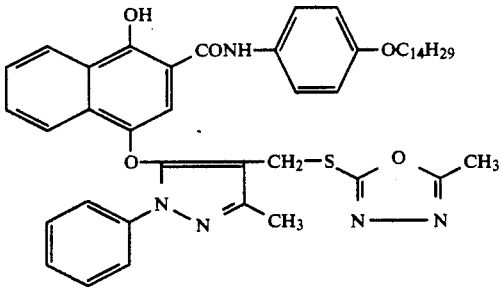
UV-1
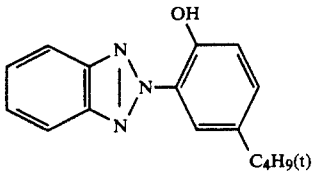

-continued
UV-2
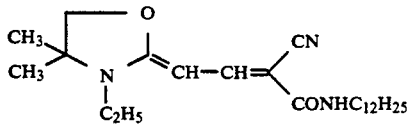
S-1
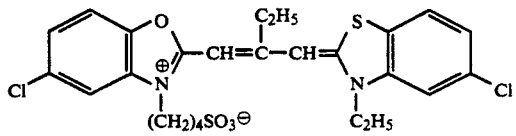
S-2
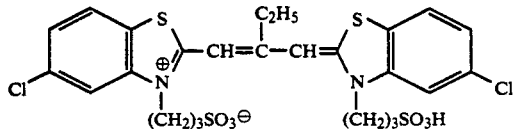
S-3
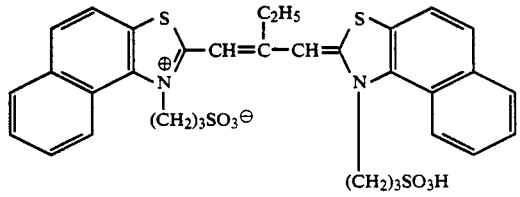
S-4
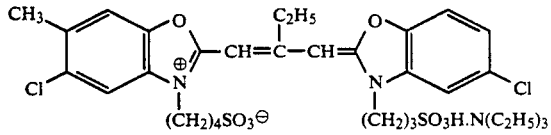
S-5
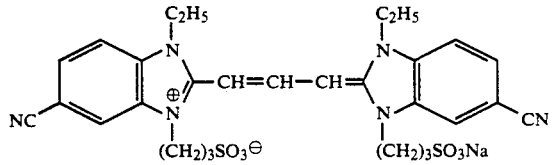
S-6
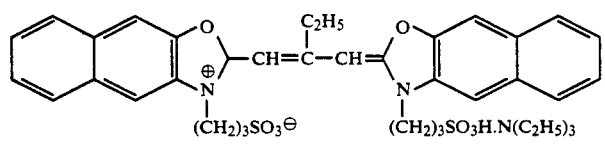
S-7
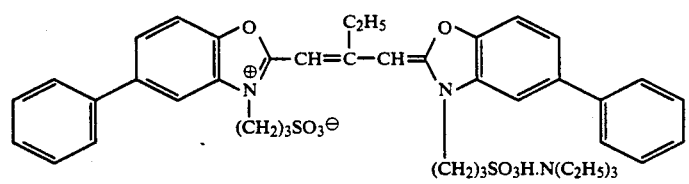
S-8
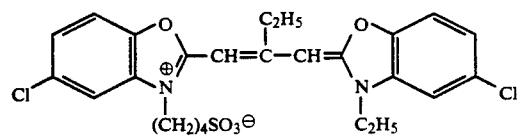
S-9
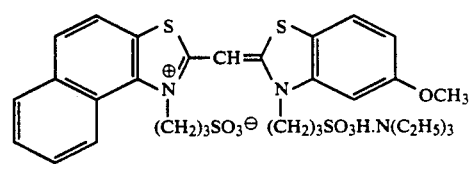

-continued
S-10
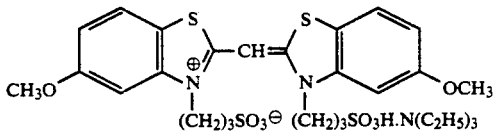
S-11
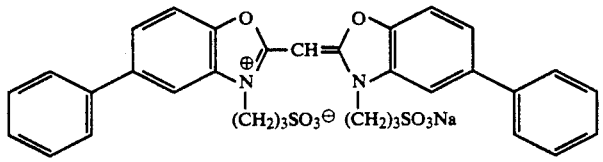
AI-1
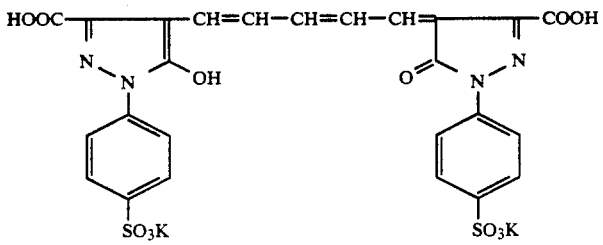
AI-2
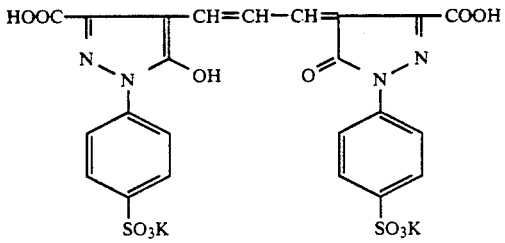
SU-1
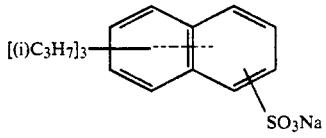
SU-2
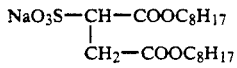
SC-1
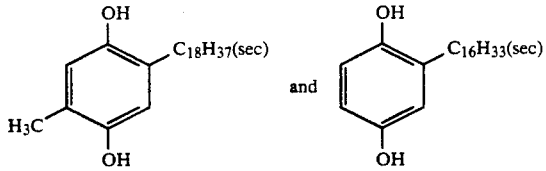
(mixture of 2:3)
Oil-1
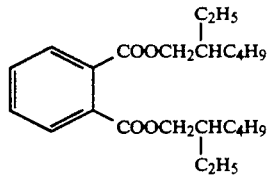
Oil-2
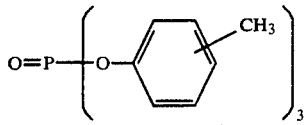

-continued

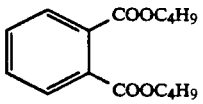

Oil-3

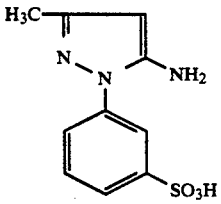

HS-1

$CH_2{=}CHSO_2CH_2OCH_2SO_2CH{=}CH_2$

H-1

By making use of the resulting samples No. 21 through No.39 and a camera (Konica FT-1 MOTOR manufactured by Konica Corp.), a color checker manufactured by Macbeth Co. was photographed and developed in the following processing steps, respectively.

| Process A | |
|---|---|
| Processing step (at 38° C.) | Processing time |
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

In each of the above-given processing steps, the compositions of the processing solutions were as follows.

| | |
|---|---|
| <Color developing solution> | |
| 4-amino-3-methyl-N-ethyl-N-(β-hydroxyethyl) aniline.sulfate | 4.75 g |
| Sodium sulfate, anhydrous | 4.25 g |
| Hydroxylamine.½sulfate | 2.0 g |
| Potassium carbonate anhydrous | 37.5 g |
| Sodium bromide | 1.3 g |
| Trisodium.nitrilotriacetate, (monohydrate) | 2.5 g |
| Potassium hydroxide | 1.0 g |
| Add water to make | 1 liter |
| Adjust pH to be | (pH = 10.05) |
| <Bleaching solution> | |
| Iron (III) ammonium ethylenediamine tetraacetate | 100.0 g |
| Diammonium ethylenediaminetetraacetate | 10.0 g |
| Ammonium bromide | 150.0 g |

-continued

| | |
|---|---|
| Glacial acetic acid | 10.0 ml |
| Add water to make | 1 liter |
| Adjust pH with aqueous ammonia to be | pH = 6.0 |
| <Fixing solution> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH = 6.0 |
| <Stabilizing solution> | |
| Water | 900 ml |
| 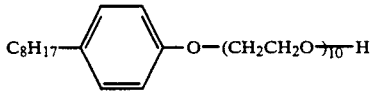 | 2.0 g |
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia or a 50% sulfuric acid solution to be | pH = 8.5 |

Printed samples No. 1A through 19A were prepared in such a manner that the resulting samples were printed by printer A so that the grey portions in a color checker could be in grey having a reflectance of 18%.

Next, printed samples 1B through 19B were prepared under the same conditions as in the case of printer A by making use of printer B having a green region detector different from that of printer A, and the interprinter variations between the two different kinds of the printers were visually judged.

CM-A

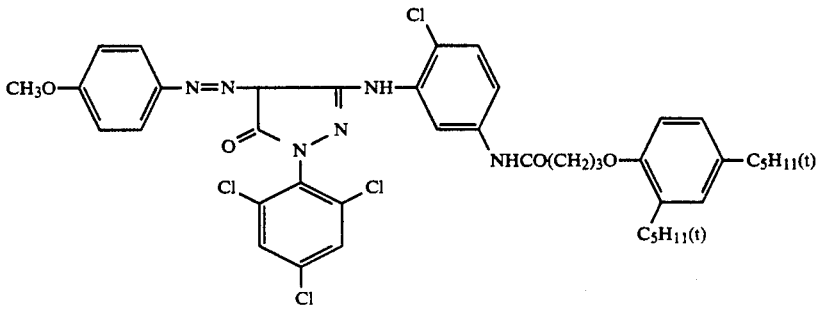

-continued

DD-1

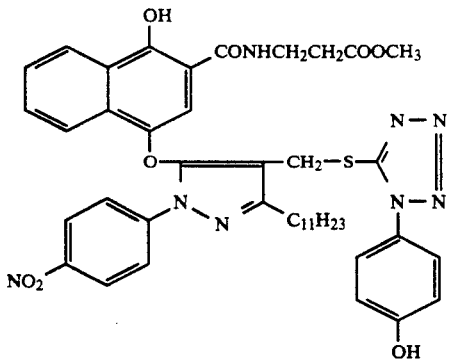

The resulting samples 1 through 19 were exposed to white light through a sensitometric step-wedge and were then processed in the foregoing process A.

On each of the processed samples, the transmission densities were measured by a densitometer Model 310 manufactured by X-rite Co. through a status M filter and the D-logE characteristic curves thereof were made out.

Next, on each of the characteristic curves of the measured green densities (G) of each sample, both inclination ($\gamma_1$) to the density point on the $\Delta\log E-1.0$ higher exposed area from the density point of 1.0 and inclination ($\gamma_2$) to the density point on the $\Delta\log E=1.0$ higher exposed area from the density point of 2.0 were each obtained and then $\Delta\gamma$ values were obtained from the following formula. Wherein, it is indicated that the smaller a value of $\Delta\gamma$ is, the wider a latitude is.

$$\Delta\gamma=\gamma_1-\gamma_2$$

Further, Each of the samples was exposed to white light through a sensitometric step-wedge in the same manner as above, they were processed in quite the same manner as in the foregoing process A, except that the pH of the color developer used in Process A was changed into 10.20; (hereinafter referred to as Process B). Both inclinations ($\gamma_1'$) and ($\gamma_2'$) of the characteristic curves were obtained as described above and the differences $\Delta\gamma_1$ and $\Delta\gamma_2$ between processes A and B. Wherein, it is indicated that the smaller the values of $\Delta\gamma_1$ and $\Delta\gamma_2$ are, the fewer the variations are.

$$\Delta\gamma_1=\gamma_1'-\gamma_1$$

$$\Delta\gamma_2=\gamma_2'-\gamma_2$$

The results thereof are shown collectively in Table 4.

TABLE 3

| | Magenta coupler | | DIR compound | | | | Colored magenta coupler | |
|---|---|---|---|---|---|---|---|---|
| | | | Layer 6 | | Layer 7 | | | |
| Sample No. | Layer 6 | Layer 7 | Kind | Amount added | Kind | Amount added | Layer 6 | Layer 7 |
| 21 (Comparison) | M-4 | M-4 | D-1 | 0.12 | D-1 | 0.12 | CM-A | CM-A |
| 22 (Comparison) | M-4 | M-4 | DD-1 | 0.03 | DD-1 | 0.03 | CM-29 | CM-29 |
| 23 (Invention) | M-4 | M-4 | D-1 | 0.12 | D-1 | 0.12 | CM-29 | CM-29 |
| 24 (Invention) | M-4 | M-4 | D-4 | 0.10 | D-4 | 0.10 | CM-29 | CM-29 |
| 25 (Invention) | M-4 | M-4 | D-6 | 0.15 | D-6 | 0.15 | CM-29 | CM-29 |
| 26 (Invention) | M-4 | M-4 | D-2 | 0.11 | D-2 | 0.11 | CM-29 | CM-29 |
| 27 (Invention) | M-4 | M-4 | D-18 | 0.12 | D-18 | 0.12 | CM-29 | CM-29 |
| 28 (Invention) | M-4 | M-4 | D-19 | 0.10 | D-19 | 0.10 | CM-29 | CM-29 |
| 29 (Invention) | M-4 | M-4 | D-25 | 0.15 | D-25 | 0.15 | CM-29 | CM-29 |
| 30 (Invention) | M-4 | M-4 | D-1 | 0.12 | D-1 | 0.12 | CM-1 | CM-1 |
| 31 (Invention) | M-4 | M-4 | D-1 | 0.12 | D-1 | 0.12 | CM-15 | CM-15 |
| 32 (Invention) | M-4 | M-4 | D-1 | 0.12 | D-1 | 0.12 | CM-31 | CM-31 |
| 33 (Invention) | M-4 | M-4 | D-1 | 0.12 | D-1 | 0.12 | CM-35 | CM-35 |
| 34 (Invention) | M-4 | M-4 | D-18 | 0.12 | D-18 | 0.12 | CM-36 | CM-36 |
| 35 (Invention) | M-9 | M-9 | D-1 | 0.12 | D-1 | 0.12 | CM-29 | CM-29 |
| 36 (Invention) | M-9 | M-9 | D-4 | 0.10 | D-4 | 0.10 | CM-31 | CM-31 |
| 37 (Invention) | M-19 | M-19 | D-1 | 0.12 | D-1 | 0.12 | CM-29 | CM-29 |
| 38 (Invention) | M-19 | M-19 | D-6 | 0.15 | D-1 | 0.12 | CM-29 | CM-29 |
| 39 (Invention) | M-65 | M-65 | D-1 | 0.12 | D-1 | 0.12 | CM-29 | CM-29 |

TABLE 4

| | Latitude | | | Process variation | | | | Interprinter |
|---|---|---|---|---|---|---|---|---|
| Sample No. | $\gamma 1$ | $\gamma 2$ | $\Delta\gamma$ | $\gamma 1'$ | $\gamma 2'$ | $\Delta\gamma 1$ | $\Delta\gamma 2$ | variation |
| 21 (Comparison) | 0.73 | 0.68 | 0.05 | 0.75 | 0.71 | 0.02 | 0.03 | Δ |
| 22 (Comparison) | 0.73 | 0.58 | 0.15 | 0.81 | 0.67 | 0.08 | 0.09 | ○ |
| 23 (Invention) | 0.74 | 0.70 | 0.04 | 0.76 | 0.73 | 0.02 | 0.03 | ◎ |
| 24 (Invention) | 0.72 | 0.70 | 0.02 | 0.75 | 0.73 | 0.03 | 0.03 | ◎ |
| 25 (Invention) | 0.74 | 0.70 | 0.04 | 0.76 | 0.73 | 0.02 | 0.03 | ◎ |
| 26 (Invention) | 0.73 | 0.70 | 0.03 | 0.76 | 0.73 | 0.03 | 0.03 | ◎ |

TABLE 4-continued

| Sample No. | Latitude γ1 | Latitude γ2 | Latitude Δγ | Process variation γ1' | Process variation γ2' | Process variation Δγ1 | Process variation Δγ2 | Interprinter variation |
|---|---|---|---|---|---|---|---|---|
| 27 (Invention) | 0.74 | 0.70 | 0.04 | 0.77 | 0.73 | 0.03 | 0.03 | ◎ |
| 28 (Invention) | 0.74 | 0.72 | 0.02 | 0.76 | 0.74 | 0.02 | 0.02 | ◎ |
| 29 (Invention) | 0.73 | 0.69 | 0.04 | 0.76 | 0.72 | 0.03 | 0.03 | ◎ |
| 30 (Invention) | 0.72 | 0.69 | 0.03 | 0.74 | 0.72 | 0.02 | 0.03 | ◎ |
| 31 (Invention) | 0.74 | 0.71 | 0.03 | 0.76 | 0.75 | 0.02 | 0.04 | ◎ |
| 32 (Invention) | 0.73 | 0.70 | 0.03 | 0.76 | 0.74 | 0.03 | 0.04 | ◎ |
| 33 (Invention) | 0.72 | 0.70 | 0.02 | 0.74 | 0.72 | 0.02 | 0.02 | ◎ |
| 34 (Invention) | 0.74 | 0.71 | 0.03 | 0.77 | 0.74 | 0.03 | 0.03 | ◎ |
| 35 (Invention) | 0.72 | 0.69 | 0.03 | 0.74 | 0.72 | 0.02 | 0.03 | ◎ |
| 36 (Invention) | 0.74 | 0.72 | 0.02 | 0.75 | 0.76 | 0.03 | 0.04 | ◎ |
| 37 (Invention) | 0.72 | 0.69 | 0.03 | 0.74 | 0.73 | 0.02 | 0.04 | ◎ |
| 38 (Invention) | 0.71 | 0.69 | 0.02 | 0.74 | 0.73 | 0.03 | 0.04 | ◎ |
| 39 (Invention) | 0.71 | 0.69 | 0.02 | 0.73 | 0.72 | 0.02 | 0.03 | ◎ |

Interprinter variations:
◎: Variation was found extremely small;
○: Variation was found small; and
Δ: Variation was found slight large.

As are obvious from Tables 3 and 4, Sample No.21, which used therein the magenta coupler of the invention, the DIR coupler of the invention and the colored magenta coupler of the invention, has a problem of interprinter variations, though it is excellent in latitude and process variations. On the other hand, Sample No.22, which used therein the magenta coupler of the invention, the colored magenta coupler of the invention and the DIR coupler other than those of the invention, is seriously deteriorated in process variations, though the interprinter variation improvements can be observed. In contrast to the above, Samples No.23 through No.39, which used therein the magenta couplers of the invention, the colored magenta couplers of the invention and the DIR couplers of the invention, are each excellent in latitude and interprinter variation and, further, more excellent in process variations.

EXAMPLE 3

A concrete example of the invention will be detailed below, bit the embodiments of the invention shall not be limited thereto.

On a triacetyl cellulose film support, each of the layers having the following compositions was formed in order from the support side, so that multilayered color photographic light sensitive materials No.40 through No.62 could be prepared.

The amounts of the materials added in the multilayered color photographic light sensitive materials are indicated by grams per sq.meter of the light sensitive material used, unless otherwise expressly stated. The silver halides and colloidal silver used therein are indicated by converting them into the silver contents. The sensitizing dyes are indicated by mol numbers per mol of the silver used.

| | |
|---|---|
| Layer 1: An antihalation layer (HC) | |
| Black colloidal silver | 0.15 |
| UV absorbent (UV-1) | 0.20 |
| Colored cyan coupler (CC-1) | 0.02 |
| High boiling solvent (Oil-1) | 0.20 |
| High boiling solvent (Oil-2) | 0.20 |
| Gelatin | 1.6 |
| Layer 2: An interlayer (IL-1) | |
| Gelatin | 1.3 |
| Layer 3: A low-speed red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |

-continued

| | |
|---|---|
| Sensitizing dye (S-2) | $3.2 \times 10^{-4}$ |
| Sensitizing dye (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| DIR compound (DD-1) | 0.01 |
| High boiling solvent (Oil-1) | 0.55 |
| Gelatin | 1.0 |
| Layer 4: A high-speed red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-2) | 0.23 |
| Colored cyan coupler (CC-1) | 0.03 |
| DIR compound (DD-1) | 0.02 |
| High boiling solvent (Oil-1) | 0.25 |
| Gelatin | 1.0 |
| Layer 5: An interlayer (IL-2) | |
| Gelatin | 0.8 |
| Layer 6: A low-speed green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (See Table 5) | 0.47 |
| Cyan coupler (C-2) | 0.13 |
| Colored magenta coupler (CM-1) | 0.10 |
| DIR compound (See Table 5) | |
| High boiling solvent (See Table 5) | 0.70 |
| Gelatin | 1.0 |
| Layer 7: A high-speed green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (See Table 5) | 0.20 |
| Colored magenta coupler (CM-1) | 0.04 |
| DIR compound (See Table 5) | |
| High boiling solvent (See Table 5) | 0.35 |
| Gelatin | 1.0 |
| Layer 8: A yellow filter layer (YC) | |
| Yellow colloidal silver | 0.1 |
| Additive (SC-1) | 0.12 |
| High boiling solvent (Oil-2) | 0.15 |
| Gelatin | 1.0 |
| Layer 9: A low-speed blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-1) | 0.60 |
| Yellow coupler (Y-2) | 0.32 |
| DIR compound (DD-2) | 0.01 |

-continued

| | |
|---|---|
| High boiling solvent (Oil-2) | 0.18 |
| Gelatin | 1.3 |
| Layer 10: A high-speed blue-sensitive emulsion layer (BH) | |
| Silver iodobromide emulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-1) | 0.18 |
| Yellow coupler (Y-2) | 0.10 |
| High boiling solvent (Oil-2) | 0.05 |
| Gelatin | 1.0 |
| Layer 11: Protective layer 1 (PRO-1) | |
| Silver iodobromide emulsion (Em-5) | 0.3 |
| UV absorbent (UV-1) | 0.07 |
| UV absorbent (UV-2) | 0.1 |
| High boiling solvent (Oil-1) | 0.07 |
| High boiling solvent (Oil-3) | 0.07 |
| Gelatin | 0.8 |
| Layer 12: Protective layer 2 (PRO-2) | |
| Alkali-soluble matting agent (having average particle size of 2 μm) | 0.13 |
| Polymethyl methacrylate (having an average particle size of 3 μm) | 0.02 |
| Gelatin | 0.5 |

To each of the layers, coating aid SU-2, dispersing aid SU-1, layer hardener H-1 and dyes AI-1 and AI-2 were also suitably added, besides the above-given compositions.

The emulsions used in the above-mentioned samples were as follows. Every emulsion was monodispersive internally high-iodine containing type emulsion.

Em-1: Average silver iodide content=7.5 mol%, Average grain size=0.55 μm, and Grain configuration=Octahedron;

Em-2: Average silver iodide content=2.5 mol%, Average grain size=0.36 μm, and Grain configuration=Octahedron;

Em-3: Average silver iodide content=8.0 mol%, Average grain size=0.84 μm, and Grain configuration=Octahedron;

Em-4: Average silver iodide content=8.5 mol%, Average grain size=1.02 μm, and Grain configuration=Octahedron; and Em-5: Average silver iodide content=2.0 mol%, Average grain size=0.08 μm, and Grain configuration=Octahedron.

C-1

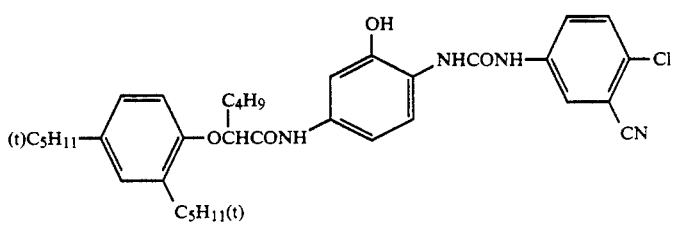

C-2

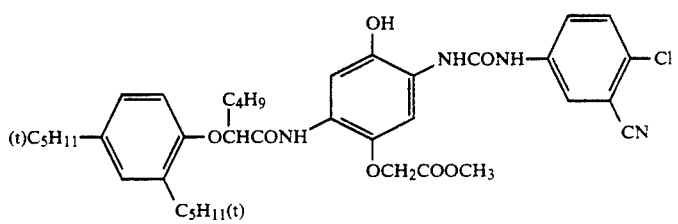

MM-1

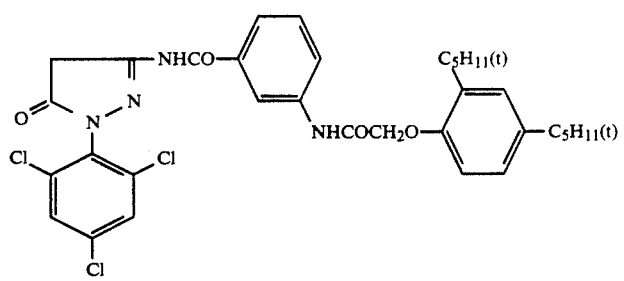

CM-1

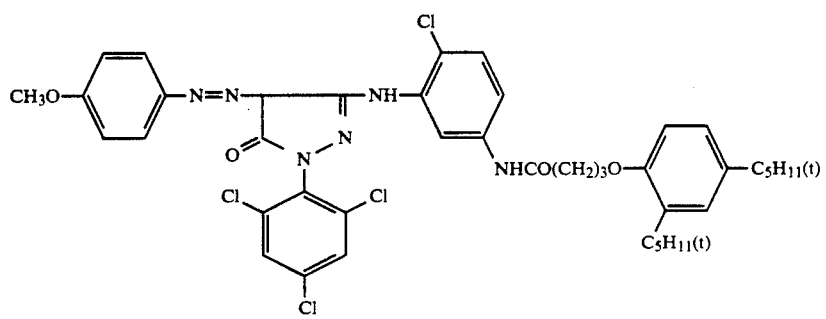

-continued
Y-1
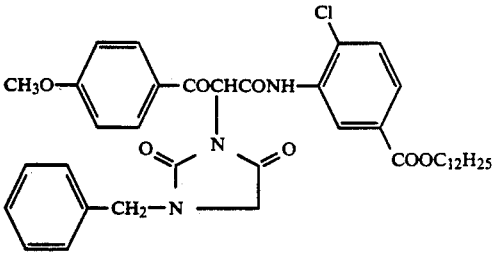
Y-2
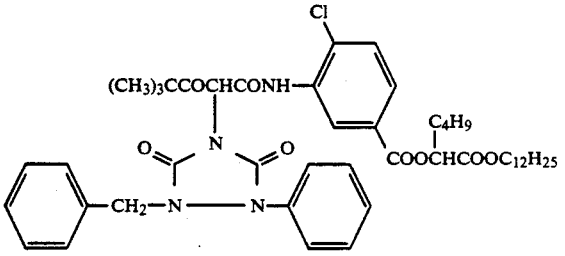
CC-1
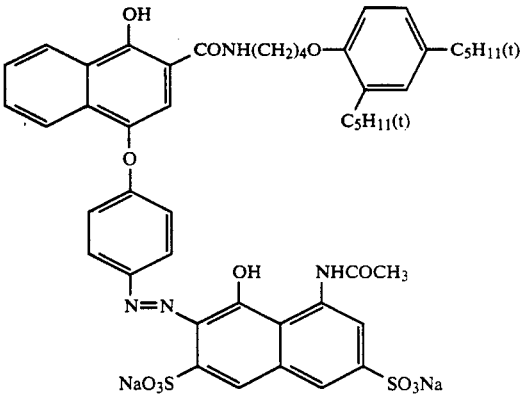
DD-1
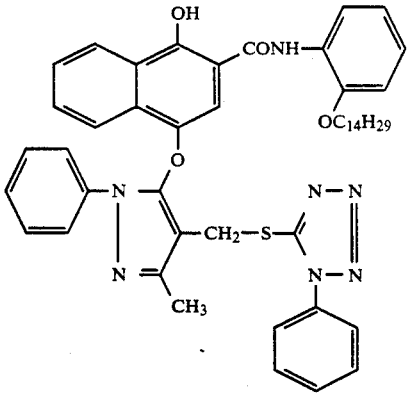
DD-2
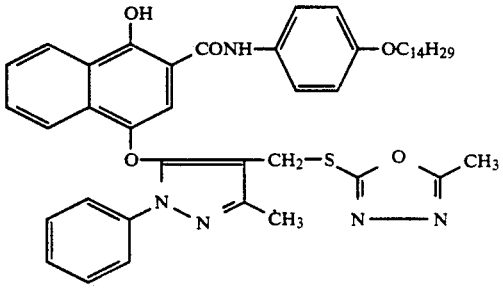

-continued
DD-4
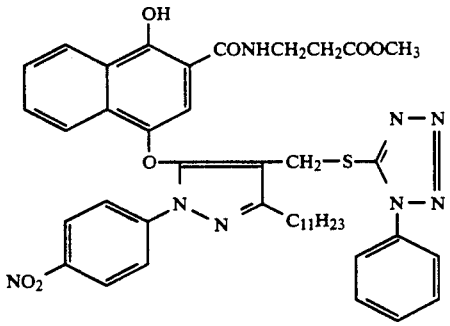
UV-1
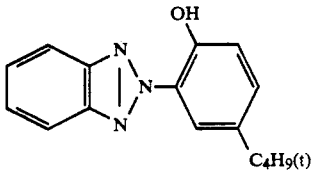
UV-2
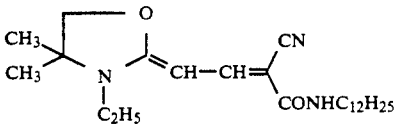
S-1
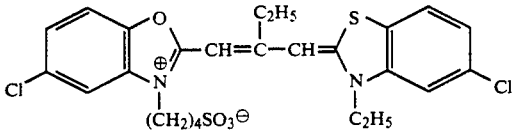
S-2
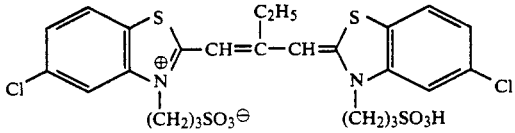
S-3
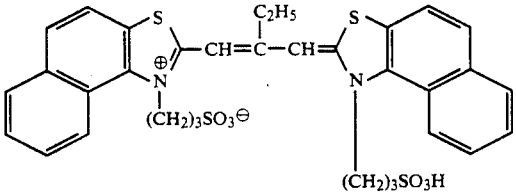
S-4
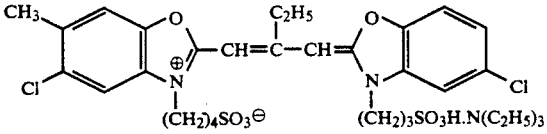
S-5
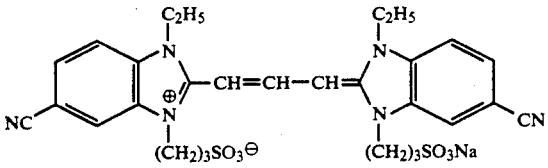
S-6
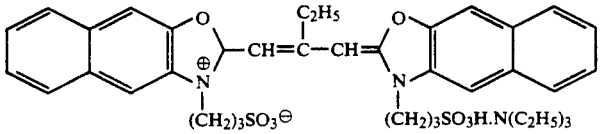

-continued
S-7
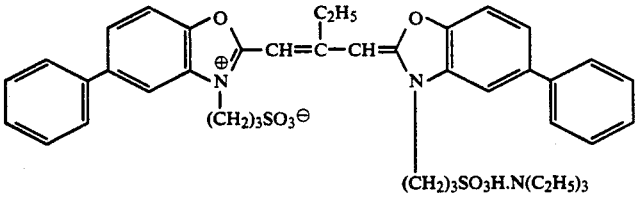
S-8
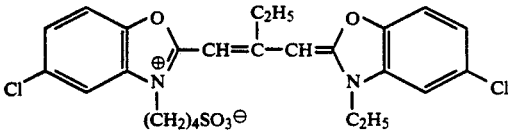
S-9
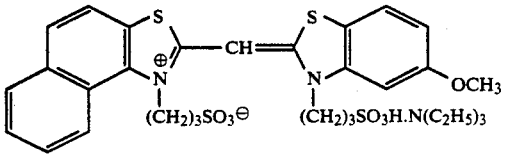
S-10
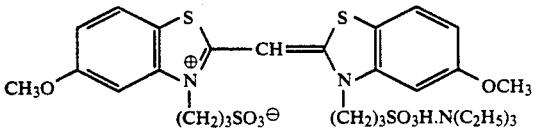
S-11
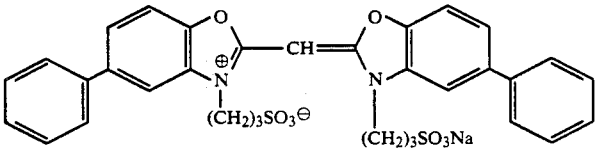
AI-1
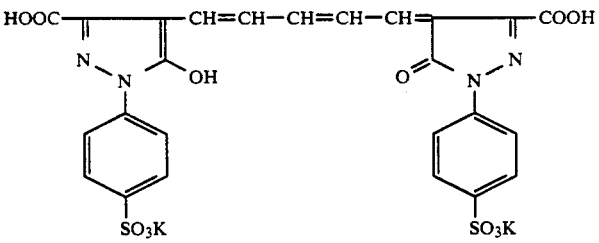
AI-2
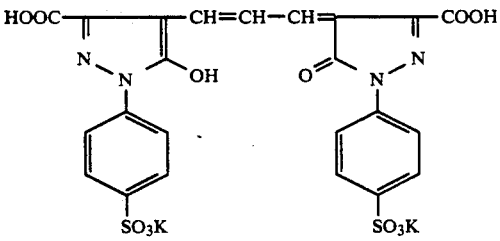
SU-1
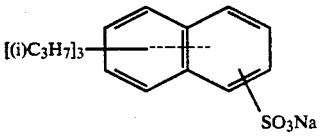
SU-2
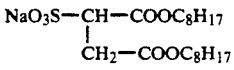

-continued

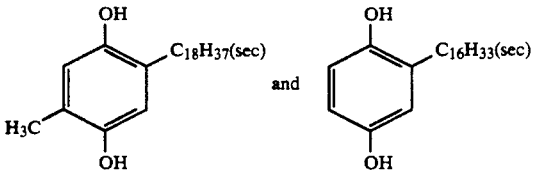

(mixture of 2:3)

SC-1

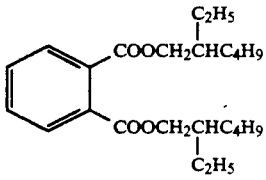

Oil-1

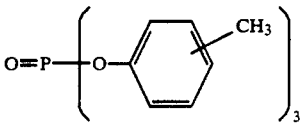

Oil-2

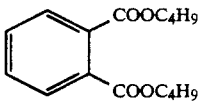

Oil-3

$CH_2{=}CHSO_2CH_2OCH_2SO_2CH{=}CH_2$

H-1

The resulting samples No.41 through No.63 were each exposed to white light through a sensitometric step-wedge and were then processed in the following processing steps A.

| Processing steps A | |
|---|---|
| Processing step (at 38° C.) | Processing time |
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

In each of the processing steps, the compositions of the processing solutions used were as follows.

| | |
|---|---|
| <Color developing solution> | |
| 4-amino-3-methyl-N-ethyl-N-(β-hydroxyethyl)aniline.sulfate | 4.75 g |
| Sodium sulfite, anhydrous | 4.25 g |
| Hydroxylamine.½ sulfate | 2.0 g |
| Potassium carbonate, anhydrous | 37.5 g |
| Sodium bromide | 1.3 g |
| Trisodium nitrilotriacetate (monohydrate) | 2.5 g |
| Potassium hydroxide | 1.0 g |
| Add water to make | 1 liter |
| Adjust pH to be | (pH = 10.05) |
| <Bleaching solution> | |
| Iron (III) ammonium ethylene diamine tetraacetate | 100.0 g |
| Diammonium ethylenediamine tetraacetate | 10.0 g |
| Ammonium bromide | 150.0 g |
| Glacial acetic acid | 10.0 ml |
| Add water to make | 1 liter |
| Adjust pH with aqueous ammonia to be | pH = 6.0 |
| <Fixing solution> | |
| Ammonium thiosulfate | 175.0 g |
| Sodium sulfate, anhydrous | 8.5 g |

-continued

| | |
|---|---|
| Sodium metasulfite | 2.3 g |
| Add water to make | 1 liter |
| Adjust pH with acetic acid to be | pH = 6.0 |
| <Stabilizing solution> | |
| Water | 900 ml |
| 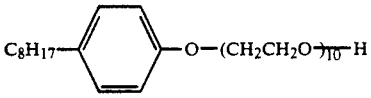 | 2.0 g |
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia or a 50% sulfuric acid solution to be | pH = 8.5 |

The raw-stock stability, processing variations and color reproducibility of samples 1 through 23 were evaluated in the following manners.

Raw-stock preservability

The samples No.40 through No.62 were each preserved for 4 days under the conditions of 50° C. and 80%RH and were then exposed to white light through a sensitometric step-wedge. Successively, they were each processed in the foregoing processing steps A. Next, the resulting green densities S' were measured and the the percentages of the variations between S' and S (i.e., the green densities of the samples before they were preserved as mentioned above.) were calculated out.

$$\text{Variation percentage} = \frac{|S - S'|}{S} \times 100$$

Processing Variation

From each of the D-logE characteristic curves of the green densities measured of each sample, inclination ($\gamma_1$) to the density point on the logE=1.0 higher exposure region side from the point of density 1.0 and inclination ($\gamma_2$) to the density point on the logE=1.0 higher exposure region side from the point of density 2.0 were each obtained. Next, the samples were each exposed to white light through a sensitometric step-wedge in the same manner as mentioned above, and the exposed samples were each processed in quite the same manner as in processing steps A, except that the pH of the color developing solution used in the processing steps A was changed into pH 10.2 (hereinafter referred to as processing steps B). Then, inclinations ($\gamma_1'$) and ($\gamma_2'$) of the characteristic curves were each obtained in the same manner as mentioned above and, further, the differences $\Delta\gamma_1$ and $\Delta\gamma_2$ between processing steps A and B were obtained. Wherein, it is indicated that the smaller the $\Delta\gamma_1$ and $\Delta\gamma_2$ values are, the fewer the processing variations are.

$$\Delta\gamma_1 = \gamma_1' - \gamma_1$$

$$\Delta\gamma_2 = \gamma_2' - \gamma_2$$

Color reproducibility

By making use of each of the samples and a camera (Konica FT-1 MOTOR manufactured by Konica Corp.), a color checker (manufactured by Macbeth Co.) was photographed. In succession, the processing were carried out in quite the same manner as in the foregoing processing steps A and the resulting negative images were printed in a 82 mm×117 mm size on Konica Color Paper Type QAA5 by making use of Konica Color Printer CL-P2000 (manufactured by Konica Corp.). The printing conditions for printing each of the samples were respectively set so that the grey portions of the color checker could be in grey on each print. The color reproducibilities of the resulting practical samples were each visually evaluated. (wherein, the comprehensive evaluations made by the impressions of 10 panelists were graded as follows; ◎: excellent; ○: good; and Δ: little better.)

The results thereof are shown in Table 6.

TABLE 5

| Sample No. | Magenta coupler Layer 6 | Magenta coupler Layer 7 | DIR compound Layer 6 Kind | DIR compound Layer 6 Amount added | DIR compound Layer 7 Kind | DIR compound Layer 7 Amount added | High boiling solvent Layer 6 | High boiling solvent Layer 7 |
|---|---|---|---|---|---|---|---|---|
| 40 (Comparison) | MM-1 | MM-1 | DD-4 | 0.02 | DD-4 | 0.02 | Oil-2 | Oil-2 |
| 41 (Comparison) | MM-1 | MM-1 | D-1 | 0.06 | D-1 | 0.06 | AII-17 | AII-17 |
| 42 (Comparison) | M-4 | M-4 | DD-4 | 0.03 | DD-4 | 0.03 | Oil-2 | Oil-2 |
| 43 (Comparison) | M-4 | M-4 | DD-4 | 0.03 | DD-4 | 0.03 | AI-26 | AI-26 |
| 44 (Comparison) | M-4 | M-4 | D-2 | 0.10 | D-2 | 0.10 | Oil-2 | Oil-2 |
| 45 (Invention) | M-4 | M-4 | D-1 | 0.10 | D-1 | 0.10 | AII-17 | AII-17 |
| 46 (Invention) | M-4 | M-4 | D-2 | 0.10 | D-2 | 0.10 | AII-58 | AII-58 |
| 47 (Invention) | M-4 | M-4 | D-2 | 0.10 | D-2 | 0.10 | AI-10 | AI-10 |
| 48 (Invention) | M-4 | M-4 | D-3 | 0.10 | D-3 | 0.10 | AI-26 | AI-26 |
| 49 (Invention) | M-4 | M-4 | D-4 | 0.10 | D-4 | 0.10 | AI-1 | AI-1 |
| 50 (Invention) | M-4 | M-4 | D-4 | 0.10 | D-4 | 0.10 | AII-9 | AII-9 |
| 51 (Invention) | M-1 | M-1 | D-1 | 0.10 | D-1 | 0.10 | AI-1 | AI-1 |
| 52 (Invention) | M-1 | M-1 | D-4 | 0.10 | D-4 | 0.10 | AII-9 | AII-9 |
| 53 (Invention) | M-2 | M-2 | D-5 | 0.10 | D-5 | 0.10 | AI-20 | AI-20 |
| 54 (Invention) | M-2 | M-2 | D-29 | 0.10 | D-29 | 0.10 | AII-48 | AII-48 |
| 55 (Invention) | M-9 | M-9 | D-6 | 0.10 | D-6 | 0.10 | AII-17 | AII-17 |
| 56 (Invention) | M-9 | M-9 | D-9 | 0.10 | D-9 | 0.10 | AI-32 | AI-32 |
| 57 (Invention) | M-46 | M-46 | D-15 | 0.10 | D-4 | 0.10 | AI-109 | AI-109 |
| 58 (Invention) | M-46 | M-46 | D-16 | 0.10 | D-16 | 0.10 | AII-22 | AII-22 |
| 59 (Invention) | M-50 | M-50 | D-19 | 0.10 | D-19 | 0.10 | AII-51 | AII-51 |
| 60 (Invention) | M-50 | M-50 | D-23 | 0.10 | D-23 | 0.10 | AI-50 | AI-50 |
| 61 (Invention) | M-64 | M-64 | D-24 | 0.10 | D-24 | 0.10 | AI-46 | AI-46 |
| 62 (Invention) | M-64 | M-64 | D-30 | 0.10 | D-30 | 0.10 | AII-56 | AII-56 |

TABLE 6

| Sample No. | Raw-stock preservability | Processing variation Δγ1 | Processing variation Δγ2 | Color reproducibility |
|---|---|---|---|---|
| 40 (Comparison) | 3 | 0.01 | 0.02 | Δ |
| 41 (Comparison) | 4 | 0.02 | 0.03 | Δ |
| 42 (Comparison) | 4 | 0.07 | 0.08 | ○ |
| 43 (Comparison) | 4 | 0.07 | 0.07 | ○ |
| 44 (Comparison) | 10 | 0.04 | 0.04 | ○ |
| 45 (Invention) | 4 | 0.02 | 0.03 | ◎ |
| 46 (Invention) | 4 | 0.02 | 0.03 | ◎ |
| 47 (Invention) | 4 | 0.02 | 0.02 | ◎ |
| 48 (Invention) | 5 | 0.02 | 0.02 | ◎ |
| 49 (Invention) | 4 | 0.02 | 0.03 | ◎ |
| 50 (Invention) | 4 | 0.02 | 0.03 | ◎ |
| 51 (Invention) | 4 | 0.02 | 0.02 | ◎ |
| 52 (Invention) | 4 | 0.02 | 0.03 | ◎ |
| 53 (Invention) | 5 | 0.03 | 0.04 | ◎ |
| 54 (Invention) | 5 | 0.04 | 0.04 | ◎ |
| 55 (Invention) | 5 | 0.03 | 0.03 | ◎ |
| 56 (Invention) | 5 | 0.03 | 0.03 | ◎ |
| 57 (Invention) | 5 | 0.03 | 0.04 | ◎ |
| 58 (Invention) | 5 | 0.03 | 0.04 | ◎ |
| 59 (Invention) | 4 | 0.03 | 0.04 | ◎ |
| 60 (Invention) | 5 | 0.03 | 0.04 | ◎ |
| 61 (Invention) | 5 | 0.04 | 0.05 | ◎ |
| 62 (Invention) | 5 | 0.03 | 0.04 | ◎ |

As shown in Table 6, Samples No.40 and No.41 used therein the comparative couplers are not satisfactory in color reproducibilities, though the raw-stock preservabilities and precessing variations are satisfactory. Samples No.42 and No.43 used therein the couplers of the invention and the comparative DIR are deteriorated in processing variations, though the raw-stock preservabilities are satisfactory. Sample No.44 used therein the coupler of the invention and the comparative DIR is deteriorated in the raw-stock preservability, though the processing variation is satisfactory. In the contrast to the above-mentioned samples, Samples No.45 through No.62 each of the invention are satisfactory in both raw-stock preservabilities and processing variations and they also display the satisfactory color reproducibilities.

EXAMPLE 4

A concrete example of the invention will be detailed below, however, the embodiments of the invention shall not be limited thereto.

In this example, the amounts of the materials added to the silver halide photographic light sensitive materials are indicated in terms of an amount per sq.meter of a subject light sensitive material, unless otherwise expressly stated. The silver halides are indicated by converting them into the silver contents thereof, and the sensitizing dyes and the couplers are indicated in terms of an amount per mol of the silver content of one and the same layer.

On a triacetyl cellulose film support, each of the layers having the following compositions were formed in order from the support side, so that multilayered color photographic light sensitive material samples 101 through 115 were each prepared.

| | |
|---|---|
| Layer 1: Antihalation layer (HC) | |
| A gelatin layer containing black colloidal silver | |
| Dried layer thickness | 3 μm |
| Layer 2: Interlayer (IL) | |
| A gelatin layer containing an emulsified dispersion of 2,5-di-t-octyl hydroquinone | |
| Dried layer thickness | 1.0 μm |
| Layer 3: Low-speed red-sensitive silver halide emulsion layer (RL) | |
| Monodisperse emulsion having an average grain-size of 0.3 μm and comprising AgBrI containing AgI of 3 mol %, (Emulsion I having a distribution range of 12%) | 1.8 g |
| Sensitizing dye I | $6.0 \times 10^{-4}$ mols |
| Sensitizing dye II | $1.0 \times 10^{-4}$ mols |
| Cyan coupler (C-1) | 0.06 mols |
| Colored cyan coupler (CC-1) | 0.003 mols |
| DIR compound (DD-1) | 0.0015 mols |
| DIR compound (DD-2) | 0.002 mols |
| Dioctyl phthalate | 0.6 g |
| Dried layer thickness | 3.5 μm |
| Layer 4: High-speed red-sensitive silver halide emulsion layer (RH) | |
| Monodisperse emulsion having an average grain-size of 0.5 μm and comprising AgBrI containing AgI of 3 mol %, (Emulsion II having a distribution range of 12%) | 1.3 g |
| Sensitizing dye I | $3.0 \times 10^{-4}$ mols |
| Sensitizing dye II | $1.0 \times 10^{-4}$ mols |
| Cyan coupler (C-1) | 0.02 mols |
| Colored cyan coupler (CC-1) | 0.0015 mols |
| DIR compound (DD-2) | 0.001 mols |
| Dioctyl phthalate | 0.2 g |
| Dried layer thickness | 2.5 μm |
| Layer 5: Interlayer (IL) | |
| The same gelatin layer as Layer 2. | |
| Dried layer thickness | 1.0 μm |
| Layer 6: Low-speed green-sensitive silver halide emulsion layer (GL) | |
| Emulsion I | 1.2 g |

-continued

| | |
|---|---|
| Sensitizing dye III | $2.5 \times 10^{-4}$ mols |
| Sensitizing dye IV | $1.2 \times 10^{-4}$ mols |
| Magenta coupler (See Table 7) | |
| Colored magenta coupler (CM-1) | 0.009 mols |
| DIR compound (See Table 7) | |
| Tricresyl phosphate | 0.5 g |
| Dried layer thickness | 3.5 μm |
| Layer 7: High-speed green-sensitive silver halide emulsion layer (GH) | |
| Emulsion II | 1.3 g |
| Sensitizing dye III | $1.5 \times 10^{-4}$ mols |
| Sensitizing dye IV | $1.0 \times 10^{-4}$ mols |
| Magenta coupler (See Table 7) | |
| Colored magenta coupler (CM-1) | 0.002 mols |
| DIR compound (See Table 7) | |
| Tricresyl phosphate | 0.3 g |
| Dried layer thickness | 2.5 μm |
| Layer 8: Yellow filter layer (YC) | |
| A gelatin layer containing an emulsified dispersion of yellow colloidal silver and 2,5-di-t-octyl hydroquinone | |
| Dried layer thickness | 1.2 μm |
| Layer 9: Low-speed blue-sensitive silver halide emulsion layer (BL) | |
| Monodisperse emulsion having an average grain-size of 0.48 μm and comprising AgBrI containing AgI of 3 mol %, (Emulsion III having a distribution range of 12%) | 0.9 g |
| Sensitizing dye V | $1.3 \times 10^{-4}$ mols |
| Yellow coupler (Y-1) | 0.29 mols |
| Tricresyl phosphate | 0.5 g |
| Dried layer thickness | 3.5 μm |
| Layer 10: High-speed blue-sensitive silver halide emulsion layer (BH) | |
| Monodisperse emulsion having an average grain-size of 0.8 μm and comprising AgBrI containing AgI of 3 mol %, (Emulsion IV having a distribution range of 12%) | 0.5 g |
| Sensitizing dye V | $1.0 \times 10^{-4}$ mols |
| Yellow coupler (Y-1) | 0.08 mols |
| DIR compound (DD-2) | 0.0015 mols |
| Tricresyl phosphate | 0.10 g |
| Dried layer thickness | 2.5 μm |
| Layer 11: Protective layer 1 (PRO-1) | |
| A gelatin layer containing 0.5 g of a silver iodobromide emulsion (having an AgI content of 2 mol % and an average grain-size of 0.07 μm) and UV absorbents (UV-1) and (UV-2) | |
| Dried layer thickness | 2.0 μm |
| Layer 12: Protective layer 2 (PRO-2) | |
| A gelatin layer containing polymethyl methacrylate particles (having a diameter of 1.5 μm) and formalin scavengers (HS-1) and (HS-2) | |
| Dried layer thickness | 1.5 μm |

To each of the layers, gelatin hardeners (H-1) and (H-2) and a surfactant were also added, besides the above-given compositions.

Sensitizing dye I : Anhydro-5,5'-dichloro-9-ethyl-3,3'-di-(3-sulfopropyl)thiacarbocyanine hydroxide Sensitizing dye II: Anhydro-9-ethyl-3,3'-di-(3-sulfopropyl)-4,5,4',5'-dibenzothiacarbocyanine hydroxide Sensitizing dye III: Anhydro-5,5'-diphenyl-9-ethyl-3,3'-di-(3-sylfopropyl)oxacarbocyanine hydroxide Sensitizing dye IV : Anhydro-9-ethyl-3,3'-di-(3-sulfopropyl)-5,6,5',6'-dibenzoxacarbocyanine hydroxide Sensitizing dye V : Anhydro-3,3'-di-(3-sulfopropyl)-4,5-benzo-5'-methoxythiacyanine hydroxide C-1
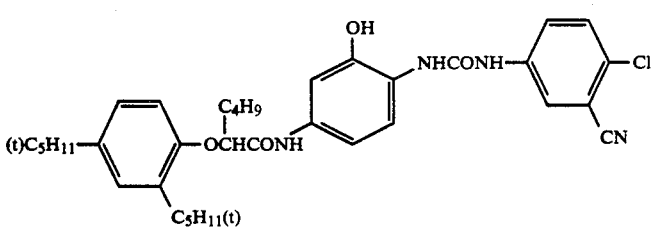
CC-1
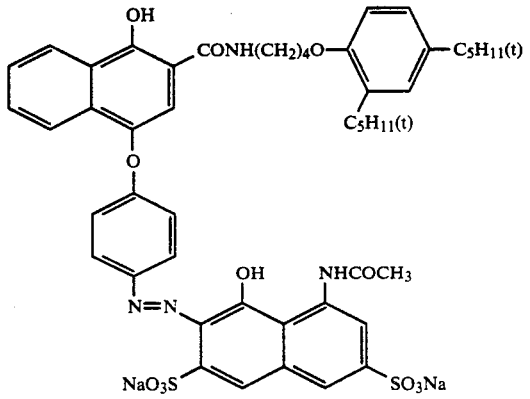
DD-1
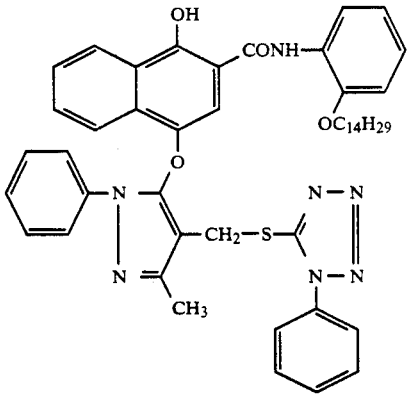
DD-2
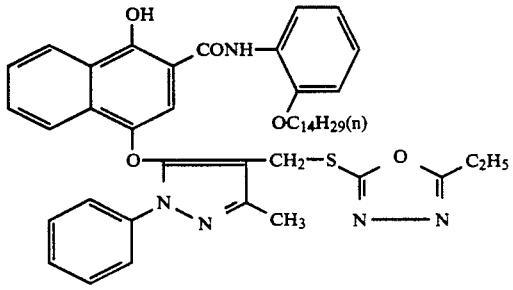

-continued
DD-3
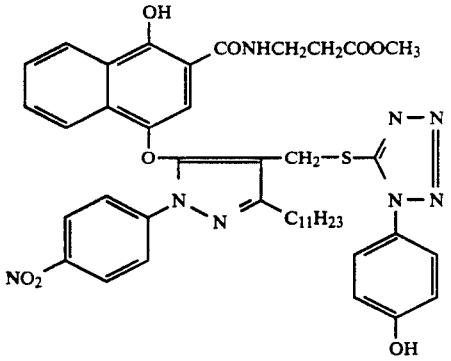
CM-1
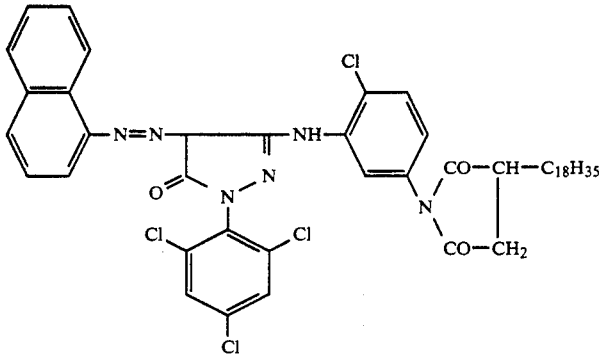
Y-1
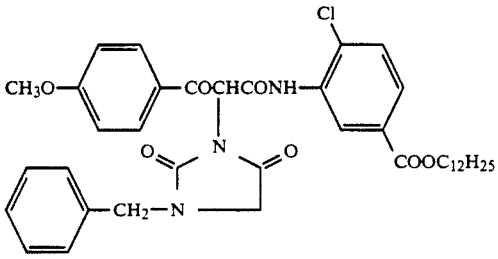
UV-1
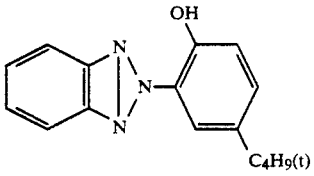
UV-2
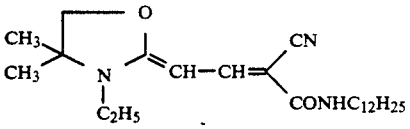
HS-1
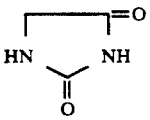
HS-2
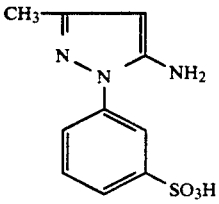

-continued

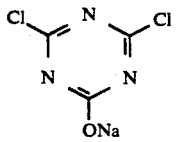

H-1

$CH_2{=}CHSO_2CH_2OCH_2SO_2CH{=}CH_2$ H-2

TABLE 7

| Sample No. | Magenta coupler in Layer 6 Kind | Amount added | Kind | Amount added | Magenta coupler in Layer 7 Kind | Amount added | Kind | Amount added | DIR compound Layer 6 Kind | Amount added | Layer 7 Kind | Amount added |
|---|---|---|---|---|---|---|---|---|---|---|---|---|
| 101 (Comparison) | I-5 | 0.07 | — | — | I-5 | 0.02 | — | — | DD-3 | 0.003 | DD-3 | 0.001 |
| 102 (Comparison) | I-5 | 0.07 | — | — | I-5 | 0.02 | — | — | D-1 | 0.01 | D-1 | 0.008 |
| 103 (Comparison) | I-5 | 0.07 | — | — | I-5 | 0.02 | — | — | D-25 | 0.012 | D-25 | 0.009 |
| 104 (Comparison) | I-5 | 0.04 | II-5 | 0.04 | I-5 | 0.015 | II-5 | 0.01 | DD-3 | 0.003 | DD-3 | 0.001 |
| 105 (Invention) | I-5 | 0.04 | II-5 | 0.04 | I-5 | 0.015 | II-5 | 0.01 | D-1 | 0.01 | D-1 | 0.008 |
| 106 (Invention) | I-5 | 0.04 | II-5 | 0.04 | I-5 | 0.015 | II-5 | 0.01 | D-4 | 0.01 | D-4 | 0.006 |
| 107 (Invention) | I-5 | 0.04 | II-5 | 0.04 | I-5 | 0.015 | II-5 | 0.01 | D-6 | 0.012 | D-6 | 0.008 |
| 108 (Invention) | I-5 | 0.04 | II-5 | 0.04 | I-5 | 0.015 | II-5 | 0.01 | D-19 | 0.01 | D-19 | 0.008 |
| 109 (Invention) | I-5 | 0.04 | II-5 | 0.04 | I-5 | 0.015 | II-5 | 0.01 | D-25 | 0.012 | D-25 | 0.009 |
| 110 (Invention) | I-5 | 0.04 | II-8 | 0.04 | I-5 | 0.015 | II-8 | 0.01 | D-1 | 0.01 | D-1 | 0.008 |
| 111 (Invention) | I-5 | 0.04 | II-9 | 0.04 | I-5 | 0.015 | II-9 | 0.01 | D-1 | 0.01 | D-1 | 0.008 |
| 112 (Invention) | I-5 | 0.04 | II-18 | 0.04 | I-5 | 0.015 | II-18 | 0.01 | D-1 | 0.01 | D-1 | 0.008 |
| 113 (Invention) | I-3 | 0.04 | II-5 | 0.04 | I-10 | 0.015 | II-5 | 0.01 | D-1 | 0.01 | D-1 | 0.008 |
| 114 (Invention) | I-11 | 0.04 | II-5 | 0.04 | I-11 | 0.015 | II-5 | 0.01 | D-1 | 0.01 | D-1 | 0.008 |
| 115 (Invention) | I-59 | 0.04 | II-5 | 0.04 | I-47 | 0.015 | II-5 | 0.01 | D-1 | 0.01 | D-1 | 0.008 |

The amounts added were indicated by mol numbers per mol of silver contained in the same layer.

The resulting photographic materials were exposed to light through a wedge in an ordinary method and were then developed in the processing steps shown in the following Table 8.

TABLE 8

| Processing step | Processing time | Processing temperature | Amount replenished* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*(Amounts replenished were indicated by a value per $m^2$ of the light sensitive materials used.)

The following color developing solution, bleaching solution, fixing solution stabilizing solution and the replenishers thereof were used therein.

| | |
|---|---|
| Color developing solution | |
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium bromide | 1.2 mg |
| Hydroxylamine sulfate | 2.5 g |
| Sodium chloride | 0.6 g |
| 4-amino-3-methyl-N-ethyl-N-(β-hydroxyethyl) aniline sulfate | 4.5 g |
| Diethylenetriamine pentaacetate | 3.0 g |
| Potassium hydroxide | 1.2 g |
| Add water to make | 1 liter |
| Adjust pH with potassium hydroxide or a 20% sulfuric acid solution to be | pH = 10.06 |
| Color developing replenisher | |
| Water | 800 ml |
| Potassium carbonate | 35 g |
| Sodium hydrogencarbonate | 3 g |
| Potassium sulfite | 5 g |
| Sodium bromide | 0.4 g |
| Hydroxylamine sulfate | 3.1 g |

-continued

| | |
|---|---|
| 4-amino-3-methyl-N-ethyl-N-(β-hydroxyethyl) aniline sulfate | 6.3 g |
| Potassium hydroxide | 2 g |
| Diethylenetriamine pentaacetate | 3.0 g |
| Add water to make | 1 liter |
| Adjust pH with potassium hydroxide of a 20% sulfuric acid solution to be | pH = 10.18 |
| Bleaching solution | |
| Water | 700 ml |
| Ferric ammonium 1,3-diaminopropane tetraacetate | 125 g |
| Ethylenediamine tetraacetic acid | 2 g |
| Sodium nitrate | 40 g |
| Ammonium bromide | 150 g |
| Glacial acetic acid | 40 g |
| Add water to make | 1 liter |
| Adjust pH with aqueous ammonia or glacial acetic acid to be | pH = 4.4 |
| Bleaching replenisher | |
| Water | 700 ml |
| Ferric ammonium 1,3-diaminopropane tetraacetate | 175 g |
| Ethylenediamine tetraacetic acid | 2 g |
| Sodium nitrate | 50 g |
| Ammonium bromide | 200 g |
| Glacial acetic acid | 56 g |
| Adjust pH with aqueous ammonia to be | pH = 4.0 |
| Add water to make | 1 liter |
| Fixing solution | |
| Water | 800 ml |
| Ammonium thiocyanate | 120 g |
| Ammonium thiosulfate | 150 g |
| Sodium sulfite | 15 g |
| Ethylenediamine tetraacetic acid | 2 g |
| Adjust pH with glacial acetic acid or aqueous ammonia to be | pH = 6.2 |
| Add water to make | 1 liter |
| Fixing replenisher | |
| Water | 800 ml |
| Ammonium thiocyanate | 150 g |
| Ammonium thiosulfate | 180 g |
| Sodium sulfite | 20 g |
| Ethylenediamine tetraacetic acid | 2 g |
| Adjust pH with glacial acetic acid or aqueous ammonia to be | pH = 6.5 |

-continued

| | |
|---|---|
| Add water to make | 1 liter |
| Stabilizing solution and the replenisher thereof | |
| Water | 900 ml |
| 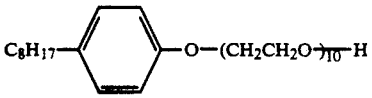 | 2.0 g |
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia or a 50% sulfuric acid solution to be | pH = 8.5 |

Evaluation of the Sensitivity

After completing the treatments, the sensitometric characteristics of the green-light measurements of the resulting samples were each measured.

The sensitivities were each obtained from the reciprocals of the exposure quantities necessary to give a density of fog +0.3 and the sensitivities of Samples 101 through 115 are shown in Table 9 by the values relative to the sensitivity of Sample 101 regarded as a value of 100.

Evaluation of the raw-stock preservability

Samples 101 through 115 were each allowed to stand under the conditions of 40° C. and 80%RH for 7 days so as to be forcibly aged. The resulting samples were exposed to light in the same manner as mentioned above and were then developed similarly. The resulting fog and sensitivities of the green-sensitive layers of the samples were measured. The fog increases (ΔFog) of the forcibly aged samples in comparison to the samples not forcibly aged were measured and the relative sensitivities of the forcibly aged samples were also measure in comparison to those of the samples not forcibly aged which are regarded as a value of 100.

Evaluation of the processing stability

After exposing Samples 101 through 115 to white light through a sensitometric step-wedge in the same manner as mentioned above, the same treatments were made by making use of a color developing solution in which the pH of the foregoing developing solution was changed into 10.4 and 10.0, respectively. The gamma variation values in the straight-line portions on the resulting green density characteristic curves were compared to each other, respectively.

The gamma variation value is the variation ratio of a gamma value B resulted when the pH is 10.4 to the gamma value resulted when pH is 10.0. The gamma variation values were obtained from the following formula.

$$\text{Gamma variation value} = ((B/A) - 1) \times 100.$$

It indicates that the smaller a gamma variation value is, the less the variations are.

The results thereof are collectively shown in Table 9.

TABLE 9

| Sample | Sensitivity | Raw-stock stability ΔFog | Raw-stock stability Relative sensitivity | Gamma variation value in varying pH values |
|---|---|---|---|---|
| 101 (Comparison) | 100 | 0.17 | 74 | 35 |
| 102 (Comparison) | 84 | 0.10 | 88 | 22 |
| 103 (Comparison) | 85 | 0.10 | 89 | 23 |
| 104 (Comparison) | 128 | 0.23 | 95 | 28 |
| 105 (Invention) | 123 | 0.11 | 93 | 18 |
| 106 (Invention) | 122 | 0.11 | 93 | 19 |
| 107 (Invention) | 119 | 0.12 | 92 | 20 |
| 108 (Invention) | 119 | 0.11 | 93 | 20 |
| 109 (Invention) | 120 | 0.11 | 91 | 19 |
| 110 (Invention) | 121 | 0.12 | 93 | 18 |
| 111 (Invention) | 120 | 0.11 | 92 | 18 |
| 112 (Invention) | 120 | 0.11 | 91 | 19 |
| 113 (Invention) | 124 | 0.11 | 94 | 19 |
| 114 (Invention) | 120 | 0.11 | 94 | 19 |
| 115 (Invention) | 117 | 0.10 | 91 | 18 |

As is obvious from Table 9, Samples 105 through 115 each relating to the invention are proved to be high in sensitivity, few in fog-increase and sensitivity lowering when they are forcibly aged, satisfactory in raw-stock preservability and few in gamma variations when the pH values of a color developing solution are varied.

What is claimed is:

1. A silver halide color photographic light-sensitive material comprising a support having thereon a blue-sensitive silver halide emulsion layer, a green-sensitive silver halide emulsion layer and a red-sensitive silver halide emulsion layer, wherein at least one green-sensitive silver halide emulsion layer contains at least one of magenta coupler represented by Formula M-I and at least one compounds represented by Formula D-I, capable of releasing a development inhibitor or a precursor of a development inhibitor, upon reaction with oxidized products of a development agent, Formula M-I

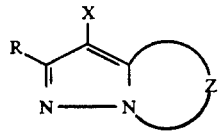

wherein Z represents a group consisting of a non-metal atoms necessary to form a nitrogen containing heterocyclic ring, provided, the ring formed by the Z may have a substituent; X represents a hydrogen atom or a group releasable upon reaction with an oxidized product of a color developing agents; and R represents a hydrogen atom or a substituent, Formula D-I

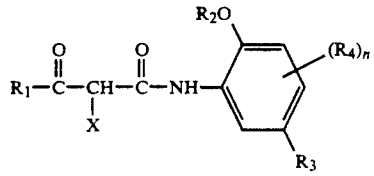

Formula D-I

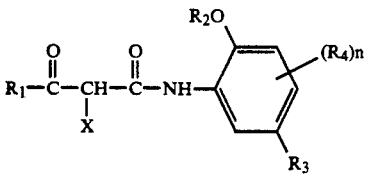

wherein $R_1$ represents an alkyl group, $R_2$ represents an alkyl group or an aryl group, $R_3$ represents an oxycarbonyl group, a sulfonamido group, a carbamoyl group, an acylamino group, an ureido group, an oxycarbonylamino group, a sulfonyloxy group, a carbonyloxy group or a sulfamoyl group, $R_4$ represents a substituent; n is an integer of 0 to 3; X represents a group capable of releasing a development inhibitor or a precursor upon formation of ortho quinonemethide when released by a coupling to an oxidized product of a color developing agent.

2. The silver halide photographic light-sensitive material of claim 1, wherein in Formula D-I, X represents a substituent selected from the group consisting of Formula D-II and Formula D-III, Formula D-II

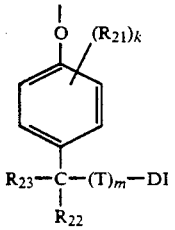

Formula D-III

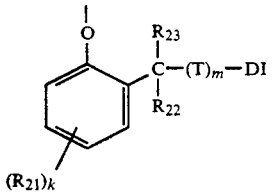

wherein $R_{21}$ represents a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group or an acyl group, k is an integer of 0 to 4; $R_{22}$ and $R_{23}$ represent independently a hydrogen atom, an alkyl group or an aryl group, T represents a linking group, and m is an integer of 0 to 1, DI represents a group cleaved so as to serve as a development inhibitor.

3. The silver halide photographic light-sensitive material of claim 1, wherein the said at least one green-sensitive silver halide emulsion layer further contains at least one colored magenta coupler represented by Formula CM-I, Formula CM-I

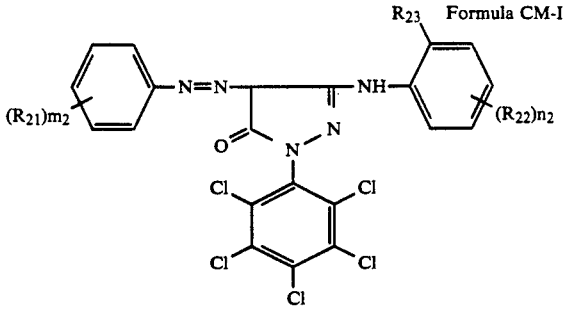

wherein $R_{21}$ represents a substituent, $R_{22}$ represents an acylamino group, a sulfonamido group, an imido group, a carbamoyl group, a sulfamoyl group, an alkoxy group, or an alkoxycarbonylamino group, $R_{23}$ represents a halogen atom or an alkoxy group, $m_2$ is an integer of 0 to 5; and $n_2$ is an integer of 0 to 4.

4. The silver halide photographic light-sensitive material of claim 1, wherein the said at least one green-sensitive silver halide emulsion layer further contains at least one of compound represented by Formula A-I and at least one compound represented by Formula A-II, $$R_{11}—NHSO_2—R_{12}$$ Formula A-I wherein $R_{11}$ and $R_{12}$ independently represent a hydrogen atom, an alkyl group, a cycloalkyl group, an alkenyl group, a cycloalkenyl group, an alkinyl group, an aryl group, a heterocyclic group, an alkoxy group, an aryloxy group,

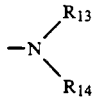

wherein $R_{13}$ and $R_{14}$ represent each a hydrogen atom, an alkyl group or an aryl group, provided, $R_{13}$ and $R_{14}$ may be the same with or the different from each other, Formula A-II

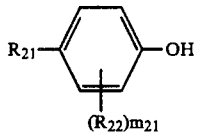

wherein $R_2I$ represents an alkyl group, an alkoxycarbonyl group, an arylsulfonyl group, an alkylsulfonyl group, an arylsulfonylamino group or an alkylsulfonylamino group, $R_{22}$ represents a group substitutable to a benzene ring, and $m_{21}$ is an integer of 0 to 4.

5. The silver halide photographic light-sensitive material of claim 4, wherein Formula A-I represents Formula A-III, $$R_{15}—NHSO_2—R_{16}$$ Formula A-III wherein $R_{15}$ and $R_{16}$ independently represent an alkyl group or an aryl group.

6. The silver halide photographic light-sensitive material of claim 4, wherein in Formula A-II, $R_{21}$ represents an alkyl group having 4 to 20 carbon atoms, an alkoxycarbonyl group having 2 to 20 carbon atoms, a benzenesulfonyl group, a naphthalenesulfonyl group, an alkylsulfonyl group having 1 to 32 carbon atoms, a benzenesulfonylamino group, a naphthalenesulfonylamino group, an alkylsulfonylamino group having 1 to 32 carbon atoms.

7. The silver halide photographic light-sensitive material of claim 1, wherein the said at least one green-sensitive silver halide emulsion layer further contains at least one magenta coupler represented by Formula M-II, Formula M-II

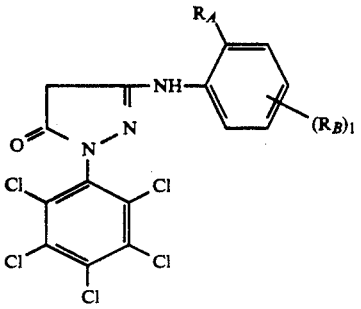

wherein $R_A$ represents a halogen atom or an alkoxy group, $R_B$ represents an acylamino group, a sulfonamido group, an imido group, a carbamoyl group, a sulfamoyl group, an alkoxycarbonyl group, an alkoxycarbonylamino group or an alkoxy group, and 1 is an integer of 0 to 4.

8. The silver halide photographic light-sensitive material of claim 7, wherein the mol ratio between a magenta coupler represented by Formula M-I and the other magenta coupler represented by Formula M-II in a single silver halide emulsion layer is 10:1 to 1:5.

9. A silver halide color photographic light-sensitive material comprising a support having thereon a blue-sensitive silver halide emulsion layer, a green-sensitive silver halide emulsion layer and a red-sensitive silver halide emulsion layer, wherein at least one of green-sensitive silver halide emulsion layers contains at least one of magenta coupler represented by Formula M-I and at least one compound represented by formula D-I capable of releasing a development inhibitor or a precursor of a development inhibitor, upon reaction with oxidized products of a development agent;

Formula M-I

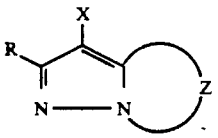

wherein Z represents a group consisting of a non-metal atoms necessary to form a nitrogen containing heterocyclic ring, provided, the ring formed by the Z may have a substituent; X represents a hydrogen atom or a group releasable upon reaction with an oxidized product of a color developing agents; and R represents a hydrogen atom or a substituent;

Formula D-I

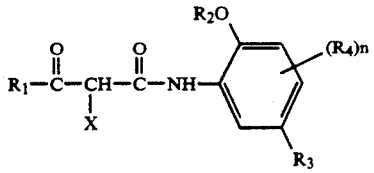

wherein $R_1$ represents an alkyl group, $R_2$ represents an alkyl group or an aryl group, $R_3$ represents an oxycarbonyl group, a sulfonamido group, a carbamoyl group, an acylamino group, an ureido group, an oxycarbonylamino group, a sulfonyloxy group, a carbonyloxy group or a sulfamoyl group, $R_4$ represents a substituent; n is an integer of 0 to 3; X represents a substituent selected from the group consisting of Formula D-II and Formula D-III, Formula D-II

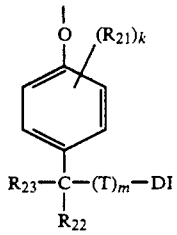

Formula D-III

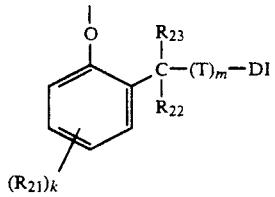

wherein $R_{21}$ represents a halogen atom, an alkyl group, an alkenyl group, an aralkyl group, an alkoxy group, an alkoxycarbonyl group, an anilino group, an acylamino group, an ureido group, a cyano group, a nitro group, a sulfonamido group, a sulfamoyl group, a carbamoyl group, an aryl group, a carboxyl group or an acyl group, k is an integer of 0 to 4; $R_{22}$ and $R_{23}$ represent independently a hydrogen atom, an alkyl group or an aryl group, T represents a linking group, and m is an integer of 0 to 1, DI represents a group cleaved so as to serve as a development inhibitor.

* * * * *

UNITED STATES PATENT AND TRADEMARK OFFICE

CERTIFICATE OF CORRECTION

PATENT NO. : 5,270,156

DATED : December 14, 1993

INVENTOR(S) : Shigeto Hirabayashi et al.

It is certified that error appears in the above-indentified patent and that said Letters Patent is hereby corrected as shown below:

Title page, Abstract, line 6, under Formula D-I, (17th line of text) change "Rrepresents" to --R represents--.

Claim 1, column 140, line 37, delete "of".

Claim 1, column 140, line 40, change "compounds" to --compound--.

Claim 1, column 140, line 53, after "consisting of" delete "a".

Claim 1, column 141, delete duplication of Formula D-I from top of column.

Claim 4, column 142, line 41, change "represent each" to --each represent--.

Claim 4, column 142, line 53, change "$R_2I$" to --$R_{21}$--.

UNITED STATES PATENT AND TRADEMARK OFFICE

CERTIFICATE OF CORRECTION

PATENT NO. : 5,270,156

DATED : December 14, 1993

INVENTOR(S) : Shigeto Hirabayashi et al.

It is certified that error appears in the above-indentified patent and that said Letters Patent is hereby corrected as shown below:

Claim 9, column 143, line 43, delete "of".

Signed and Sealed this

Thirteenth Day of September, 1994

*Attest:*

*Attesting Officer*

BRUCE LEHMAN

*Commissioner of Patents and Trademarks*